US008197048B2

(12) United States Patent
Yamanaka et al.

(10) Patent No.: US 8,197,048 B2
(45) Date of Patent: Jun. 12, 2012

(54) IMAGE FORMING APPARATUS

(75) Inventors: Kunihiro Yamanaka, Kanagawa (JP); Kenichiroh Hashimoto, Kanagawa (JP); Hideyuki Makita, Kanagawa (JP); Takahiro Yoshida, Kanagawa (JP); Kunihiro Miura, Kanagawa (JP); Takafumi Sasaki, Kanagawa (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1415 days.

(21) Appl. No.: 11/786,725

(22) Filed: Apr. 11, 2007

(65) Prior Publication Data

US 2009/0102907 A1 Apr. 23, 2009

(30) Foreign Application Priority Data

Apr. 26, 2006 (JP) ..... 2006-122629
May 17, 2006 (JP) ..... 2006-138314
May 26, 2006 (JP) ..... 2006-146105

(51) Int. Cl.
*B41J 2/14* (2006.01)
*B41J 2/045* (2006.01)

(52) U.S. Cl. ..... 347/94; 347/70; 347/71

(58) Field of Classification Search ..... 347/68–72, 347/94

See application file for complete search history.

(56) References Cited

U.S. PATENT DOCUMENTS 5,777,649 A * 7/1998 Otsuka et al. ..... 347/94
5,818,482 A 10/1998 Ohta et al.
6,193,360 B1 2/2001 Nishiwaki et al.
6,331,052 B1 12/2001 Murai et al.
6,361,155 B1 * 3/2002 Kanda et al. ..... 347/70
6,367,914 B1 4/2002 Ohtaka et al.
6,568,794 B2 5/2003 Yamanaka et al.
6,682,185 B2 1/2004 Hashimoto et al.
6,729,716 B2 5/2004 Eguchi et al.
6,913,348 B2 7/2005 Hashimoto et al.
7,004,570 B2 * 2/2006 Momose ..... 347/68
7,070,263 B2 * 7/2006 Okazawa ..... 347/68
2003/0038868 A1 2/2003 Arai et al.
2003/0067511 A1 * 4/2003 Okazawa ..... 347/68
2003/0214560 A1 11/2003 Yonekubo
2004/0246292 A1 12/2004 Hashimoto et al.
2005/0116992 A1 6/2005 Akahane
2005/0231561 A1 10/2005 Hashimoto (Continued)

FOREIGN PATENT DOCUMENTS

EP 0786346 A2 7/1997

(Continued)

OTHER PUBLICATIONS

Apr. 17, 2009 European search report in connection with a counterpart European patent Application No. 07 25 1648.

(Continued)

*Primary Examiner* — Geoffrey Mruk
(74) *Attorney, Agent, or Firm* — Cooper & Dunham LLP

(57) ABSTRACT

An image forming apparatus is disclosed that includes a liquid discharger including a liquid discharge head configured to discharge a droplet of liquid so as to form an image. The liquid discharge head includes multiple individual channels communicating with corresponding nozzles from which the liquid is discharged; a common channel configured to supply the liquid to the individual channels; a deformable member configured to form at least one wall face of the common channel; and a vibration damping member formed of a viscoelastic material, the vibration member being provided in contact with the deformable member.

11 Claims, 33 Drawing Sheets

U.S. PATENT DOCUMENTS

| | | | |
|---|---|---|---|
| 2006/0066690 | A1 | 3/2006 | Katayama |
| 2006/0103692 | A1 | 5/2006 | Andrews |
| 2006/0238579 | A1 | 10/2006 | Hashimoto et al. |
| 2008/0259127 | A1 | 10/2008 | Andrews |

FOREIGN PATENT DOCUMENTS

| | | | | |
|---|---|---|---|---|
| EP | 1285761 | A1 | | 2/2003 |
| EP | 1657060 | A2 | | 5/2006 |
| JP | 6-305142 | | | 11/1994 |
| JP | 7-171969 | | | 7/1995 |
| JP | 7-323530 | | | 12/1995 |
| JP | 8-20111 | | | 1/1996 |
| JP | 8-281938 | | | 10/1996 |
| JP | 9-248939 | | | 9/1997 |
| JP | 2000-43252 | | | 2/2000 |
| JP | 2000-52553 | | | 2/2000 |
| JP | 2001-353871 | | | 12/2001 |
| JP | 2002-67310 | | | 3/2002 |
| JP | 2002-86721 | | | 3/2002 |
| JP | 2002-086721 | | * | 3/2002 |
| JP | 2002-103608 | | * | 4/2002 |
| JP | 2002-137392 | | | 5/2002 |
| JP | 2003-11357 | | | 1/2003 |
| JP | 2003-34026 | | | 2/2003 |
| JP | 2003-175602 | | | 6/2003 |
| JP | 2003-237082 | | | 8/2003 |
| JP | 2003-311952 | | | 11/2003 |
| JP | 2004-114315 | | | 4/2004 |
| JP | 2004-122428 | | | 4/2004 |
| JP | 2004-209855 | | | 7/2004 |
| JP | 2004-284196 | | | 10/2004 |
| JP | 2004-299345 | | | 10/2004 |
| JP | 2004-351811 | | | 12/2004 |
| JP | 2005-119044 | | | 5/2005 |
| JP | 2005-125631 | | | 5/2005 |
| JP | 2005-205810 | | | 8/2005 |
| JP | 2006-7629 | | | 1/2006 |
| JP | 2006-44133 | | | 2/2006 |
| JP | 2006-76264 | | | 3/2006 |
| JP | 2006-264268 | | | 10/2006 |

OTHER PUBLICATIONS

Aug. 17, 2009 European search report in connection with a counterpart European patent application No. 07 25 1648.

Apr. 13, 2011 Japanese official action in connection with a counterpart Japanese patent application.

Jun. 21, 2011 Japanese official action in connection with counterpart Japanese patent Application No. 2006-122629.

Jun. 21, 2011 Japanese official action in connection with counterpart Japanese patent Application No. 2006-146105.

Nov. 1, 2011 Japanese official action in connection with a counterpart Japanese patent application.

* cited by examiner

IMAGE FORMING APPARATUS

BACKGROUND

1. Technical Field

This disclosure relates to an image forming apparatus.

2. Description of the Related Art

Some common image forming apparatuses such as printers, facsimile machines, copiers, plotters, and those having two or more of the functions of these apparatuses perform image forming (recording or printing) by causing recording liquid (hereinafter also referred to as "ink") as liquid to adhere to a medium (hereinafter also referred to as "paper" or "paper sheet," but not limited to paper in material; "medium to be subjected to recording," "recording medium," "transfer material," and "recording paper" may also be used as synonyms) while conveying the paper, using, for example, a liquid discharger (liquid discharge device) including a recording head formed of a liquid discharge head that discharges liquid droplets of the recording liquid.

The term "image forming apparatus" means an apparatus that performs image forming by discharging liquid onto media such as paper, thread, textile, cloth, leather, metal, plastic, glass, wood, and ceramics. The term "image forming" means not only providing media with significant images such as letters, characters, and figures, but also providing media with insignificant images such as patterns. Further, the term "liquid" is not limited to recording liquid and ink, and may be any liquid as long as it becomes fluid when it is discharged. Further, the term "liquid discharger" means an apparatus that discharges liquid from a liquid discharge head, and is not limited to those performing image forming.

Known liquid discharge heads include those using a piezoelectric actuator formed of a piezoelectric element, those using a thermal actuator formed of a heat element, and those using an electrostatic actuator that generates an electrostatic force, as a pressure generation part (actuator part) for generating pressure to press ink, which is liquid, in an individual channel (hereinafter referred to as "pressure liquid chamber").

The image forming apparatus has been required to output images of higher quality at higher printing rates. The number and the density of nozzles tend to increase in order to meet the former requirement. As a result, the distance between pressure liquid chambers tends to decrease, and the driving frequency for applying discharge energy tends to increase. With respect to the latter requirement, attempts have been made to elongate heads, and a full-line-type head capable of covering the entire area of a medium widthwise has been put into practical use.

In such a liquid discharge head required to have multiple nozzles at high density, the discharge energy applied to a predetermined pressure liquid chamber causes pressure variation or fluctuation of liquid in the pressure liquid chamber, and the pressure variation caused in the pressure liquid chamber also propagates to a common channel (hereinafter referred to as "common liquid chamber") that supplies the liquid to multiple pressure liquid chambers.

If this pressure variation propagated to the common liquid chamber propagates back to the pressure liquid chamber discharging droplets of the liquid, the pressure variation varies the pressure of the pressure liquid chamber so as to prevent the pressure liquid chamber from discharging liquid droplets at a required droplet velocity with a required droplet amount (droplet volume), thus causing ejection failure (discharge failure). Further, if mutual interference, where the pressure variation propagated to the common liquid chamber propagates to an adjacent pressure liquid chamber to affect its liquid, occurs, leakage or discharge of liquid droplets from unintended nozzles and destabilization of a discharge condition are induced. As a result, a high-quality image is prevented from being output.

Therefore, as conventional examples of providing a vibration absorber in the common liquid chamber, Japanese Laid-Open Patent Application No. 7-171969 (Patent Document 1) discloses absorbing pressure in a common liquid chamber at the time of discharging ink by providing a foamed flexible material in the common liquid chamber, and Japanese Laid-Open Patent Application No. 2000-043252 (Patent Document 2) discloses providing a vibration absorber in a common liquid chamber or providing wedge-like projections in the common liquid chamber. Patent Document 2 also discloses providing a vibration absorber in the communication part between an ink pressure chamber and the common liquid chamber.

Further, as an example of providing a damper chamber that absorbs or releases pressure, Japanese Laid-Open Patent Application No. 8-20111 (Patent Document 3) discloses providing a single damper chamber that communicates with common liquid chambers through multiple communicating passages but does not communicates with the atmosphere; and filling the damper chamber with a compressible material for absorbing pressure variations due to pressure waves.

Japanese Laid-Open Patent Application No. 2002-103608 (Patent Document 4) discloses providing damper recesses in a first member different from a second member in which pressure generation chambers are formed with a diaphragm closing the opening of an ink reservoir chamber being provided between the first and second members; forming holes that communicate the damper recesses with the outside; and sealing the openings of the communicating holes with a film.

Japanese Laid-Open Patent Applications No. 2004-284196 (Patent Document 5) and No. 2005-125631 (Patent Document 6) each disclose forming, on a wall face of a common liquid chamber extending in an X direction in which multiple pressure liquid chambers are arranged, a damper surface of a pressure absorber that is lower in rigidity than the other wall faces and absorbs pressure through vibration; and not forming the damper surface entirely along the length of the common liquid chamber in the X direction so as to partially provide an area where the damper surface does not exist.

Japanese Laid-Open Patent Application No. 2004-299345 (Patent Document 7) discloses providing a free oscillation face formed of a thick-wall part and a thin-wall part as at least one of the wall faces of a common liquid chamber.

Japanese Laid-Open Patent Application No. 2005-119044 (Patent Document 8) discloses providing a member having rubber elasticity that absorbs pressure applied to liquid in directions other than the discharge direction because of partial deformation of the shape of a channel on at least a face of a wall of a reservoir that supplies the liquid to multiple channels which face comes into contact with the liquid.

In addition, Japanese Laid-Open Patent Application No. 2004-122428 (Patent Document 9) discloses providing a pressure damping partition wall formed of a low-rigidity material in the partition wall between pressure liquid chambers.

Japanese Laid-Open Patent Application No. 2003-311952 (Patent Document 10) discloses an inkjet head including a first flat plate layer formed of at least one flat plate, in which multiple nozzles for discharging ink and multiple pressure chambers communicating with the corresponding nozzles are formed; a second flat plate layer formed of at least one flat plate, in which a common ink chamber shaped to be elongated in a direction in which the pressure chambers are arranged; an ink channel having one end thereof communicating with each of the pressure chambers and having the other end thereof communicating with the common ink chamber; an ink supply passage connecting the common ink chamber and an ink supply source; a flat plate member in the form of a thin film positioned between the first flat plate layer and the second flat plate layer; and a damper chamber formed of a closed space in a flat plate facing the flat plate member on the side opposite to the common ink chamber.

Japanese Laid-Open Patent Application No. 2006-007629 (Patent Document 11) discloses an inkjet recording head in which multiple damper walls that deflect to absorb a pressure change of a common liquid chamber that supplies ink to individual pressure liquid chambers are formed in a wall that defines the common liquid chamber; and at least one of the damper walls is different in elasticity from the other damper walls.

Japanese Laid-Open Patent Application No. 2004-114315 (Patent Document 12) discloses providing a common liquid chamber with a damper mechanism for absorbing pressure.

Japanese Laid-Open Patent Application No. 2002-67310 (Patent Document 13) discloses stacking multiple members so that pressure generation chambers and a damper chamber are positioned on the same level and the pressure generation chambers and a common liquid chamber adjacent to the damper chamber are positioned on different levels, that the pressure generation chambers and the damper chamber have wall faces thereof formed of a diaphragm, and that the wall part between the common liquid chamber and the damper chamber is formed of an ink supply hole formation plate, in which ink supply holes for supplying ink from the common liquid chamber to the pressure generation chambers are formed.

However, in the case of providing a foamed flexible material or forming a damping structure in a common liquid chamber as disclosed in Patent Documents 1 and 2, there is difficulty in processing, and the cost of parts is high. For example, it is difficult to process and dispose the foamed flexible material. Further, as the driving frequency and the number of nozzles increase, the common liquid chamber pressure tends to increase, thus causing a problem in that it is difficult to ensure absorption and damping of the increasing pressure. Further, since the foamed flexible material is constantly in contact with the liquid in the common liquid chamber, the foamed flexible material is required to be highly resistant to liquid. This narrows the range of choices for material, which may lead to a further increase in the cost of parts. Further, according to the head disclosed in Patent Document 2, since the vibration absorber may be provided in the communication part between the ink pressure chamber and the common liquid chamber, the droplet discharge characteristic itself may be subject to variation.

Further, in the case of providing a damper chamber as disclosed in Patent Documents 3 and 4, it is necessary to perform processing to form the damper chamber, and the increase in part size causes an increase in the cost of parts. In particular, the damper chamber is filled with a compressible member such as air in Patent Document 3. However, controlling the amount of air in the damper chamber is itself difficult, and there is a problem in that if air separated from the damper chamber turns into bubbles to enter a pressure liquid chamber, it is impossible to sufficiently increase the pressure in the pressure liquid chamber, which may result in ejection failure or cause no liquid droplets to be discharged. Further, according to the head disclosed in Patent Document 4, since each ink reservoir chamber is formed on one side of the corresponding pressure generation chambers, and the damper recess parts are disposed next to the corresponding ink reservoir chambers with the diaphragm provided therebetween, it is difficult to ensure a large capacity for each ink reservoir chamber. In particular, in the case of an elongated head such as a line-type head, timely replenishment or supply may not be possible.

Further, an increasing pressure variation per unit time in a head can no longer be managed by forming, on a wall face of a common liquid chamber, a damper surface of a pressure absorber that is lower in rigidity than the other wall faces and absorbs pressure through vibration as disclosed in Patent Documents 5 through 7.

That is, if the pressure absorbing effect of the common liquid chamber is weak in the above-described configuration, as the instantaneous pressure variation becomes greater as in the case of high-frequency driving or discharging large droplets, a greater delay in supplying recording liquid into the common liquid chamber is caused by the pressure. This may prevent recovery of a meniscus so as to cause ejection failure.

Therefore, it is important to ensure early absorption of the pressure in the common liquid chamber in response to a pressure variation increase per unit time due to high-frequency driving. However, in the configuration where the damper surface of the common liquid chamber deforms and vibrates in order to absorb the pressure in the common liquid chamber, if the vibration of the damper surface is not completely damped, the vibration of the damper surface causes a pressure variation so that the meniscus does not completely recover at the time of discharging a droplet. This phenomenon makes it difficult to control a nozzle meniscus and causes undesirable variations in the volume, velocity, and discharge direction of a discharged droplet, thus preventing improvement of image quality.

This phenomenon no longer occurs after discharging is repeated in sequence, that is, after vibration is damped, because recording liquid is steadily supplied to normalize the operation of a meniscus. However, before the vibration of the damper surface is damped, the volume and/or velocity of a discharged droplet may slightly vary at the vibration period of the vibration of the damper surface so as to degrade image quality.

Further, according to the head disclosed in Patent Document 5, since a wall face of the common liquid chamber is formed of a damper surface of a pressure absorber, the area of the thin film part increases, in particular, in an elongated head such as a line-type head, it is difficult for the thin film to maintain rigidity as a part the same as in the head disclosed in Patent Document 11, which leads to a decrease in assembly ability.

Further, in the case of providing a member having rubber elasticity on at least a wall of a reservoir that supplies liquid to multiple channels as disclosed in Patent Document 8, a longer time is necessary before the vibration of the wall face is damped because of reception of a repulsive force generated by the rubber-elasticity member in addition to the above-described problem in the case of absorbing a pressure variation in the common liquid chamber through the vibration of a damper surface. As a result, the volume and/or velocity of a discharged droplet slightly varies at the vibration period of the vibration of the wall face, thus degrading image quality.

According to the inkjet head disclosed in Patent Document 10, the damper (buffer) chamber facing the thin film serving as a wall face of the common liquid chamber absorbs a pressure variation caused in the common liquid chamber.

However, since this damper chamber is closed, an elongated head such as a line-type head particularly has a problem in that a sufficient buffer effect is not produced for a relatively large pressure variation caused in the case of applying energy to multiple pressure liquid chambers, thus causing unstable discharge.

Further, according to the inkjet recording head disclosed in Patent Document 11, part of a wall face of a common liquid chamber is formed of a thin film so as to relax a pressure variation caused in the common liquid chamber the same as in Patent Document 10, but Patent Document 11 is different from Patent Document 10 in that the thin film directly faces the atmosphere and a closed space like the damper chamber is not provided. According to this configuration, it is possible to regard the atmosphere as having an infinite size with respect to the volume of the common liquid chamber, which is sufficient for absorbing pressure variation.

However, since the surface of the thin film has to be in contact with the atmosphere according to this configuration, there is the problem of a greater number of layout restrictions. Further, since the thin film is exposed, there is a problem in that a recording medium and the inkjet recording head may contact each other for some reason (such as a jam) to damage the thin film, thereby causing an outflow of liquid in the common liquid chamber. Particularly, in an elongated head such as a line-type head, the thin film has a large area so that it is difficult for the thin film to maintain rigidity as a part, which leads to a decrease in assembly ability.

According to the head disclosed in Patent Document 12, providing the damper mechanism for absorbing pressure in the common liquid chamber makes the assembling process of the head complicated.

Further, according to the head disclosed in Patent Document 13, the number of parts increases since the wall part between the common liquid chamber and the damper chamber is formed of the ink supply hole formation plate, in which the ink supply holes for supplying ink from the common liquid chamber to the pressure generation chambers are formed.

SUMMARY

According to an aspect of this disclosure, there is provided an image forming apparatus capable of controlling a meniscus with accuracy by ensuring absorption and damping of a pressure variation of a common channel.

According to another aspect, there is provided an image forming apparatus in which mutual interference is efficiently controlled while reducing layout restrictions.

According to another aspect, there is provided an image forming apparatus in which mutual interference is efficiently controlled while reducing layout restrictions with a simple configuration.

According to another aspect, there is provided an image forming apparatus including a liquid discharger including a liquid discharge head, the liquid discharge head being configured to discharge a droplet of liquid so as to form an image, the liquid discharge head including a plurality of individual channels communicating with corresponding nozzles from which the liquid is discharged; a common channel configured to supply the liquid to the individual channels; a deformable member configured to form at least one wall face of the common channel; and a vibration damping member formed of a viscoelastic material, the vibration member being provided in contact with the deformable member.

According to the above-described image forming apparatus, the deformable member forming the one wall face of the common channel deforms in response to a pressure variation in the common channel so as to absorb the pressure variation, and the vibration of the deformable member is damped by the vibration damping member. Accordingly, it is possible to immediately damp the vibration of the deformable member, so that it is possible to perform accurate meniscus control even if there occurs a large pressure variation in the common channel.

According to another aspect, there is provided an image forming apparatus including a liquid discharger including a liquid discharge head, the liquid discharge head being configured to discharge a droplet of liquid so as to form an image, the liquid discharge head including a plurality of individual channels communicating with corresponding nozzles from which the liquid is discharged; a common channel configured to supply the liquid to the individual channels; a buffer chamber adjacent to the common channel through a deformable part; and a communicating path connecting the buffer chamber and an outside.

According to the above-described image forming apparatus, the deformable part serving as a wall face of the buffer chamber is prevented from being exposed to the outside. Accordingly, layout restrictions are reduced. Further, by the buffer chamber communicating with the outside through the communicating path, it is possible to absorb even a large pressure variation so that it is possible to control mutual interference with efficiency.

According to another aspect, there is provided an image forming apparatus including a liquid discharger including a liquid discharge head, the liquid discharge head being configured to discharge a droplet of liquid so as to form an image, the liquid discharge head including a plurality of individual channels communicating with corresponding nozzles from which the liquid is discharged; a diaphragm configured to form at least one wall face of each of the individual channels; a common channel configured to supply the liquid to the individual channels; a damper chamber formed of a member forming the individual channels, the damper chamber being adjacent to the common channel; and a deformable part configured to form a wall part between the damper chamber and the common channel, the deformable part being a part of the diaphragm.

According to the above-described image forming apparatus, it is possible to provide the common channel separately from the channel member, so that it is possible to ensure capacity of the common channel. Further, since the deformable part serving as a wall face of the damper chamber is prevented from being exposed to the outside, layout restrictions are reduced. Further, it is possible to absorb a pressure variation and to control mutual interference with efficiency.

BRIEF DESCRIPTION OF THE DRAWINGS

Other aspects, features and advantages will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 1:
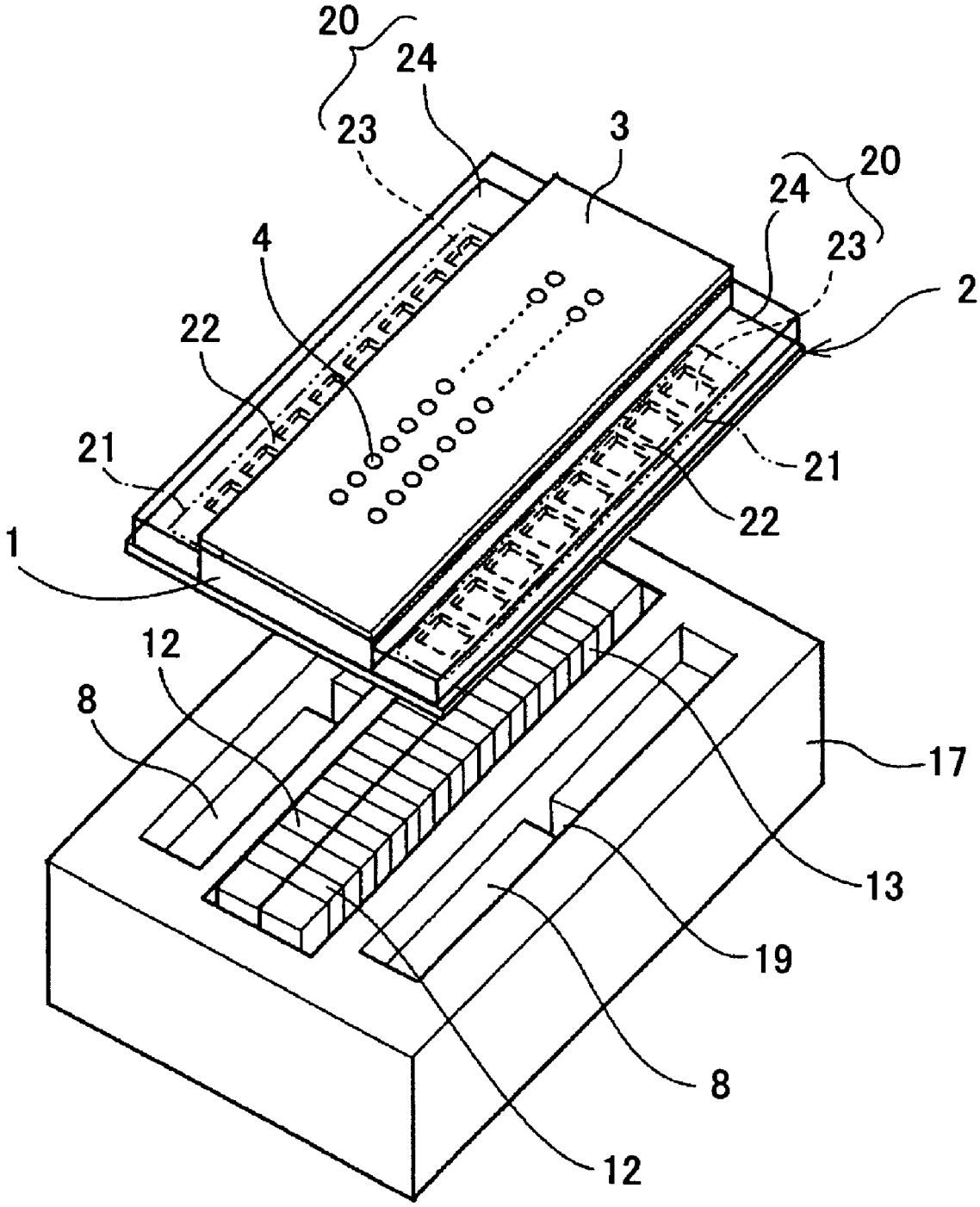
FIG. 1 is an exploded perspective view of a liquid discharge head according to a first embodiment of the present invention.
Figure 2:
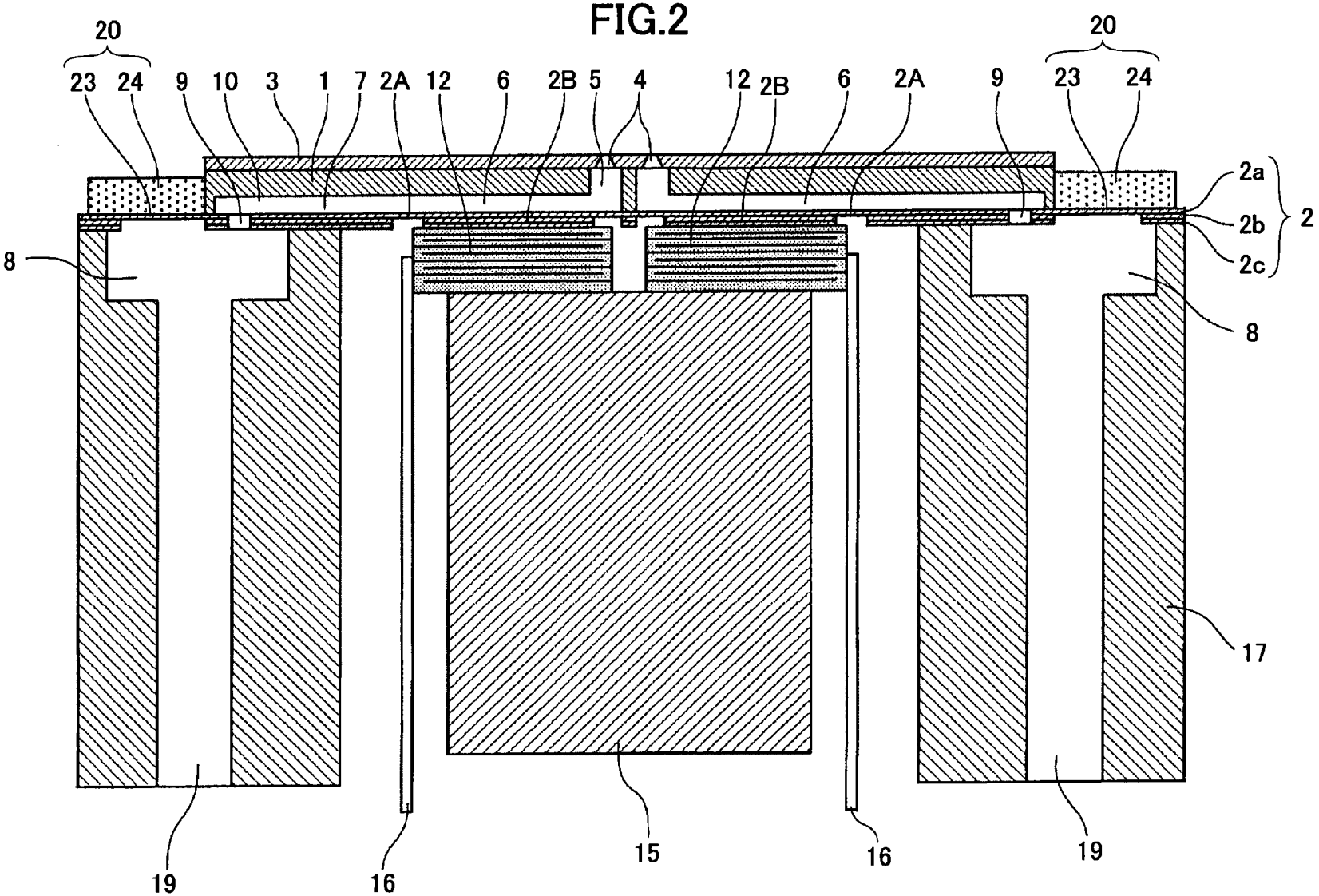
FIG. 2 is a cross-sectional view of the liquid discharge head taken along the length of a pressure liquid chamber of the liquid discharge head according to the first embodiment of the present invention.
Figure 3:
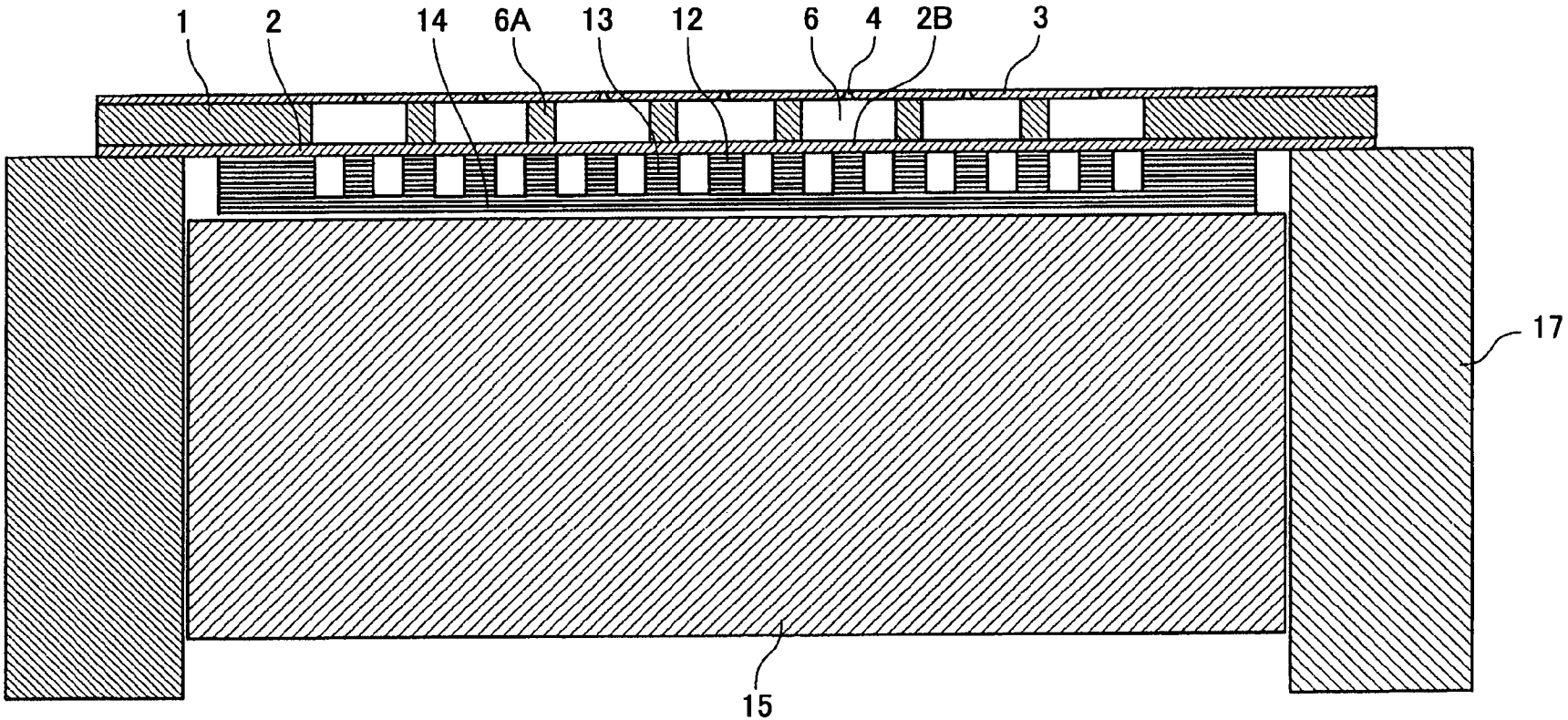
FIG. 3 is a longitudinal-sectional view of the liquid discharge head taken along the width of the pressure liquid chamber of the liquid discharge head according to the first embodiment of the present invention.

First, a description is given, with reference to FIGS. 1 through 3, of a liquid discharge head according to a first embodiment of the present invention. FIG. 1 is an exploded perspective view of the liquid discharge head. FIG. 2 is a cross-sectional view of the liquid discharge head taken along the length of a pressure liquid chamber of the liquid discharge head (the directions perpendicular to the directions in which nozzles are arranged). FIG. 3 is a longitudinal-sectional view of the liquid discharge head taken along the width of the pressure liquid chamber of the liquid discharge head (the directions in which the nozzles are arranged).

The liquid discharge head includes a channel plate (liquid chamber base plate) 1, a diaphragm member 2 joined to the lower surface of the channel plate 1, and a nozzle plate 3 joined to the upper surface of the channel plate 1, thereby forming pressure liquid chambers (also referred to as "pressure chambers" or "channels") 6 serving as individual channels and fluid resistance parts 7. The pressure liquid chambers 6 communicate with corresponding nozzles 4, through which liquid droplets (droplets of liquid) are discharged, via corresponding nozzle communicating paths (communicating tubes) 5. The fluid resistance parts 7 also serve as supply channels for supplying ink (recording liquid) to the corresponding pressure liquid chambers 6.

Here, the openings of the pressure liquid chambers 6 and the fluid resistance parts 7 are formed in the channel plate 1 by subjecting a SUS substrate to etching with an acid etching liquid or mechanical processing such as blanking. The channel plate 1 may be integrally formed with the nozzle plate 3 or the diaphragm member 2 by electroforming. Further, the channel plate 1 may also be formed by subjecting a (110) single-crystal silicon substrate to anisotropic etching using an alkaline etching liquid such as a potassium hydroxide (KOH) aqueous solution. Photosensitive resin may also be used as the channel plate 1.

The diaphragm member 2 has a three-layer structure of nickel plates, which are a first layer 2*a*, a second layer 2*b*, and a third layer 2*c* from the pressure liquid chamber 6 side as shown in FIG. 2. The diaphragm member 2 is formed by, for example, electroforming. The diaphragm member 2 may also be formed of a lamination member of, for example, a resin member of polyimide and a metal plate such as a SUS substrate, or of a resin member.

The nozzle plate 3, in which the multiple nozzles 4 corresponding to the pressure liquid chambers 6 are formed, is joined to the channel plate 1 with an adhesive agent. The nozzle plate 3 may be formed of metal such as stainless steel or nickel, resin such as a polyimide resin film, silicon, or a combination of two or more thereof. The nozzles 4 are each formed to have a horn-like internal (interior) shape. The nozzles 4 may also be formed to have a substantially cylindrical or truncated corn-like internal shape. The hole diameter of each nozzle 4 is approximately 20 to 35 μm on the ink droplet exit side. Further, the nozzles 4 are arranged with a nozzle pitch of 150 dpi in each array.

Further, a water-repellent layer (not graphically illustrated) on which water-repellent surface treatment is performed is provided on the nozzle surface (surface in the discharge direction or discharge surface) of the nozzle plate 3. A water-repellent film selected in accordance with the physical properties of recording liquid is provided as the water-repellent layer, thereby stabilizing the droplet shape and flying characteristics of the recording liquid to produce high image quality. The water-repellent film may be formed by, for example, performing PTFE-Ni eutectoid plating, performing electropainting of fluororesin, depositing evaporative fluororesin (such as pitch fluoride) as a coating, or baking a silicon-based or fluorine-based resin solvent after its application.

As shown in FIG. 2, in the diaphragm member 2, projecting parts 2B of a two-layer structure of the second layer 2*b* and the third layer 2*c* are formed in correspondence to the pressure liquid chambers 6 in the center part of a diaphragm part 2A, which is a deformable area formed of the first layer 2*a*. A piezoelectric element 12 forming a pressure generation part (actuator part) is joined to each projecting part 2B. Further, support parts 13 are joined to the three-layer structure parts (thick wall parts 2B) so as to correspond to partition walls 6A of the pressure liquid chambers 6.

These piezoelectric elements 12 and support parts 13 are formed by dividing a stacked piezoelectric element member 14 in a comb-teeth manner by performing slitting by half-cut dicing on the stacked piezoelectric element member 14. The support parts 13 are also piezoelectric elements, but merely serve as supports since no driving voltage is applied thereto. This stacked piezoelectric element member 14 is joined to a base member 15.

Each piezoelectric element 12 (piezoelectric element member 14) is, for example, alternately stacked layers of lead zirconate titanate (PZT) piezoelectric layers each of 10 to 50 μm in thickness and silver-palladium (AgPd) internal electrode layers each of several μm in thickness. The internal electrodes are electrically connected alternately to an individual electrode and a common electrode, which are end face electrodes (external electrodes) at respective end faces. A driving signal is provided to these electrodes through a corresponding FPC cable 16.

The recording liquid in the pressure liquid chambers 6 may be pressurized using displacement in either the d33 direction or the d31 direction as the piezoelectric direction of the piezoelectric elements 12. According to the configuration of this embodiment, displacement in the d33 direction is employed.

Preferably, the base member 15 is formed of a metal material. If the material of the base member 15 is metal, it is possible to prevent the piezoelectric elements 12 from storing heat due to self-heating. The piezoelectric elements 12 and the base member 15 are bonded with an adhesive agent. However, an increase in the number of channels causes the temperatures of the piezoelectric elements 12 to increase to nearly 100° C. because of their self-heating, thus extremely reducing the bonding strength. Further, the self-heating of the piezoelectric elements 12 increases the internal temperature of the head, thus causing an increase in ink temperature. The increase in ink temperature reduces ink viscosity, thus greatly affecting ejection characteristics. Accordingly, forming the base member 15 of a metal material and thereby preventing the piezoelectric elements 12 from storing heat due to their self-heating make it possible to prevent such a decrease in bonding strength and degradation of ejection characteristics due to reduction in the viscosity of recording liquid.

Further, a frame member 17 formed of, for example, an epoxy resin or polyphenylene sulfide by injection molding is joined to the periphery of the diaphragm member 2 with an adhesive agent.

Common liquid chambers 8 that supply recording liquid to each pressure liquid chamber 6 are formed in the frame member 17. The recording liquid is supplied from the common liquid chambers 8 to the pressure liquid chambers 6 through supply holes 9 formed in the diaphragm member 2, channels 10 formed on the upstream side of the fluid resistance parts 7, and the fluid resistance parts 7. Recording liquid supply holes 19 for externally supplying recording liquid to the common liquid chambers 8 are also formed in the frame member 17. Further, as shown in FIG. 1, each common liquid chamber 8 is formed to have a rectangular planar shape in the directions in which the pressure liquid chambers 6 are arranged (the nozzle arrangement directions, which may be determined as "common liquid chamber longitudinal directions").

Further, damper parts 20 for absorbing and damping pressure variations in the common liquid chambers 8 are provided. Each damper part 20 includes thin-wall parts 23 and a damper material 24. Each thin-wall part 23 is a deformable member that forms at least one wall face of the corresponding common liquid chamber 8. The damper material 24 is a vibration damping member that is in contact with the thin-wall parts 23 to damp the vibrations of the thin-wall parts 23.

Figure 4:
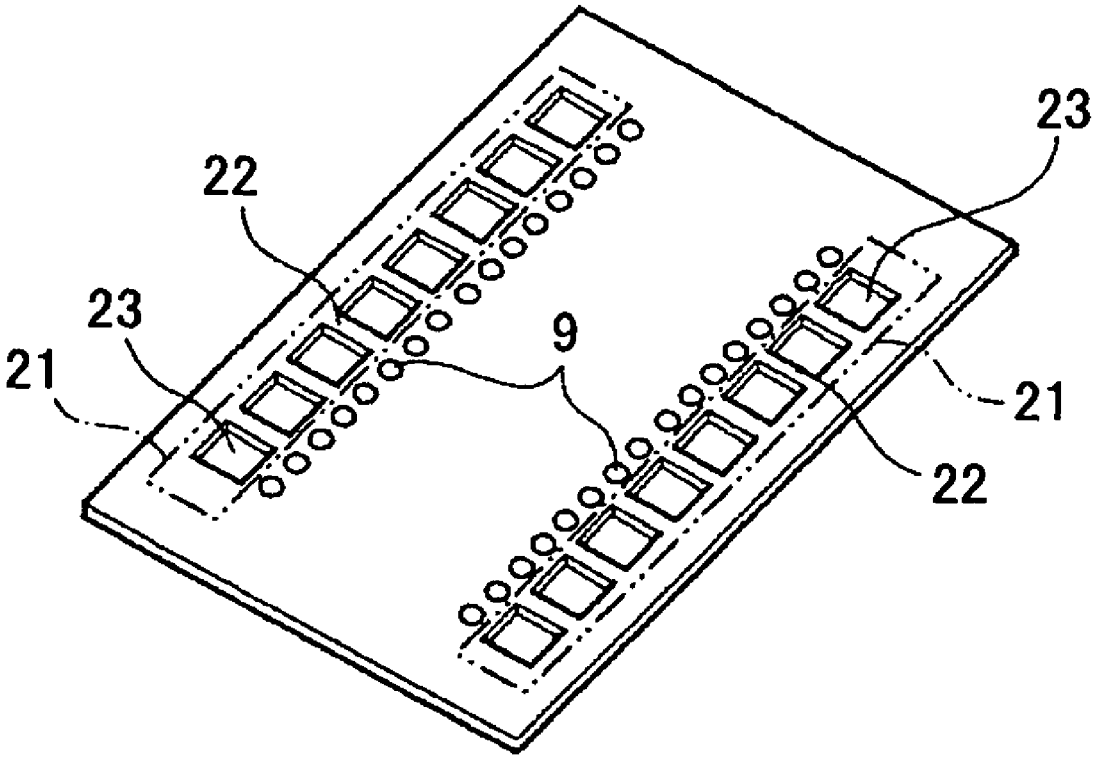
FIG. 4 is a perspective view of a diaphragm member of the liquid discharge head from the common liquid chamber side according to the first embodiment of the present invention.

That is, a wall face of each common liquid chamber 8 is formed of the diaphragm member 2 that forms wall faces of the pressure liquid chambers 6, and the part forming this wall face of each common liquid chamber 8 is determined as a free vibration (oscillation) surface (damper area) 21. As shown in FIG. 4, which is a perspective view of the diaphragm member 2 from the common liquid chamber 8 side, this free vibration surface 21 includes thick-wall parts 22 and the thin-wall parts (diaphragm parts) 23. The thick-wall parts 22 are formed of the three-layer structure part (the first through third layers 2*a* through 2*c*) of the diaphragm member 2 having a three-layer structure. The thin-wall parts (diaphragm parts) 23 are planar rectangular deformable parts formed of a single-layer structure part of the first layer 2*a* of the diaphragm member 2 formed by partially removing the second layer 2*b* and the third layer 2*c*. In this case, the thick-wall parts 22 and the thin-wall parts 23 are alternately arranged like stripes in the longitudinal directions of the common liquid chambers 8 (nozzle arrangement directions).

Here, the thin-wall parts 23, which are deformable members that form at least one wall face of each common liquid chamber 8, and the diaphragm member 2 are formed as a unit. Since the deformable members and the member forming a wall face of each pressure liquid chamber (the diaphragm member 2 in this case) are formed as a unit, it is possible to reduce the number of components and the number of manufacturing processes of the head, so that it is possible to reduce the manufacturing cost of the head. Further, since the deformable members (thin-wall parts 23) have the same thickness as the member forming a wall face of each pressure liquid chamber, it is easy to form the deformable members and the member forming a wall face of each pressure liquid chamber as a unit.

The thick-wall parts 22 may have a two-layer structure and the thin-wall parts 23 may have a single-layer structure. Alternatively, the thick-wall parts 22 may have a three-layer structure and the thin-wall parts 23 may have a two-layer structure. Further, it is preferable that the diaphragm member 2, which forms a wall face of each common liquid chamber 8, have resistance to ink (resistance to liquid) at least on the common liquid chamber 8 side.

Further, the damper material 24 is provided on each free vibration surface 21 as a vibration damping member formed of a viscoelastic material that is in contact with the thin-wall parts 23 to damp the vibrations of the thin-wall parts 23. According to this embodiment, the damper material 24 is, but does not necessary have to be, formed on the entire surface of each free vibration surface 21. It is preferable that the damper material 24 be formed on at least the deformable thin-wall parts 23 of each free vibration surface 21. The thin-wall parts 23 are deformable in order to absorb pressure in the corresponding common liquid chamber 8, and it is possible to perform accurate meniscus control by providing the damper material 24 with the function of damping the vibrations of the thin-wall parts 23.

Further, according to this embodiment, the damper material 24 is provided on the side of the deformable members (thin-wall parts 23) opposite to the common liquid chambers 8 so as to be out of contact with liquid (ink in this embodiment) in the common liquid chambers 8. Therefore, the damper material 24 may not have resistance to liquid (resistance to ink), thus widening the range of choices for each of the liquid (ink) and the viscoelastic material. As a result, it is easy to lower the manufacturing cost of the head, and to improve image quality because of an increase in usable ink types.

Further, the damper material 24 can be provided by applying its stock solution on the free vibration surfaces 21 on the side opposite to the common liquid chambers 8 with a dispenser and setting the applied stock solution with heat or ultraviolet rays, thus facilitating manufacture.

As described above, the damper material 24 is formed of a viscoelastic material. When the thin-wall parts 23 vibrate in accordance with pressure variations in the common liquid chambers 8, these variations cannot be reduced in a short time with an elastic material alone. As a result, the vibrations of the thin-wall parts 23 are transmitted to the liquid in the common liquid chambers 8, and are, on the contrary, propagated into the pressure liquid chambers 6. On the other hand, by using a viscoelastic material having both elasticity and viscosity, it is possible to damp the vibrations of the thin-wall parts 23 by absorbing the vibrations with the viscoelastic material.

A gel material, particularly silicone gel, whose changes in elasticity and viscosity with respect to temperature are limited, is preferable as the viscoelastic material. Further, it is preferable that the viscoelastic material be higher in viscosity than the liquid in the common liquid chambers 8, which is effective in absorbing and damping pressure and vibration in the common liquid chambers 8. Examples of the gel viscoelastic material include, in addition to silicone gel, urethane-based, styrene-based, and olefin-based gel materials.

In addition to applying and setting a stock solution, the damper material 24 may also be formed by disposing a molded article.

According to the liquid discharge head thus configured, for example, the piezoelectric element 12, which may be any of the multiple piezoelectric elements 12, contracts in response to a decrease in the voltage applied thereto from a reference electric potential, so that the diaphragm member 2 moves downward to expand the volume of the corresponding pressure liquid chamber 6. As a result, ink flows into the pressure liquid chamber 6. Thereafter, the voltage applied to the piezoelectric element 12 is increased to expand the piezoelectric element 12 in its stacking direction, thereby deforming the diaphragm member 2 toward the nozzle 4 to contract the volume of the pressure liquid chamber 6. As a result, the recording liquid in the pressure liquid chamber 6 is pressurized so that a droplet of the recording liquid is discharged (ejected) from the nozzle 4.

Then, by returning the voltage to be applied to the piezoelectric element 12 to the reference electric potential, the diaphragm member 2 is restored to its initial position, so that the pressure liquid chamber 6 expands to generate a negative pressure. Accordingly, at this point, the pressure liquid chamber 6 is filled with the recording liquid from the corresponding common liquid chamber 8. Then, after the vibration of the meniscus surface of the nozzle 4 damps so that the meniscus surface is stabilized, the liquid discharge head proceeds to an operation for discharging the next liquid droplet.

The method of driving this head is not limited to the above-described example (pull-push ejection). Pull-ejection or push-ejection can also be performed depending on how the driving waveform is provided.

When a pressure variation is thus caused in the pressure liquid chamber 6 in order to discharge a liquid droplet from the nozzle, the pressure variation in the pressure liquid chamber 6 is propagated to the corresponding common liquid chamber 8 through the fluid resistance part 7.

As a result, if the damper parts 20 are not provided or if the damper material 24 is not provided although the thin-wall parts 23 are provided, the pressure variation propagated to the common liquid chamber 8 is propagated back to the pressure liquid chamber 6 or propagated to one or more of the other pressure liquid chambers 6, thereby varying the pressures of the pressure liquid chambers 6 for discharging liquid droplets. As a result, a liquid droplet is prevented from being discharged with a required volume or at a required velocity, or the pressure of the pressure liquid chamber 6 that is not to discharge a liquid droplet is varied to destroy the meniscus of the nozzle 4, so that the recording liquid may leak out or a liquid droplet may be discharged.

On the other hand, according to the liquid discharge head of this embodiment, the thin-wall parts 23, formed as part of the diaphragm member 2, are provided in each common liquid chamber 8. Accordingly, when a pressure vibration is propagated to the common liquid chamber 8, the thin-wall parts 23 deforms (are displaced) to absorb the pressure variation. At this point, the thin-wall parts 23 are displaced in accordance with a pressure variation in the common liquid chamber 8, and accordingly, try to vibrate. However, since the damper material 24 formed of a viscoelastic material is in contact with the thin-wall parts 23, the vibrations of the thin-wall parts 23 are absorbed and damped by the damper material 24. Accordingly, the vibrations of the thin-wall parts 23 according to the pressure variation in the common liquid chamber 8 are controlled (damped).

That is, merely providing the thin-wall parts 23 and causing the thin-wall parts 23 to deform in accordance with a pressure variation in the common liquid chamber 8 results in the vibrations of the thin-wall parts 23, and a pressure variation due to the vibrations of the thin-wall parts 23 varies liquid in the common liquid chamber 8. This variation of the liquid in the common liquid chamber 8 is propagated to one or more of the corresponding pressure liquid chambers 6, so that their meniscuses do not completely recover at the time of discharging droplets. This phenomenon makes it difficult to control a nozzle meniscus and causes undesirable variations in the volume, velocity, and discharge direction of a discharged droplet, thus preventing improvement of image quality. This phenomenon no longer occurs after discharging is repeated in sequence, that is, after the vibrations of the thin-wall parts 23 damp, because the recording liquid is steadily supplied to normalize the operation of a meniscus. However, before the vibrations of the thin-wall parts 23 damp, the volume and/or velocity of a discharged droplet may slightly vary at the vibration period of the vibrations of the thin-wall parts 23 so as to degrade image quality.

Therefore, by absorbing and damping the vibrations of the thin-wall parts 23 with the damper material 24 formed of a viscoelastic material as in this liquid discharge head, it is possible to reduce the variation of liquid in the common liquid chamber 8 and thereby to enable early control of a pressure variation. In this case, if the damper material 24 is formed of a rubber elastic member instead of a viscoelastic member, the effect of shifting the vibration frequency to a slightly lower frequency can be expected, but the vibration itself cannot be controlled because the vibration damping effect is limited. The viscous characteristic of the damper material 24 is very effective in order to control vibration itself.

Thus, the liquid discharge head of this embodiment includes a deformable member that forms at least one wall face of a common channel; and a vibration damping member formed of a viscoelastic material, which is provided in contact with the deformable member. Accordingly, the deformable member forming the one wall face of the common channel deforms in response to a pressure variation in the common channel so as to absorb the pressure variation, and the vibration of the deformable member is damped by the vibration damping member. As a result, it is possible to immediately damp the vibration of the deformable member, so that it is possible to perform accurate meniscus control even if there is a great pressure variation in the common channel.

Further, by forming the thin-wall parts 23 as the same layer and with the same thickness as (the first layer 2*a* of) the diaphragm member 2 disposed at one surface of each pressure liquid chamber 6 so that the thin-wall parts 23 and the diaphragm member 2 are formed as a unit, it is possible to reduce the number of components of the head and to form the deformable area of each pressure liquid chamber 6 and the thin-wall parts 23 on each common liquid chamber 8 simultaneously in the same process. Further, after forming the part forming the pressure liquid chambers 6 and the part forming the common liquid chambers 8, the pressure liquid chamber part and the common liquid chamber part can be formed by once joining the parts to the layer formed of the diaphragm member 2 and the free vibration surfaces 21. Therefore, it is possible to reduce the manufacturing cost, the number of manufacturing processes, and the number of assembling processes of the head.

According to this embodiment, a piezoelectric element is employed as a pressure generation part. However, the pressure generation part in the liquid discharge head according to this embodiment is not limited, and pressure may also be generated by heating a heating element and generating bubbles in liquid with the action of heat energy.

Second Embodiment

Figure 5:
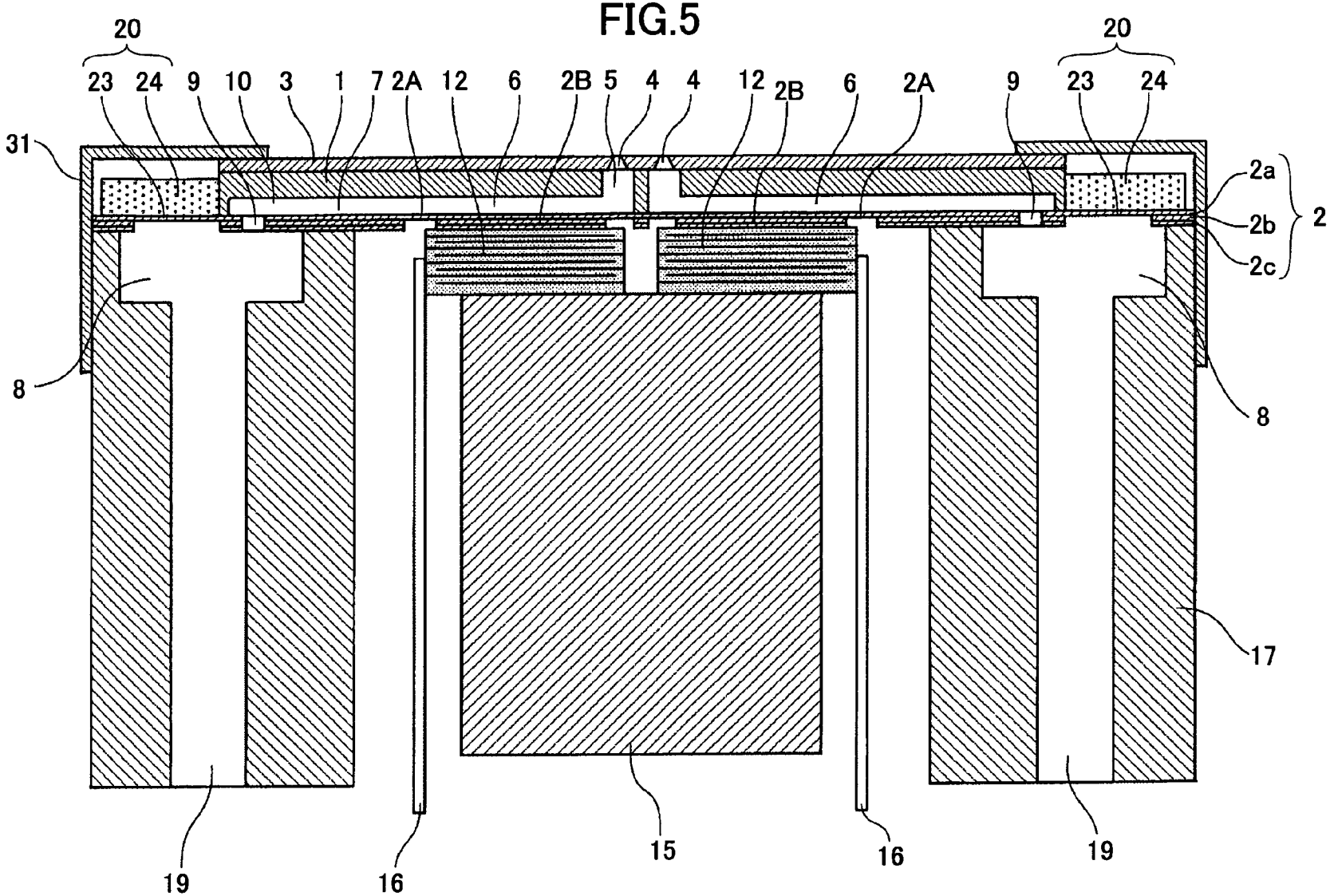
FIG. 5 is a cross-sectional view of a liquid discharge head taken along the length of a pressure liquid chamber of the liquid discharge head according to a second embodiment of the present invention.

Next, a description is given, with reference to FIG. 5, of a liquid discharge head according to a second embodiment of the present invention. FIG. 5 is a cross-sectional view of the liquid discharge head taken along the length of a pressure liquid chamber of the liquid discharge head. In FIG. 5, the same elements as those of the first embodiment are referred to by the same reference numerals.

This head includes a nozzle cover 31 that protects the periphery of the nozzle plate 3. The nozzle cover 31 also serves as a member to protect the damper parts 20.

The nozzle cover 31 can protect the damper parts 20 from contact with the outside or contamination, so that it is possible to prevent damage to the liquid discharge head and degradation of its characteristics. Here, examples of "contact with the outside" includes contact with other parts, an assembler, jigs, and human hands during a manufacturing process and contact with paper due to a paper jam in an image forming apparatus. Further, it is also possible to prevent ink (liquid) from coming into contact with and corroding the damper material 24 forming the damper parts 20 on the discharge surface side of the nozzle plate 3.

Third Embodiment

Figure 6:
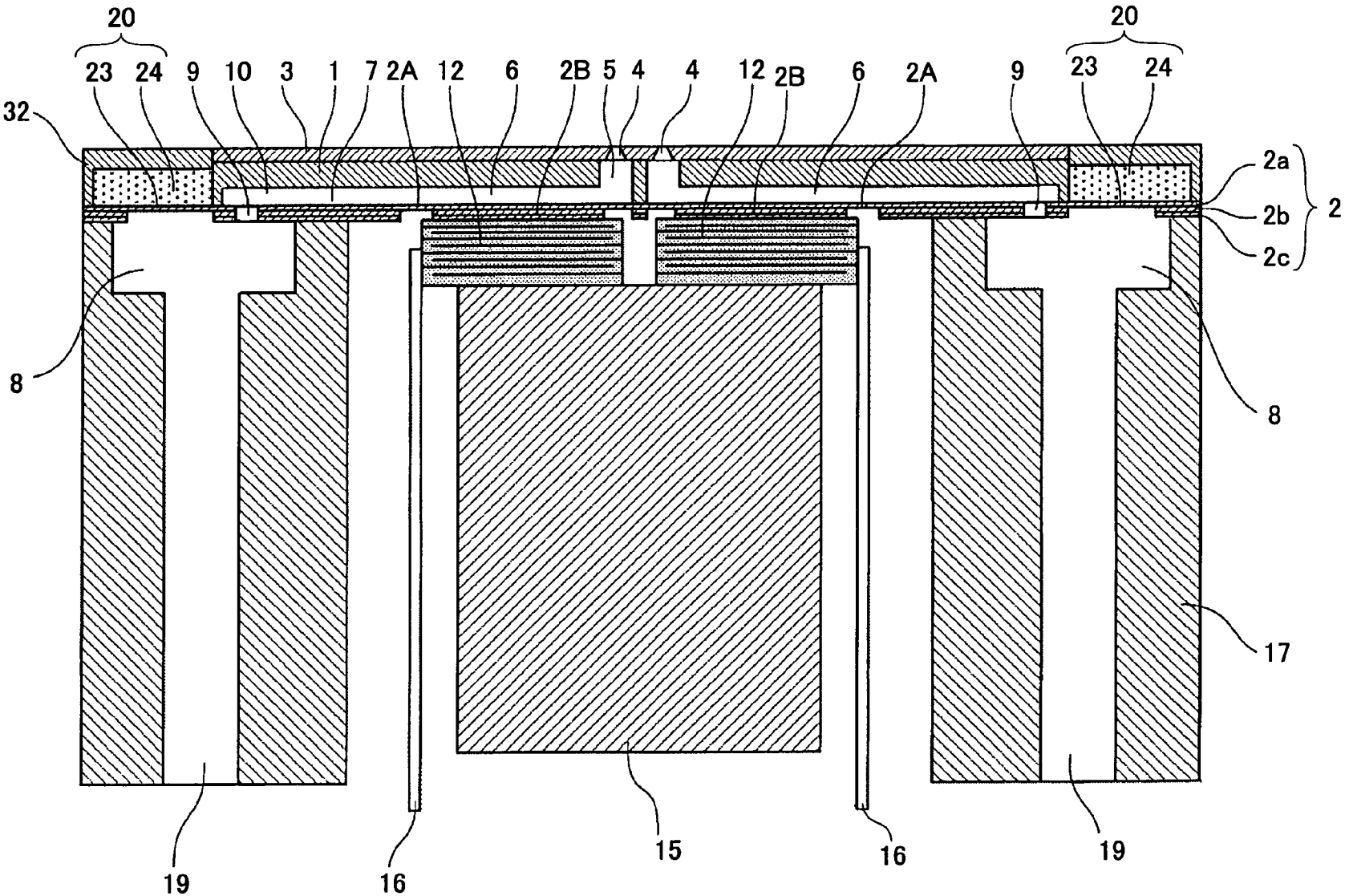
FIG. 6 is a cross-sectional view of a liquid discharge head taken along the length of a pressure liquid chamber of the liquid discharge head according to a third embodiment of the present invention.

Next, a description is given, with reference to FIG. 6, of a liquid discharge head according to a third embodiment of the present invention. FIG. 6 is a cross-sectional view of the liquid discharge head taken along the length of a pressure liquid chamber of the liquid discharge head. In FIG. 6, the same elements as those of the first embodiment are referred to by the same reference numerals.

This head includes a protection layer 32 that covers the surface of the damper material 24. The protection layer 32 may be formed by depositing fluororesin (such as pitch fluoride) or by baking or setting with ultraviolet rays a solvent of a silicon-based resin, a fluorine-based resin, an epoxy resin, or polyimide after its application. It is preferable that the protection layer 32 be a solid with tack in terms of easiness of handling in manufacturing the head. Further, it is preferable that the protection layer 32 have resistance to liquid (resistance to ink).

By thus protecting the damper material 24 having the function of damping vibration with the protection layer 32, it is possible to improve durability while maintaining manufacturing yield and head characteristics.

In each of the above-described embodiments, by using a material with resistance to liquid (resistance to ink) for the damper material 24, it is possible to prevent the damper material 24 from being dissolved or removed from the thin-wall parts 23 and thus to prevent degradation of the characteristics of the liquid discharge head even if the damper material 24 comes into contact with discharged ink or there is a pin hole in the thin-wall parts 23.

Figure 7:
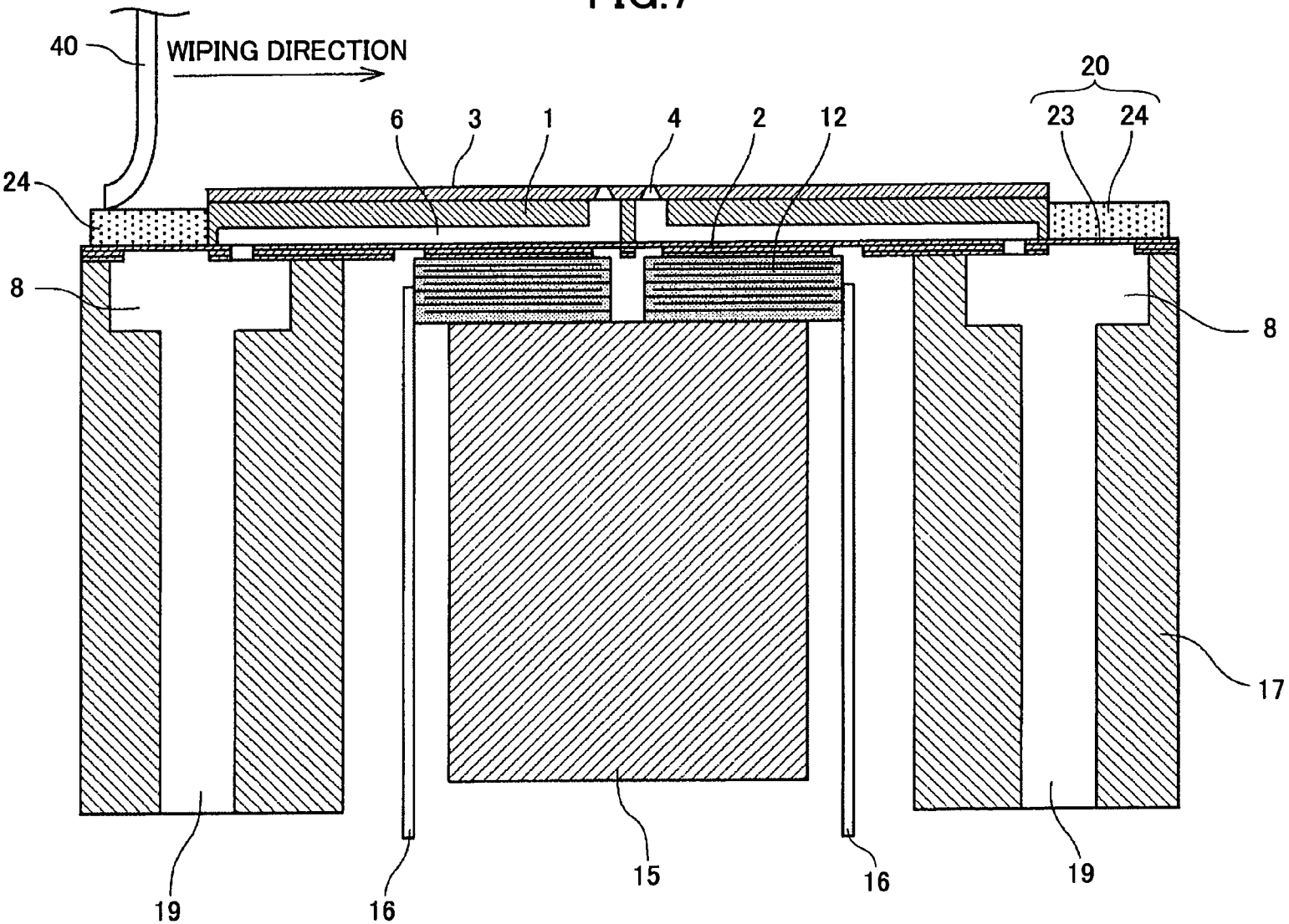
FIG. 7 is a cross-sectional view of the liquid discharge head of the first embodiment for illustrating another configuration thereof.

Further, referring to FIG. 7, by providing the damper material 24 in the structure of the first embodiment with a liquid-repellent (ink-repellent) characteristic, it is possible to wipe and clean the surface of the damper material 24 at the time of wiping the discharge surface of the nozzle plate 3 with a wiper blade 40 in the maintenance and recovery operation of the head even without the nozzle cover 31 of the second embodiment. As a result, it is possible to reduce the number of components of the head, so that it is possible to reduce cost.

Likewise, by providing the protection layer 32 of the third embodiment with a liquid-repellent characteristic (ink-repellent characteristic), it is possible to keep the surface of the damper material 24 clean even without the nozzle cover 31 of the second embodiment. As a result, it is possible to reduce the number of components of the head, so that it is possible to reduce cost.

Fourth Embodiment

Figure 8:
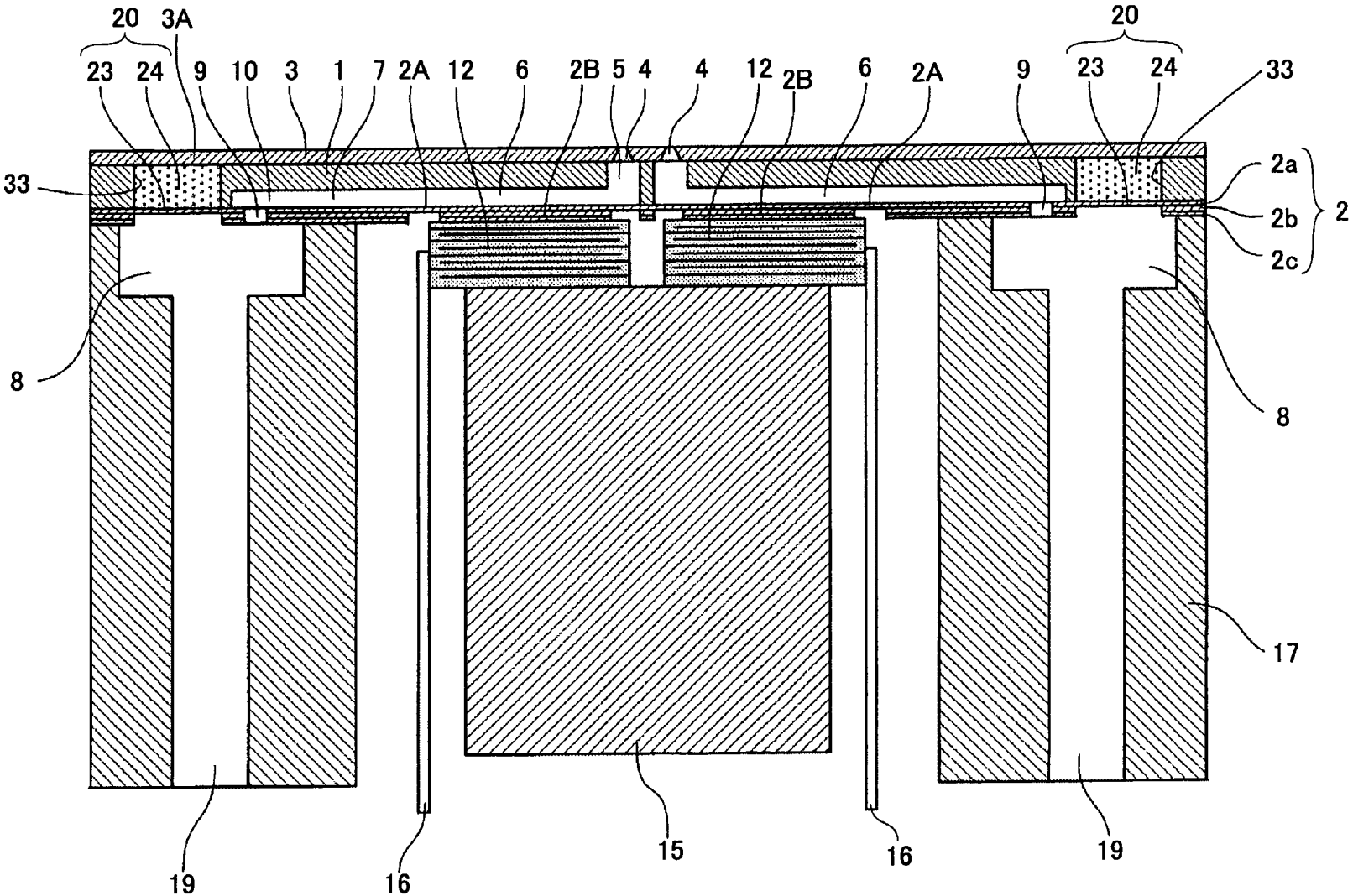
FIG. 8 is a cross-sectional view of a liquid discharge head taken along the length of a pressure liquid chamber of the liquid discharge head according to a fourth embodiment of the present invention.
Figure 9:
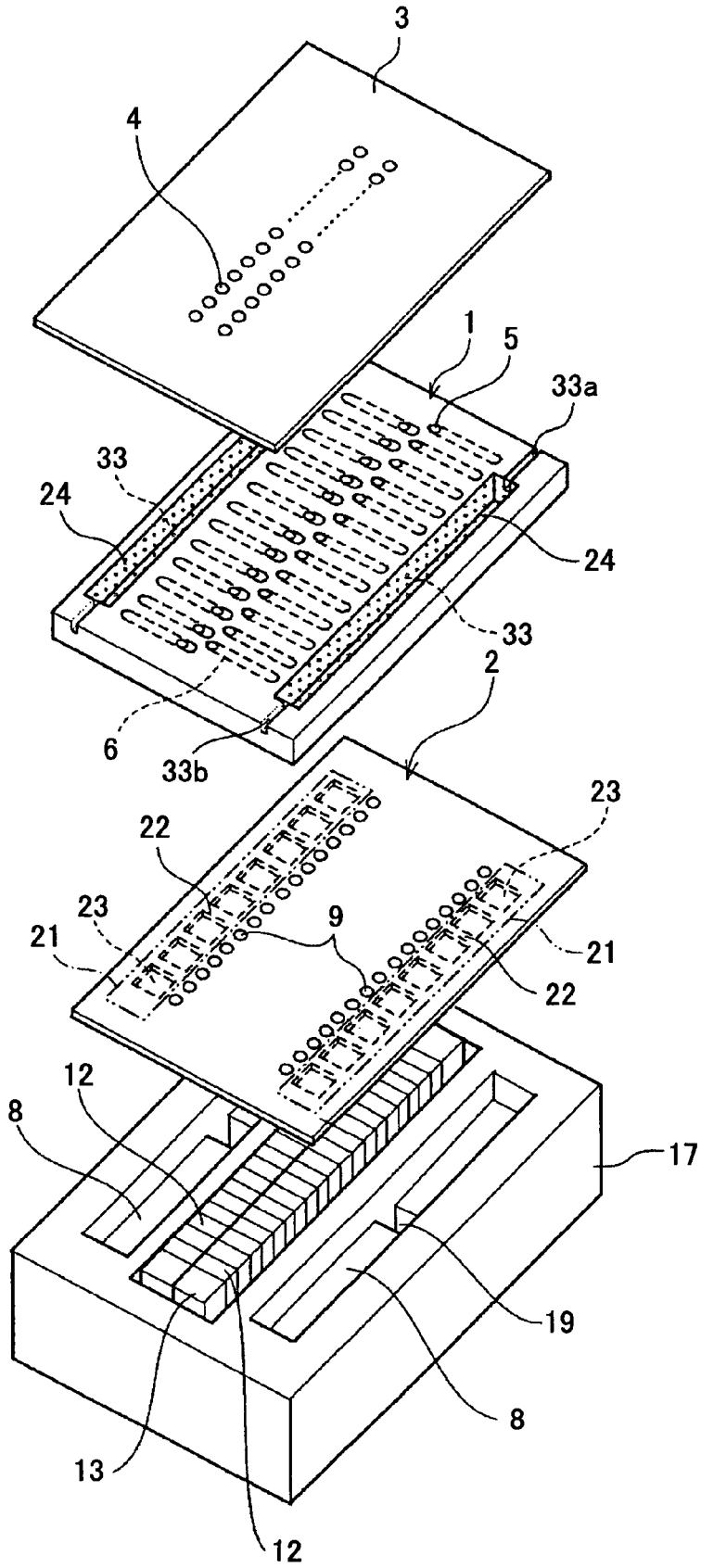
FIG. 9 is an exploded perspective view of the liquid discharge head according to the fourth embodiment of the present invention.

Next, a description is given, with reference to FIGS. 8 and 9, of a liquid discharge head according to a fourth embodiment of the present invention. FIG. 8 is a cross-sectional view of the liquid discharge head taken along the length of a pressure liquid chamber of the liquid discharge head. FIG. 9 is an exploded perspective view of the liquid discharge head. In FIGS. 8 and 9, the same elements as those of the first embodiment are referred to by the same reference numerals.

In this head, the diaphragm member 2, the channel plate 1, and the nozzle plate 3 have substantially the same planar size, through holes 33 are formed in the channel plate 1 so as to correspond to the free vibration surfaces 21 of the damper parts 20, the damper material 24 is provided in each through hole 33, and a part 3A of the nozzle plate 3 is used as a member to protect the damper material 24. As shown in FIG. 9, communicating paths 33*a* and 33*b*, which have respective openings on the corresponding longitudinal end sides of the channel plate 1, are formed at the corresponding longitudinal ends of each through hole 33. Each through hole 33 is filled with the damper material 24 through the communicating paths 33*a* and 33*b* after assembly.

This makes it possible to protect the damper parts 20 without adding a member or a protection layer in particular.

Fifth Embodiment

Figure 10:
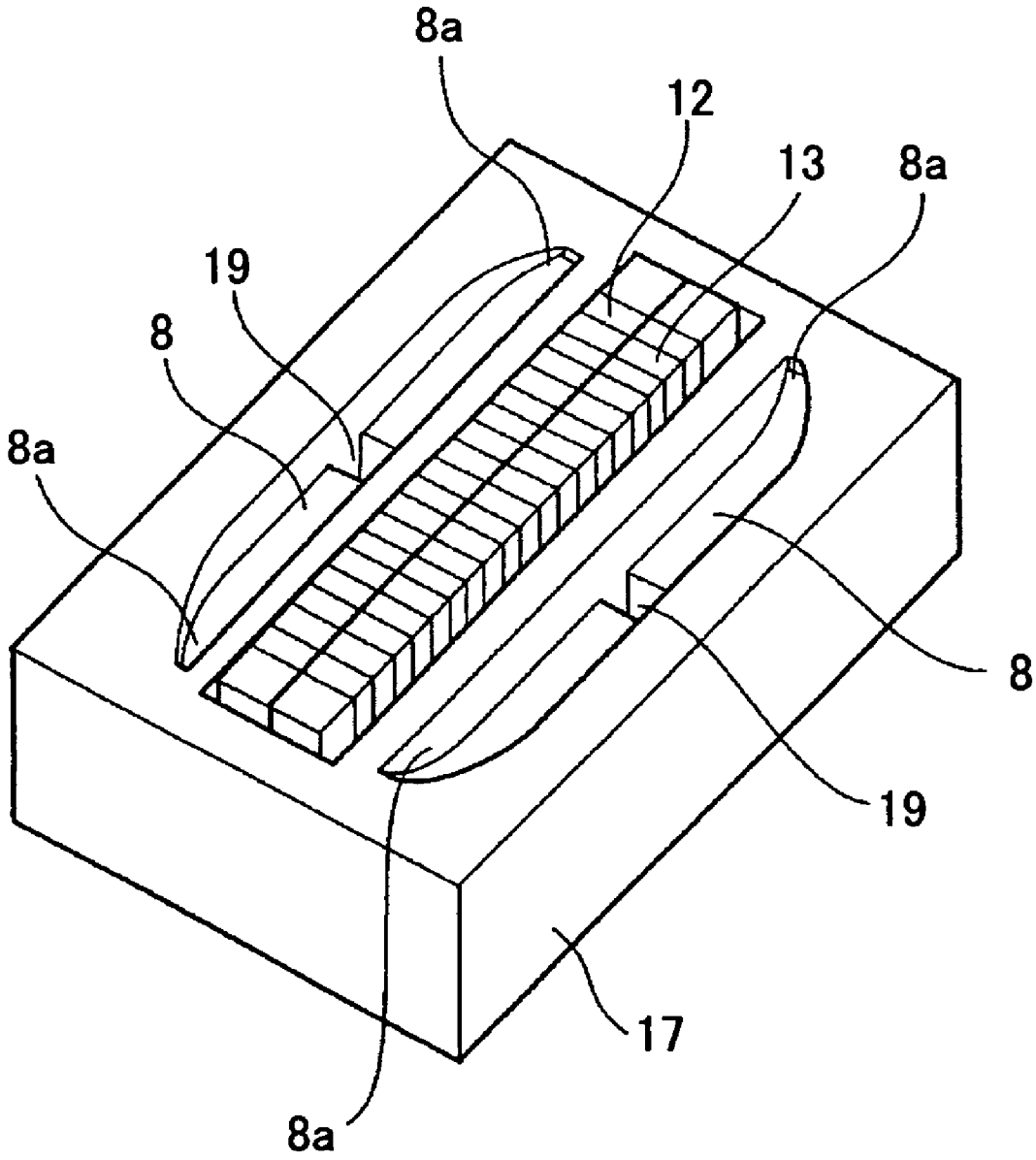
FIG. 10 is a perspective view of a frame member for illustrating a configuration of a common liquid chamber according to a fifth embodiment of the present invention.

Next, a description is given, with reference to FIG. 10, of a structure of the common liquid chamber 8 according to a fifth embodiment of the present invention. FIG. 10 is a perspective view of the frame member 17.

In this case, each common liquid chamber 8 is shaped to be reduced in width and depth at longitudinal ends 8*a* and 8*b* thereof. Providing the common liquid chambers 8 with such a shape makes it possible to increase a recording-liquid flow characteristic and a bubble discharge characteristic.

Sixth Embodiment

Figure 11:
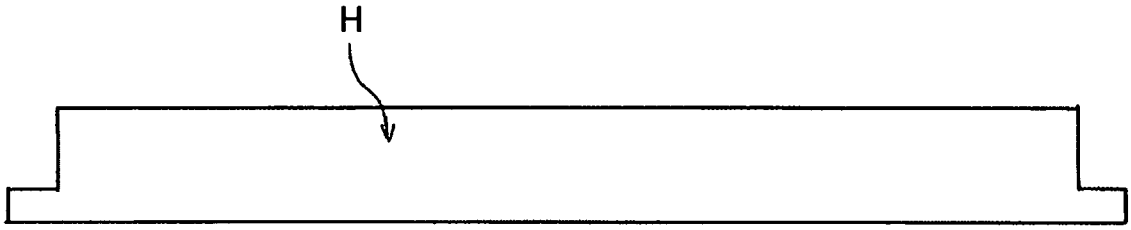
FIG. 11 is a side view of a liquid discharge head according to a sixth embodiment of the present invention.
Figure 12:
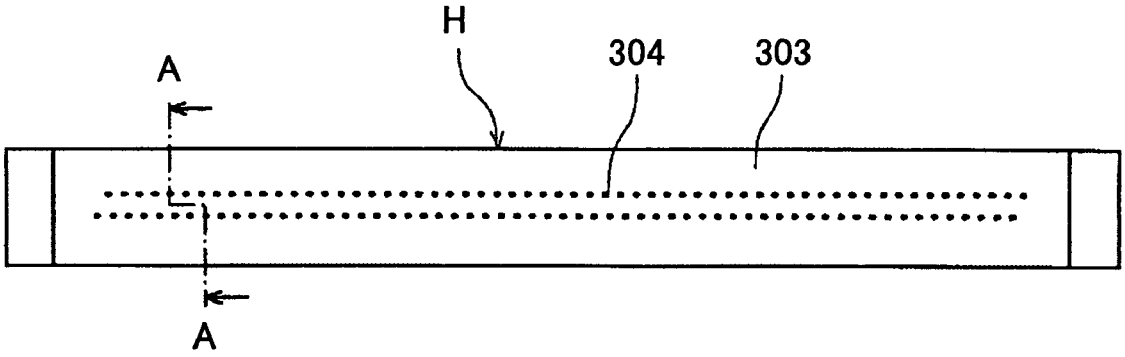
FIG. 12 is a plan view of the liquid discharge head according to the sixth embodiment of the present invention.
Figure 13:
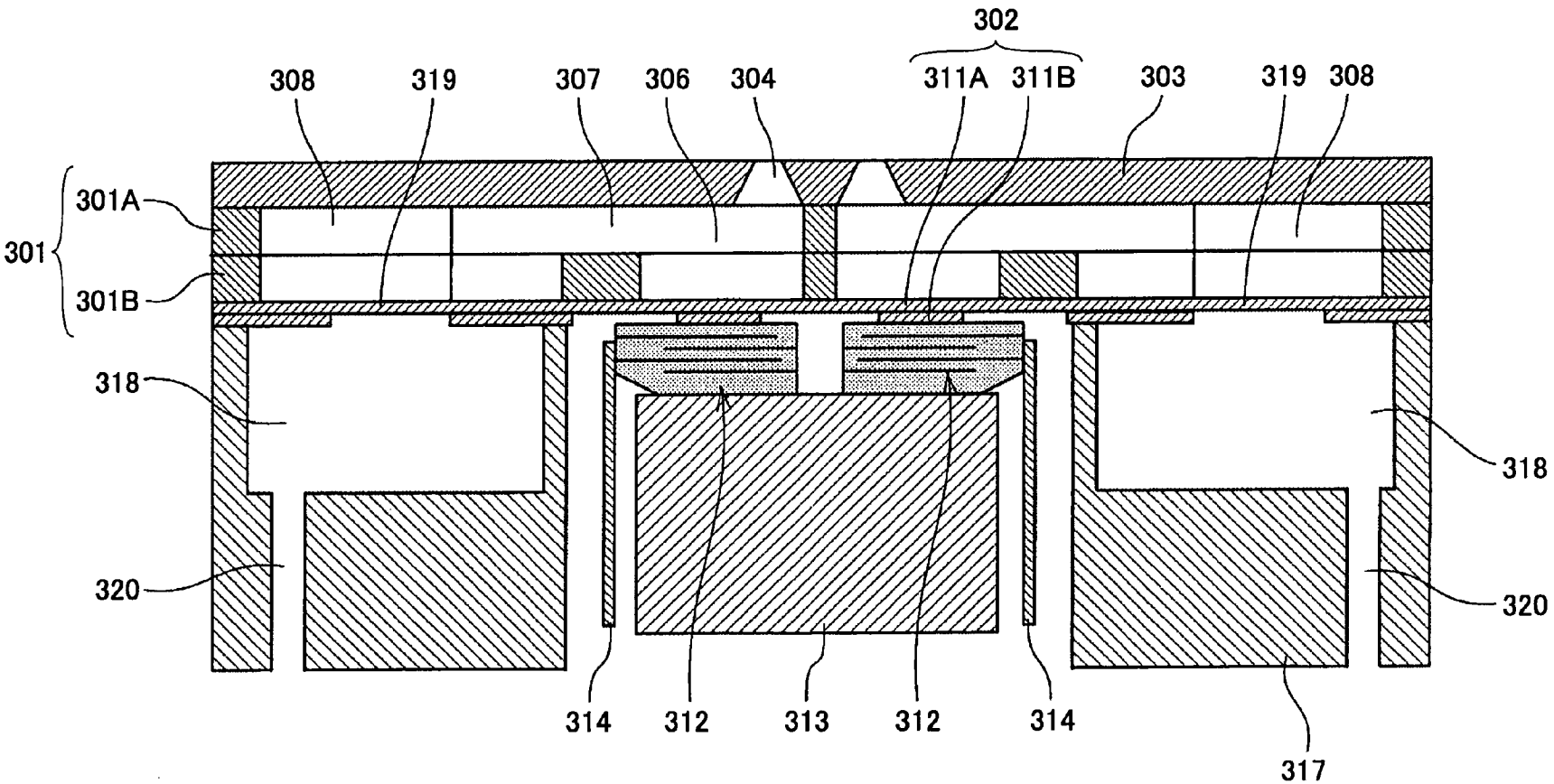
FIG. 13 is a cross-sectional view of the liquid discharge head taken along the length of a pressure liquid chamber of the liquid discharge head along line A-A of FIG. 12 according to the sixth embodiment of the present invention.

Next, a description is given, with reference to FIGS. 11 through 13, of a liquid discharge head H according to a sixth embodiment of the present invention. FIG. 11 is a side view of the liquid discharge head H. FIG. 12 is a plan view of the liquid discharge head H. FIG. 13 is a cross-sectional view of the liquid discharge head H taken along the length of a pressure liquid chamber of the liquid discharge head H along line A-A of FIG. 12.

The liquid discharge head H includes a channel base plate (liquid chamber base plate) 301 formed of a SUS substrate, a diaphragm 302 joined to the lower surface of the channel base plate 301, and a nozzle plate 303 joined to the upper surface of the channel base plate 301, thereby forming pressure liquid chambers (also referred to as "pressure chambers" or "channels") 306 serving as individual channels, fluid resistance parts 307, and common liquid chambers 308. The pressure liquid chambers 306 communicate with corresponding nozzles 304, through which liquid droplets (droplets of liquid) are discharged. The fluid resistance parts 307 also serve as supply channels for supplying ink (recording liquid) to the corresponding pressure liquid chambers 306. The common liquid chambers 308 supply the recording liquid to the pressure liquid chambers 306. The recording liquid is supplied to each common liquid chamber 308 from a recording liquid tank (not graphically illustrated) through a supply channel.

Here, the channel base plate 301 is formed by bonding a restrictor plate 301A and a chamber plate 301B. The openings of the pressure liquid chambers 306, the fluid resistance parts 307, and the common liquid chambers 308 are formed in the channel base plate 301 by subjecting a SUS substrate to etching with an acid etching liquid or mechanical processing such as blanking. The fluid resistance parts 307 are formed by forming openings in part of the restrictor plate 301A and not forming openings in the corresponding part of the chamber plate 301B.

The diaphragm 302 is bonded to the chamber plate 301B forming the channel base plate 301. The diaphragm 302 is formed by, for example, joining projecting parts 311B formed of a SUS substrate to a resin member 311A of polyimide. The diaphragm 302 may also be formed of a plate of metal such as nickel. By joining the chamber plate 301B of the fluid resistance parts 307 on the diaphragm 302 side to the diaphragm 302 as described above, the pressure inside the pressure liquid chambers 306 is prevented from being relieved to the outside through the thin resin member 311A of polyimide or the like of the diaphragm 302, so that it is possible to discharge liquid droplets with efficiency.

The nozzle plate 303, in which the multiple nozzles 4 of 10 to 30 μm in diameter corresponding to the pressure liquid chambers 306 are formed, is joined to the restrictor plate 301A of the channel base plate 301 with an adhesive agent. The nozzle plate 303 may be formed of metal such as stainless steel or nickel, resin such as a polyimide resin film, silicon, or a combination of two or more thereof. Further, in order to ensure ink repellency, a water-repellent film is formed on the nozzle surface (surface in the discharge direction or discharge surface) of the nozzle plate 303 by a known method such as plating or repellent coating.

Further, stacked piezoelectric elements 312 forming pressure generation parts (actuator parts) are joined to the outer side (the side opposite to the pressure liquid chambers 306) of the diaphragm 302 through the corresponding projecting parts 311B so as to correspond to the pressure liquid chambers 306. The stacked piezoelectric elements 312 are joined to a base member 313. The piezoelectric elements 312 are formed without being separated from one another by performing groove processing (slitting) on a single piezoelectric element member. The piezoelectric element member is fixed on the base member 313 so as to extend along the directions in which the piezoelectric elements 312 are arranged. Further, an FPC cable 314 is connected to one end face of each piezoelectric element 12 so as to provide a driving waveform thereto.

The recording liquid in the pressure liquid chambers 306 may be pressurized using displacement in either the d33 direction or the d31 direction as the piezoelectric direction of the piezoelectric elements 312. According to the configuration of this embodiment, displacement in the d33 direction is employed.

Preferably, the base member 313 is formed of a metal material. If the material of the base member 313 is metal, it is possible to prevent the piezoelectric elements 312 from storing heat due to self-heating. The piezoelectric elements 312 and the base member 313 are bonded with an adhesive agent. However, an increase in the number of channels causes the temperatures of the piezoelectric elements 312 to increase to nearly 100° C. because of their self-heating, thus extremely reducing the bonding strength. Further, the self-heating of the piezoelectric elements 312 increases the internal temperature of the head, thus causing an increase in ink temperature. The increase in ink temperature reduces ink viscosity, thus greatly affecting ejection characteristics. Accordingly, forming the base member 313 of a metal material and thereby preventing the piezoelectric elements 312 from storing heat due to their self-heating make it possible to prevent such a decrease in bonding strength and degradation of ejection characteristics due to reduction in the viscosity of ink.

Further, a frame member 317 is joined to the periphery of the diaphragm 302 with an adhesive agent. Buffer chambers 318 are formed in the frame member 317 so as to be adjacent to the corresponding common liquid chambers 308 through corresponding diaphragm parts 319, which are formed of the resin member 311A of the diaphragm 302 and serve as deformable parts. Each diaphragm part 319 forms a wall face of the corresponding common liquid chamber 308 and a wall face of the corresponding buffer chamber 318. The diaphragm parts 319, each serving as a deformable part forming the wall part between the corresponding buffer chamber 318 and common liquid chamber 308, are formed of a member forming the diaphragm 302 according to this embodiment. However, it is also possible to provide the diaphragm parts 319 separately from the diaphragm member 302 without making the diaphragm member 302 also serve as the diaphragm parts 319.

Further, communicating paths 320 that connect the corresponding buffer chambers 318 with the outside (atmosphere) are formed in the frame member 317. In this case, each communicating path 20 has an opening on the side of the liquid discharge head (the surface of the frame member 317) opposite to the side on which the nozzles 304 are formed, so that the buffer chambers 318 communicate with the atmosphere. That is, if the communicating paths 320 are open on the nozzle surface side, recording liquid may enter the buffer chambers 318 through the communicating paths 320 at the time of, for example, wiping the nozzle surface (so that the communicating paths 320 have to be open to spaces covered with a nozzle cover). By causing the communicating paths 320 to be open on the side opposite to the nozzle surface, it is possible to prevent recording liquid from entering the buffer chambers 318.

Further, the communicating paths 320 are formed at positions that do not oppose the diaphragm parts 319. Accordingly, it is possible to prevent foreign matter from being inserted into the communicating paths 320 to damage the diaphragm parts 319.

Further, according to this liquid discharge head, the piezoelectric elements 312 are formed at intervals of 300 dpi to be arranged in two opposing parallel arrays. Further, the pressure liquid chambers 306 and the nozzles 304, respectively, are disposed in two arrays in a staggered manner at intervals of 150 dpi in each array, so that a resolution of 300 dpi can be obtained with a single scan. In this case, in each array of the piezoelectric elements 312, the piezoelectric elements 312 that are driven and the piezoelectric elements 312 that are not driven and serve merely as support parts alternate with each other.

Further, as described above, most of the members of this liquid discharge head are formed of SUS so as to have the same thermal coefficient. Accordingly, it is possible to avoid problems resulting from thermal expansion during assembly or use of the head.

According to the liquid discharge head thus configured, for example, the piezoelectric element 312, which may be any of the multiple piezoelectric elements 312, contracts in response to a decrease in the voltage applied thereto from a reference electric potential, so that the diaphragm 302 moves downward to expand the volume of the corresponding pressure liquid chamber 306. As a result, ink flows into the pressure liquid chamber 306. Thereafter, the voltage applied to the piezoelectric element 312 is increased to expand the piezoelectric element 312 in its stacking direction, thereby deforming the diaphragm 302 toward the nozzle 304 to contract the volume of the pressure liquid chamber 306. As a result, the recording liquid in the pressure liquid chamber 306 is pressurized so that a droplet of the recording liquid is discharged (ejected) from the nozzle 304.

Then, by returning the voltage to be applied to the piezoelectric element 312 to the reference electric potential, the diaphragm 302 is restored to its initial position, so that the pressure liquid chamber 306 expands to generate a negative pressure. Accordingly, at this point, the pressure liquid chamber 306 is filled with the recording liquid from the corresponding common liquid chamber 308. Then, after the vibration of the meniscus surface of the nozzle 304 damps so that the meniscus surface is stabilized, the liquid discharge head proceeds to an operation for discharging the next liquid droplet.

The method of driving this head is not limited to the above-described example (pull-push ejection). Pull-ejection or push-ejection can also be performed depending on how the driving waveform is provided.

When a pressure variation is thus caused in the pressure liquid chamber 306 in order to discharge a liquid droplet from the nozzle 304, the pressure variation in the pressure liquid chamber 306 may be propagated to the corresponding common liquid chamber 308 through the fluid resistance part 307, and the pressure variation propagated to the common liquid chamber 308 may be propagated to another one of the pressure liquid chambers 306 through the corresponding fluid resistance part 307. In this case, if the buffer chambers 318 are not provided, recording liquid may leak or liquid droplets may be discharged even if the nozzle 304 of the other one of the pressure liquid chambers 306 is a channel that is not to discharge liquid droplets. Further, if the nozzle 304 of the other one of the pressure liquid chambers 306 is a channel that is to discharge liquid droplets, its droplet discharge may be affected.

On the other hand, according to the liquid discharge head of this embodiment, the buffer chambers 318 adjacent to the corresponding common liquid chambers 308 through deformable parts are provided. Accordingly, when a pressure vibration is propagated to any common liquid chamber 308, the corresponding diaphragm part 319 deforms (is displaced) to absorb the pressure variation.

Even if many pressure liquid chambers 306 are simultaneously driven to discharge liquid droplets from the corresponding nozzles 304, so that a large pressure variation is propagated to the common liquid chambers 308, the diaphragm parts 319 can sufficiently deform to absorb even the large pressure variation with efficiency because the buffer chambers 318 communicate with the outside through the communicating paths 320.

That is, if the buffer chamber 318 is a closed space, the air in the buffer chamber 318 serves as resistance to deformation of the corresponding diaphragm part 319 so as to prevent great deformation of the diaphragm part 319, so that a large pressure variation cannot be absorbed. On the other hand, according to this embodiment, since each buffer chamber 318 is open to the atmosphere, it is possible to prevent the air inside the buffer chamber 318 from serving as resistance to deformation of the diaphragm part 319.

Further, since each diaphragm part 319 is provided as a wall face of the corresponding buffer chamber 318 so as not to be in direct contact with the atmosphere, layout restrictions are reduced. That is, if the diaphragm parts 319 are in direct contact with the atmosphere, such layout should be provided as to prevent the diaphragm parts 319 from being damaged in the case of occurrence of a jam or the like, thus increasing restrictions. On the other hand, according to this embodiment, since the diaphragm parts 319 are protected by the corresponding buffer chambers 318, such layout restrictions are reduced.

Further, since each communicating path 320 has a complete external (atmosphere-side) opening, the movement of air between the buffer chambers 318 and the outside is easy, so that a relatively high buffer effect is produced compared with the case of providing a deformable part at an opening (the case of an incomplete opening) as described below.

Seventh Embodiment

Figure 14:
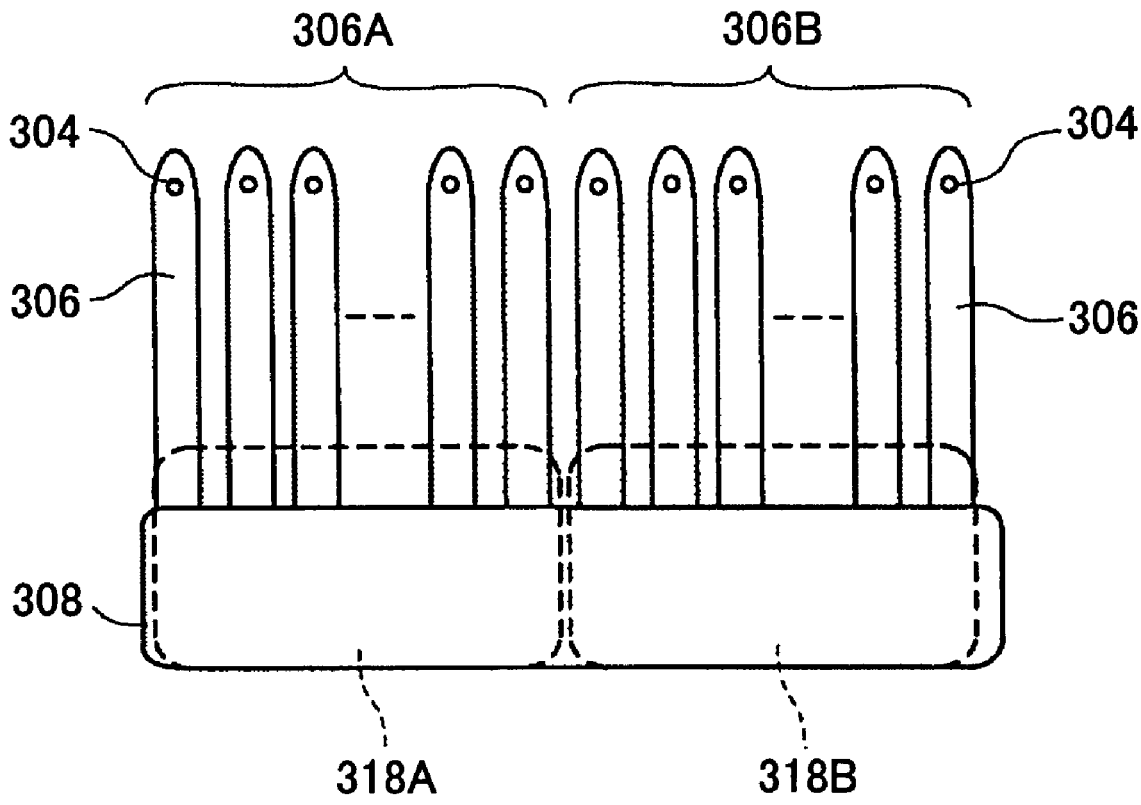
FIG. 14 is a plan view of part of a liquid discharge head according to a seventh embodiment of the present invention.

Next, a description is given, with reference to FIG. 14, of a liquid discharge head according to a seventh embodiment of the present invention. FIG. 14 is a plan view of part of the liquid discharge head.

According to this embodiment, the pressure liquid chambers 306 arranged in an array are divided into multiple groups (liquid chamber groups 306A and 306B in this case), and the multiple buffer chambers 318 (buffer chambers 318A and 318B in this case) are provided so as to correspond to the pressure liquid chambers 306 of the liquid chamber groups 306A and 306B, respectively.

The number of pressure liquid chambers 306 corresponding to a single buffer chamber 318 may be suitably determined based on one or more of a recording medium and the resolution and recording frequency (driving frequency) of the head.

This makes it possible to prevent the diaphragm parts 319 forming wall faces of the corresponding buffer chambers 318 from becoming excessively large in area.

Eighth Embodiment

Figure 15:
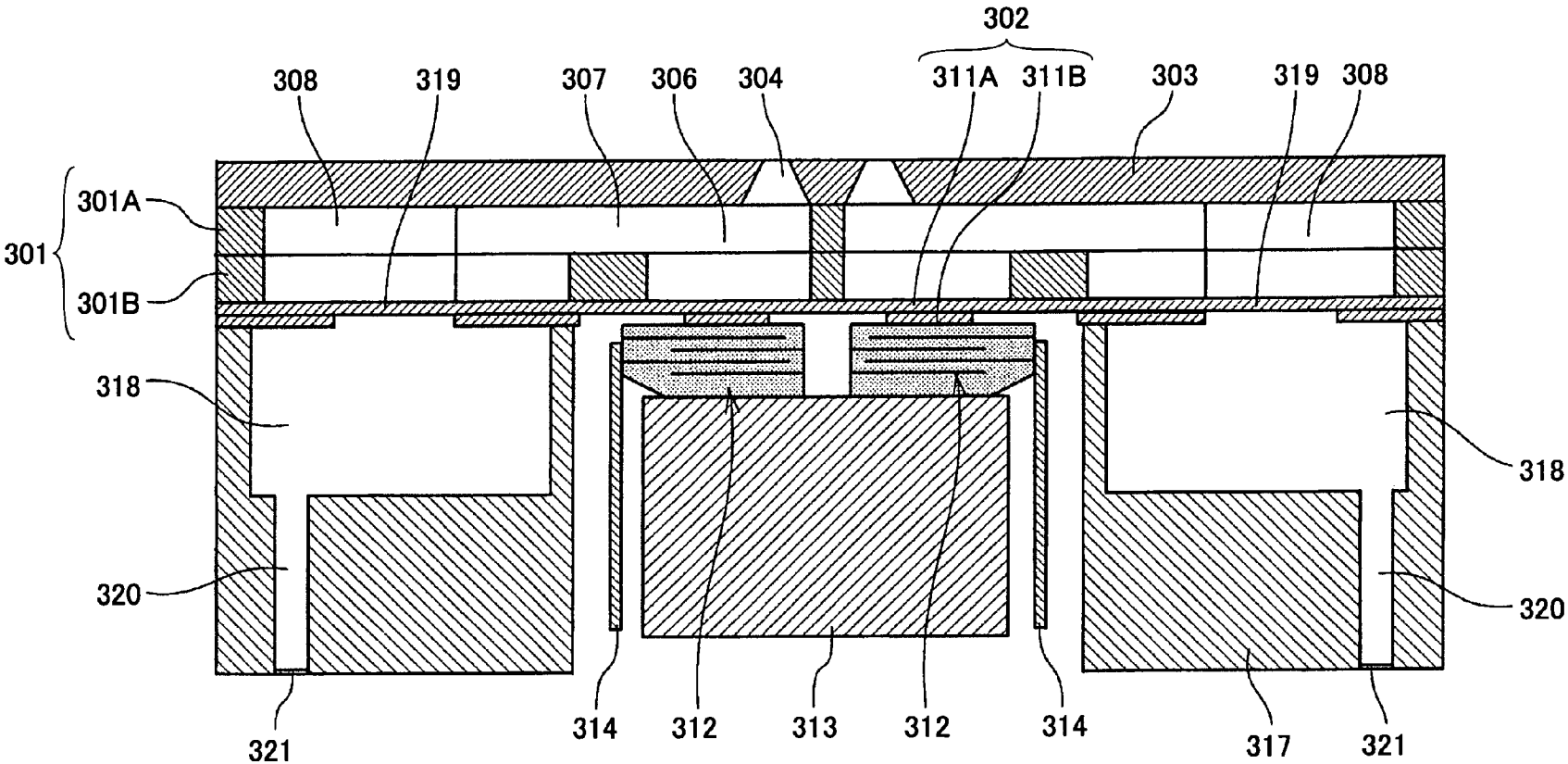
FIG. 15 is a cross-sectional view of a liquid discharge head taken along the length of a pressure liquid chamber of the liquid discharge head according to an eighth embodiment of the present invention.

Next, a description is given, with reference to FIG. 15, of a liquid discharge head according to an eighth embodiment of the present invention. FIG. 15 is a cross-sectional view of the liquid discharge head taken along the length of a pressure liquid chamber of the liquid discharge head.

In this embodiment, the communicating paths 320 that connect the corresponding buffer chambers 318 and the outside are provided in the frame member 317 the same as in the sixth embodiment. Further, a diaphragm (deformable thin film) 321 serving as a deformable part is provided at the external opening of each communicating path 320.

Thus, by providing the diaphragm 321 in each communicating path 320, it is also possible to absorb pressure variations in the buffer chambers 318 with the corresponding diaphragms 321. Further, it is possible to prevent or reduce mixture of air into recording liquid through the diaphragm parts 319 facing the buffer chambers 318 (air permeation) or evaporation of moisture from recording liquid through the diaphragm parts 319 (moisture permeation), which may occur if the buffer chambers 318 directly communicate with the atmosphere. The same effects can also be produced by providing a buffer material in the communicating paths 320.

Ninth Embodiment

Figure 16:
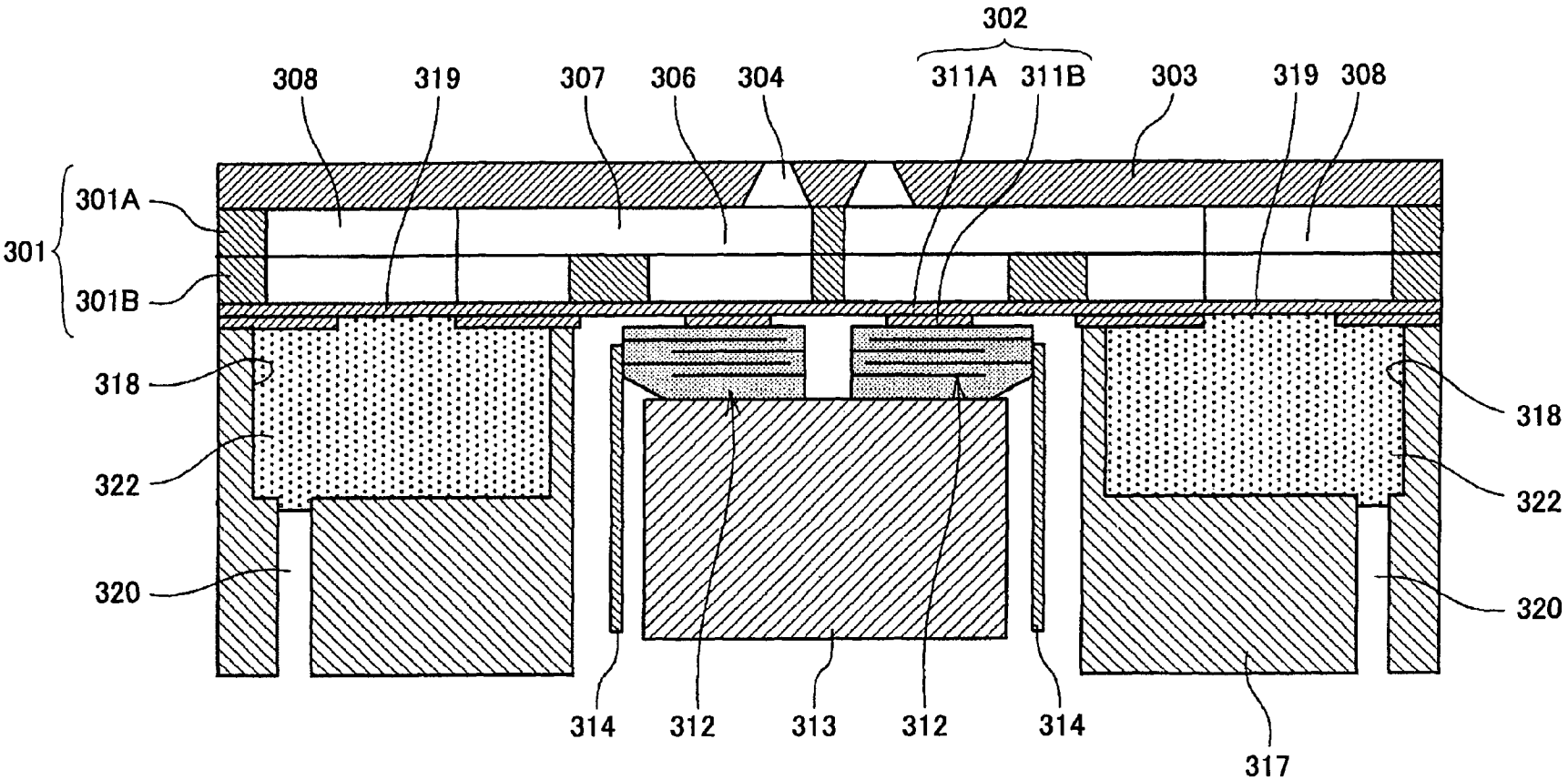
FIG. 16 is a cross-sectional view of a liquid discharge head taken along the length of a pressure liquid chamber of the liquid discharge head according to a ninth embodiment of the present invention.

Next, a description is given, with reference to FIG. 16, of a liquid discharge head according to a ninth embodiment of the present invention. FIG. 16 is a cross-sectional view of the liquid discharge head taken along the length of a pressure liquid chamber of the liquid discharge head.

In this embodiment, the communicating paths 320 that connect the corresponding buffer chambers 318 and the outside are provided in the frame member 317 the same as in the sixth embodiment. Further, a buffer material 322 highly effective in vibration damping is provided in each buffer chamber 318 by pouring. In this case, the communicating paths 320 serve as openings for pouring the buffer material 322. For example, TM1230M of ThreeBond Co., Ltd. may be employed as the buffer material 322.

By thus filling the buffer chambers 318 with the buffer material 322 having a high vibration damping effect, it is possible to effectively absorb a pressure vibration propagated to the common liquid chambers 308 through deformation of the diaphragm parts 319.

Tenth Embodiment

Figure 17:
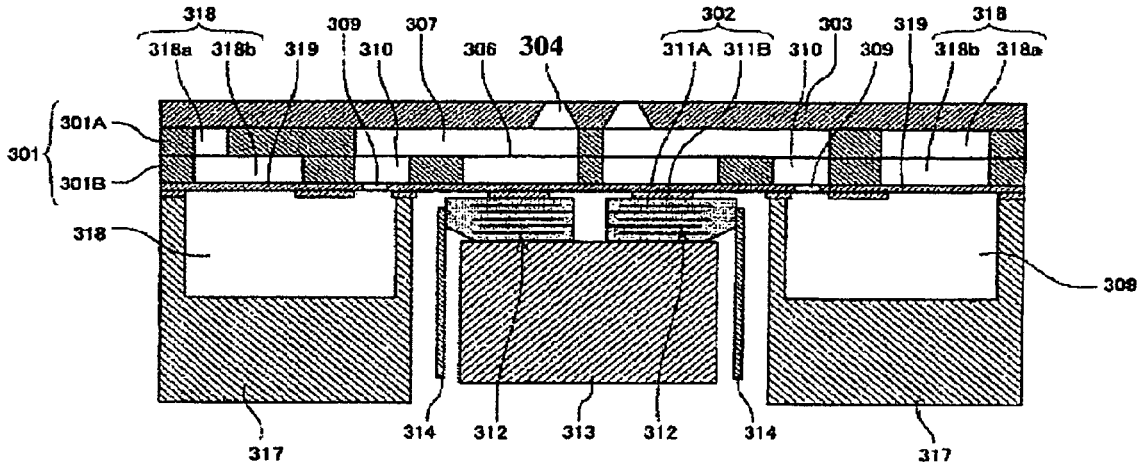
FIG. 17 is a cross-sectional view of a liquid discharge head taken along the length of a pressure liquid chamber of the liquid discharge head according to a tenth embodiment of the present invention.
Figure 18:
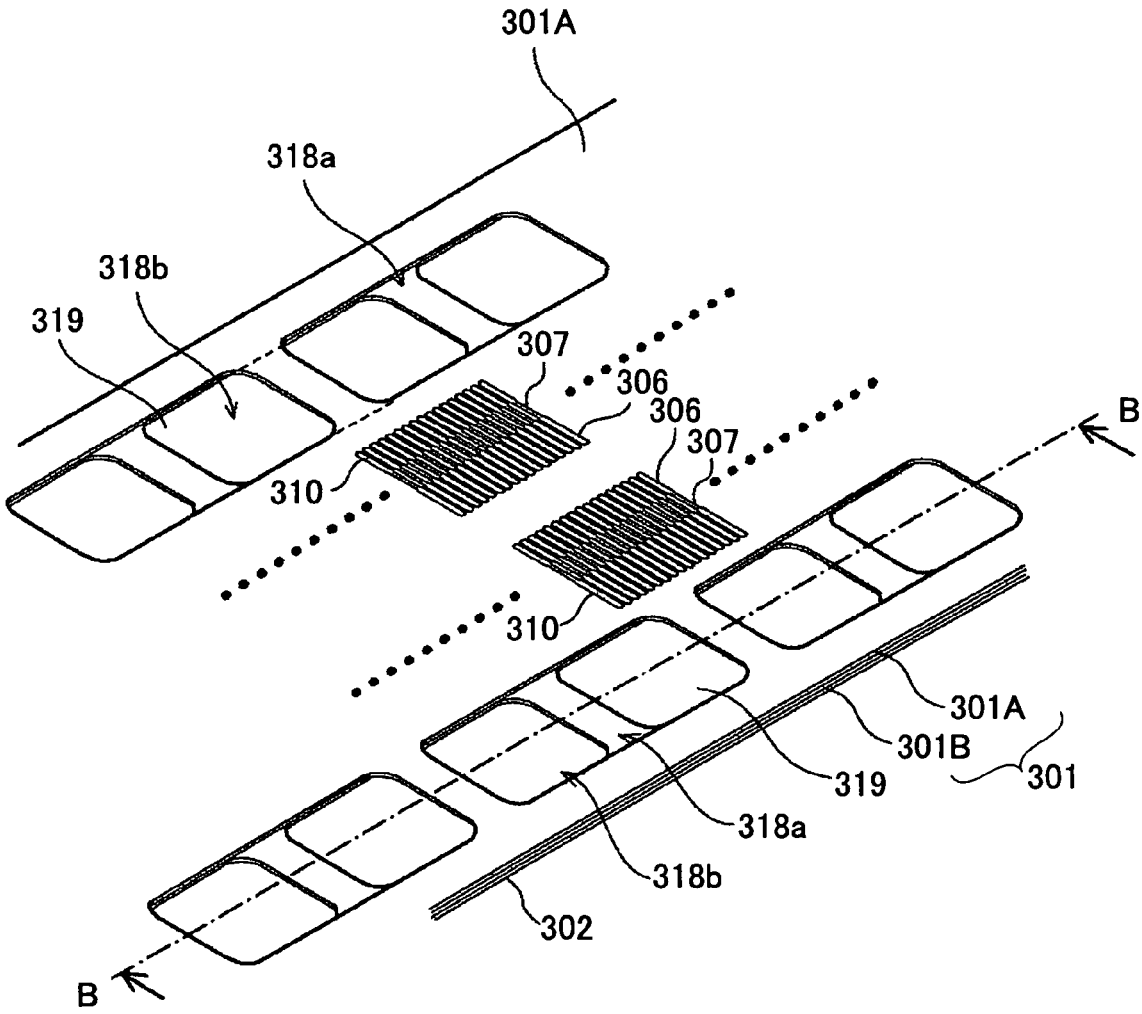
FIG. 18 is a perspective view of part of the liquid discharge head according to the tenth embodiment of the present invention.
Figure 19:
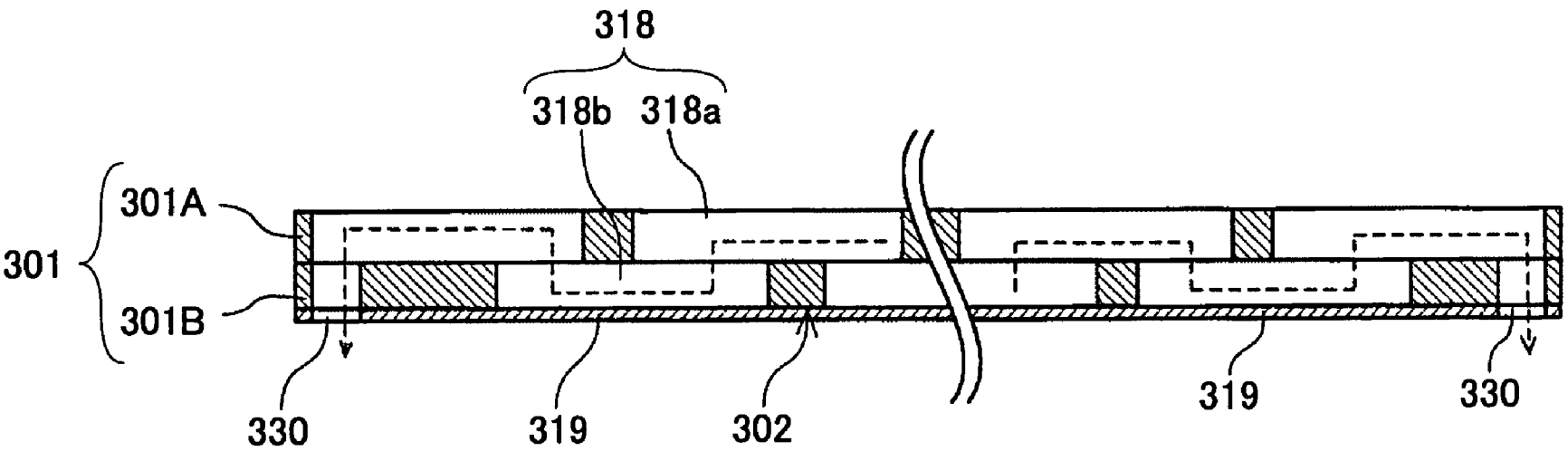
FIG. 19 is a sectional view of the part of the liquid discharge head of FIG. 18 taken along line B-B according to the tenth embodiment of the present invention.
Figure 20:
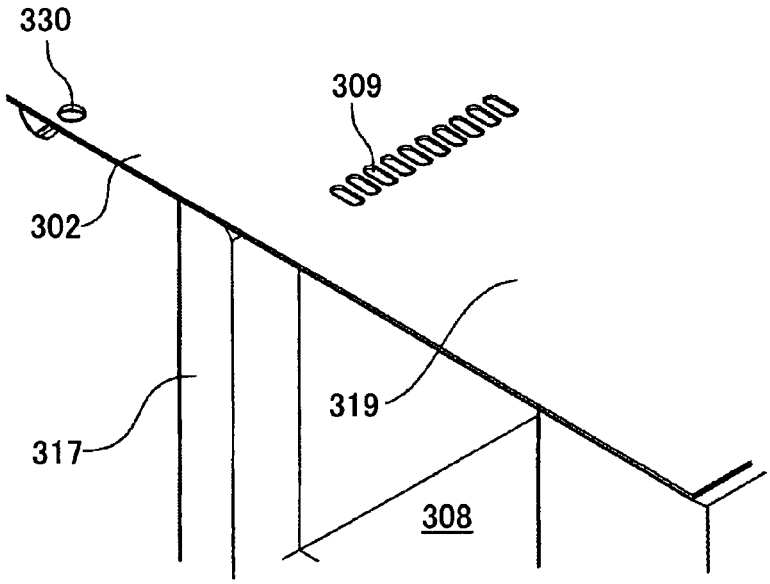
FIG. 20 is a perspective view of part of a diaphragm of the liquid discharge head according to the tenth embodiment of the present invention.
Figure 21:
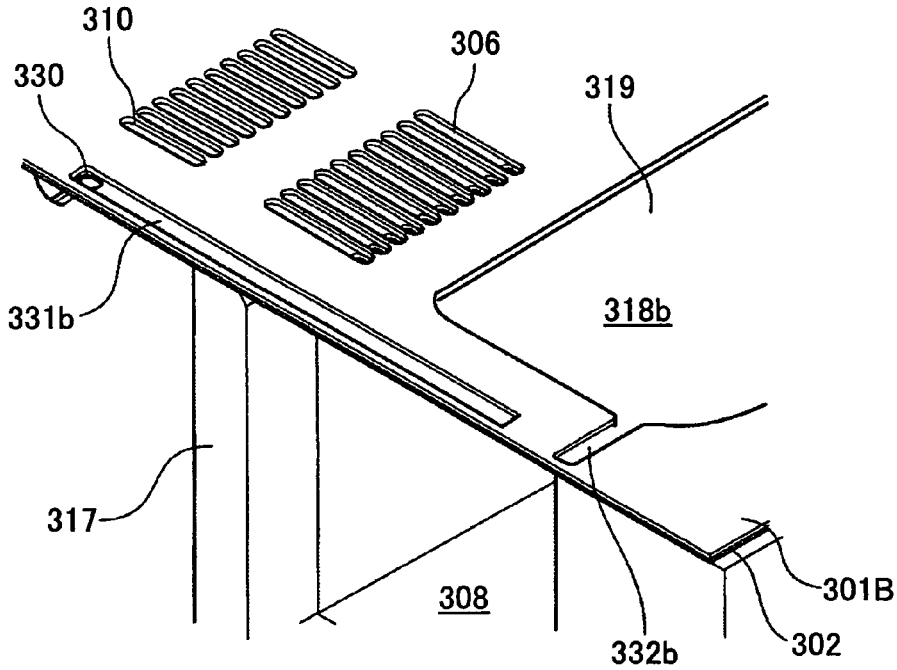
FIG. 21 is a perspective view of part of the lamination of the diaphragm and a chamber plate of the liquid discharge head according to the tenth embodiment of the present invention.
Figure 22:
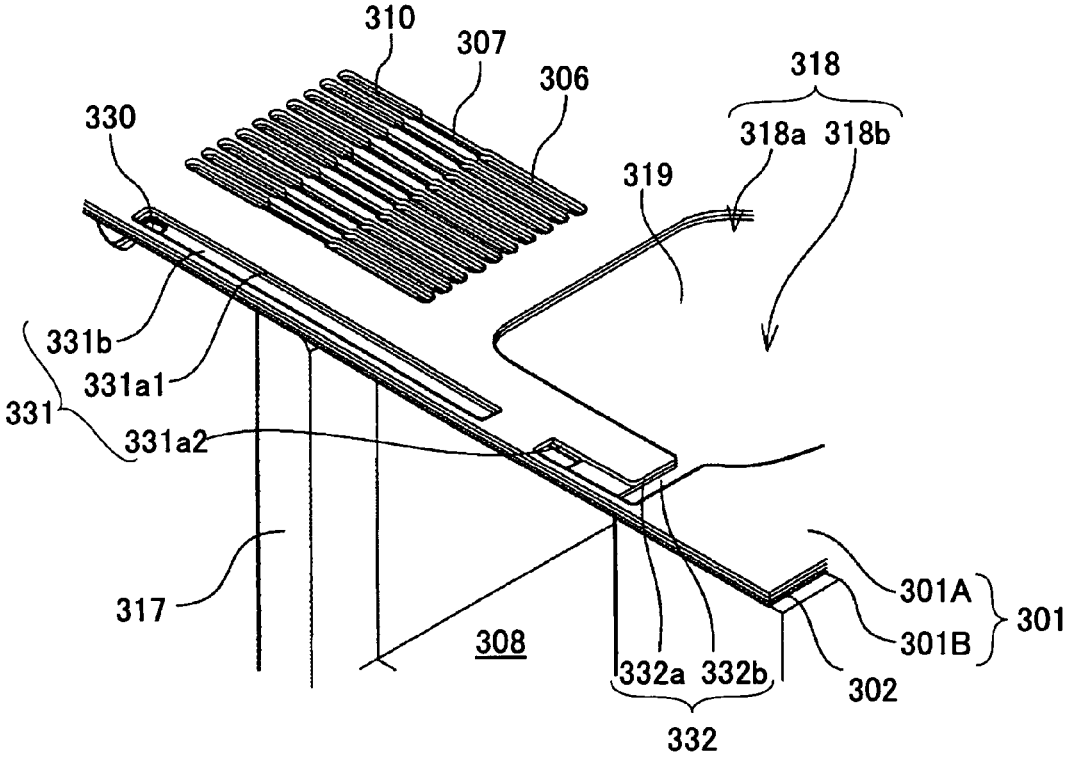
FIG. 22 is a perspective view of part of the lamination of the diaphragm, the chamber plate, and a restrictor plate of the liquid discharge head according to the tenth embodiment of the present invention.
Figure 23:
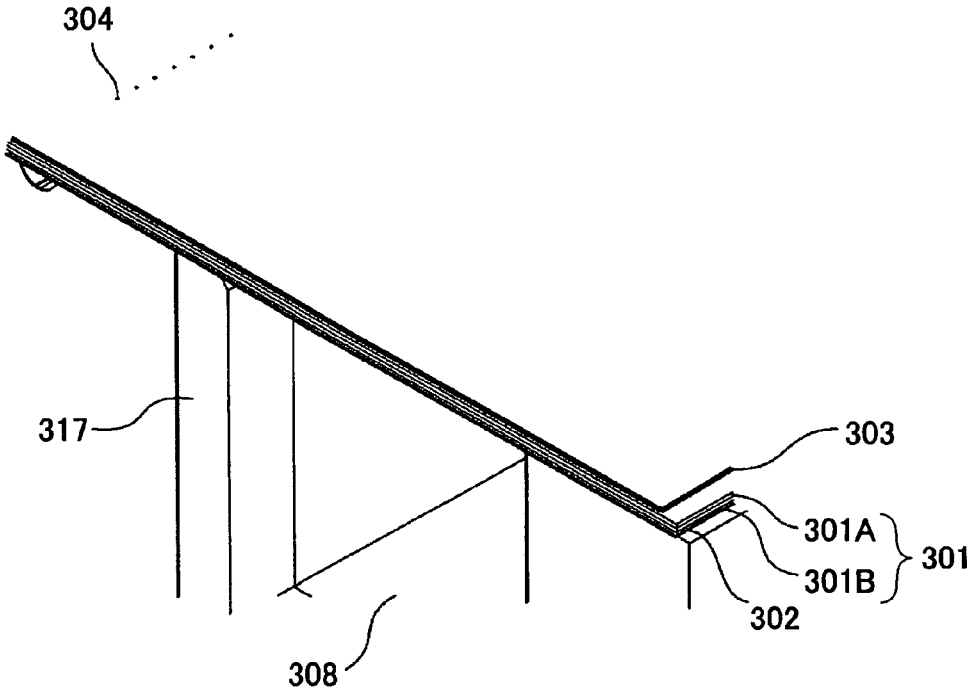
FIG. 23 is a perspective view of part of the lamination of the diaphragm, the chamber plate, the restrictor plate, and a nozzle plate of the liquid discharge head according to the tenth embodiment of the present invention.

Next, a description is given, with reference to FIGS. 17 through 23, of a liquid discharge head according to a tenth embodiment of the present invention. FIG. 17 is a cross-sectional view of the liquid discharge head taken along the length of a pressure liquid chamber of the liquid discharge head. FIG. 18 is a perspective view of part of the liquid discharge head. FIG. 19 is a sectional view of the part of the liquid discharge head of FIG. 18 taken along line B-B. FIG. 20 is a perspective view of part of the diaphragm 302 of the liquid discharge head. FIG. 21 is a perspective view of part of the lamination of the diaphragm 302 and the chamber plate 301B of the liquid discharge head. FIG. 22 is a perspective view of part of the lamination of the diaphragm 302, the chamber plate 301B, and the restrictor plate 301A of the liquid discharge head. FIG. 23 is a perspective view of part of the lamination of the diaphragm 302, the chamber plate 301B, the restrictor plate 301A, and the nozzle plate 303 of the liquid discharge head.

According to this liquid discharge head, the common liquid chambers 308 that supply recording liquid to the pressure liquid chambers 306 are formed in the frame member 317, and the recording liquid is supplied from the common liquid chambers 308 to the pressure liquid chambers 306 through supply holes 309 formed in the diaphragm 302, channels 310 formed on the upstream side of the fluid resistance parts 307, and the fluid resistance parts 307.

Further, the buffer chambers 318 adjacent to the corresponding common liquid chambers 308 through the corresponding diaphragm parts 319 formed using part of the diaphragm 302 are formed using the channel base plate 301, which is a lamination member, and one wall face of each buffer chamber 318 is formed using the nozzle plate 303.

Here, first buffer chamber parts 318*b* are formed in a nozzle arrangement direction using the chamber plate 301B in contact with the diaphragm parts 319, which are deformable parts, and second buffer chamber parts 318*a* are formed in the nozzle arrangement direction using the restrictor plate 301A out of contact with the diaphragm parts 319. As shown in FIGS. 18 and 19, the first buffer chamber parts 318*b* and the second buffer chamber parts 318*a* are formed in respective positions offset from each other (in other words, overlapping each other) in the nozzle arrangement direction.

Further, as shown in FIG. 20, communicating holes 330 are formed in the diaphragm 302 in order to have the buffer chambers 318 communicate with the outside (atmosphere). Further, as shown in FIG. 21, openings 331*b* forming passages 331 communicating with the corresponding communicating holes 330, and openings 332*b* forming passages 332 communicating with the corresponding first buffer chamber parts 318*b* are formed in the chamber plate 301B stacked on the diaphragm 302. Further, as shown in FIG. 22, openings 331*a*1 and 331*a*2, which form the passages 331 communicating the communicating holes 330 and correspond to different parts of the opening parts 331*b*, and opening parts 332*b*, which communicate with the corresponding second buffer chamber parts 318*a* and the corresponding openings 331*a*2 and form the passages 332, are formed in the restrictor plate 301A stacked on the chamber plate 301B. By stacking the nozzle plate 303 on this restrictor plate 301A as shown in FIG. 23, the communicating paths of the passage 331 and 332 and the communicating holes 330 are formed.

According to this configuration, for example, when a pressure variation caused in one of the pressure liquid chambers 306 is propagated to the corresponding common liquid chamber 308, the corresponding diaphragm part 319 deforms so that the corresponding buffer chamber 318 absorbs the pressure variation the same as in the above-described sixth to ninth embodiments. At this point, the air inside the buffer chamber 318 (318*a* and 318*b*) can escape as indicated by broken arrow in FIG. 19.

Further, according to this liquid discharge head, since the common liquid chambers 308 are formed in the frame member 317, the common liquid chambers 308 can be larger in capacity than in the above-described sixth to ninth embodiments. In particular, when a relatively large amount of recording liquid is expected to be consumed (for example, in the case of a line-type head), it is possible to supply recording liquid to the pressure liquid chambers 306 with more stability.

Further, according to the above-described sixth to ninth embodiments, since the pressure liquid chambers 306 and the buffer chambers 318 are adjacent to each other through the diaphragm 302, the energy applied from the piezoelectric elements 312 in order to discharge liquid droplets from the nozzles 304 may escape to the buffer chamber 318 side, so that liquid droplet discharge efficiency may be reduced. On the other hand, according to the configuration of this embodiment, each pressure liquid chamber 306 is adjacent to the corresponding buffer chamber 318 through a wall part formed of the channel base plate 301, and is adjacent to the corresponding common liquid chamber 308 through the diaphragm 302. Further, the common liquid chambers 308 are filled with recording liquid that has a lower damping effect than air. Accordingly, the energy applied from the piezoelectric elements 312 is prevented from escaping to the buffer chamber 318 side, so that it is possible to prevent a decrease in liquid droplet discharge efficiency.

Further, since the nozzle plate 303 is on the buffer chambers 318, the nozzle plate 303 also serves as a cover member that protects the diaphragm parts 319 forming wall faces of the corresponding common liquid chambers 308. Thus, by the nozzle plate 303 serving as a cover member, it is possible to prevent the diaphragm parts 319, which are usually thin layer members of a few μm in thickness, from being damaged by a jam of a recording medium. Further, since the nozzle plate 303 serves as a member to form the nozzles 304 and as a cover member to protect the diaphragm parts 319, it is possible to reduce cost.

According to the configuration of this embodiment, the communicating path is not limited to those having an opening because it is sufficient if a pressure variation can escape to the atmosphere through the communicating path, so that, for example, an extremely thin diaphragm part may also be formed at each communicating hole 330 the same as in the above-described eighth embodiment, or a buffer material highly effective in vibration damping may also be provided in each buffer chamber 318 the same as in the ninth embodiment (in this case, the communicating paths formed of the communicating holes 330 and the passages 331 and 332 serve as channels for pouring the buffer material).

$11^{th}$ Embodiment

Figure 24:
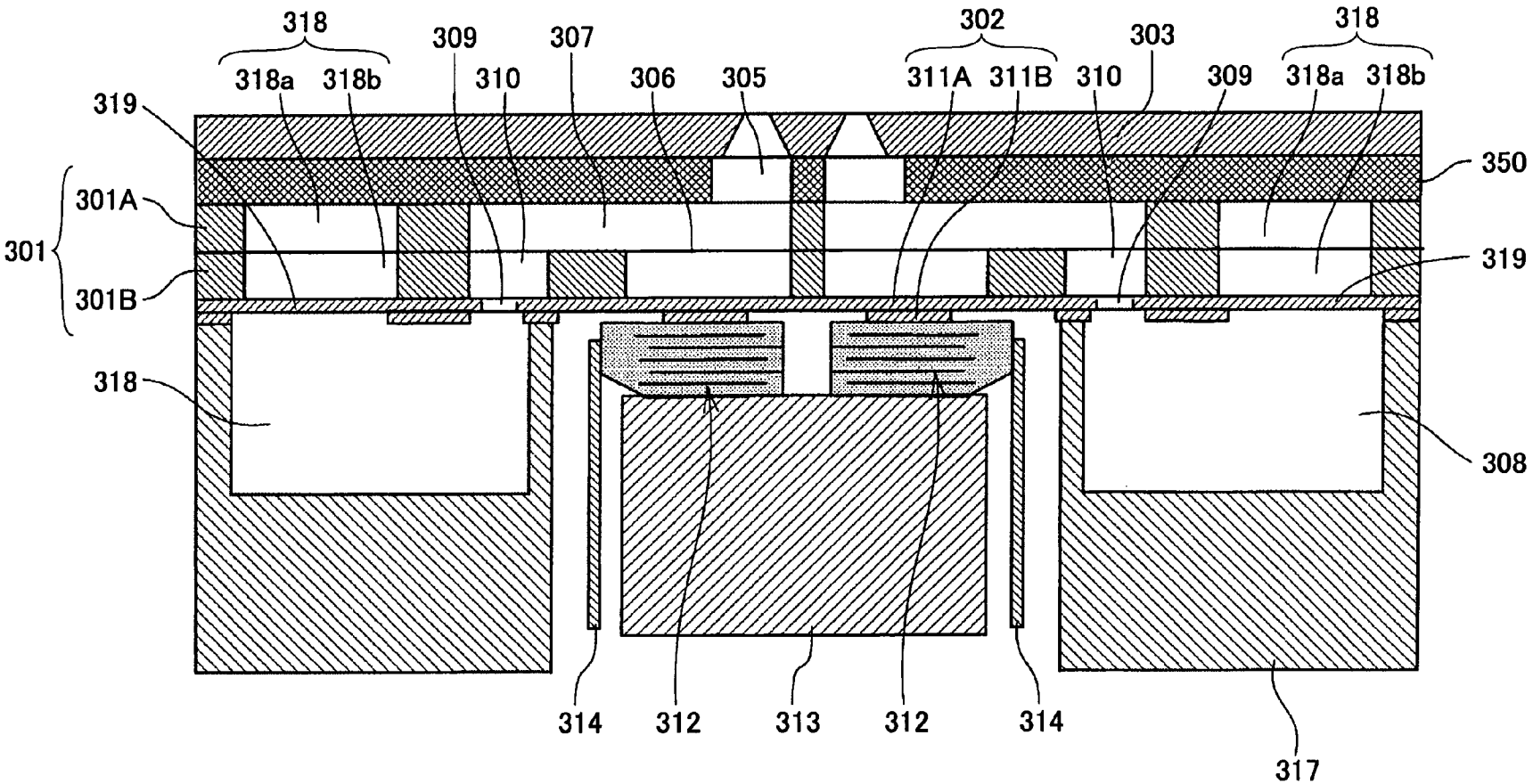
FIG. 24 is a cross-sectional view of a liquid discharge head taken along the length of a pressure liquid chamber of the liquid discharge head according to an $11^{th}$ embodiment of the present invention.

Next, a description is given, with reference to FIG. 24, of a liquid discharge head according to an $11^{th}$ embodiment of the present invention. FIG. 24 is a cross-sectional view of the liquid discharge head taken along the length of a pressure liquid chamber of the liquid discharge head.

According to this liquid discharge head, a communicating plate (manifold plate) 350 is interposed between the channel base plate 301 and the nozzle plate 303, and nozzle communicating paths 305 that connect the corresponding pressure liquid chambers 306 and nozzles 304 are formed in the manifold plate 350.

For example, if it is desired to form the nozzle plate 303 of a member relatively low in rigidity, such as a resin member of, for example, polyimide, for characteristic or processing reasons in the liquid discharge head of the above-described $10^{th}$ embodiment, the nozzle plate 303 does not serve sufficiently as the cover member of the buffer chambers 318. Accordingly, by forming the manifold plate 350 of a member of high rigidity and interposing the manifold plate 350 between the channel base plate 301 and the nozzle plate 303, it is possible to have the manifold plate 350 serve as the cover member (wall face forming member) of the buffer chambers 318.

$12^{th}$ Embodiment

Figure 25:
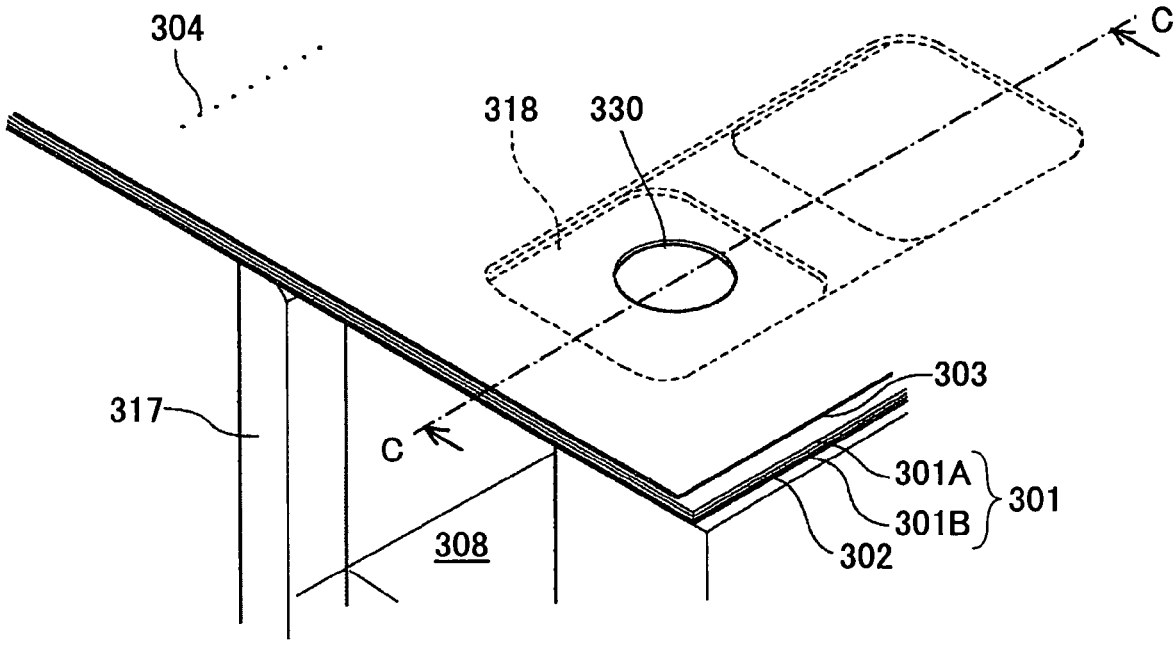
FIG. 25 is a perspective view of a buffer chamber part of a liquid discharge head according to a $12^{th}$ embodiment of the present invention.
Figure 26:
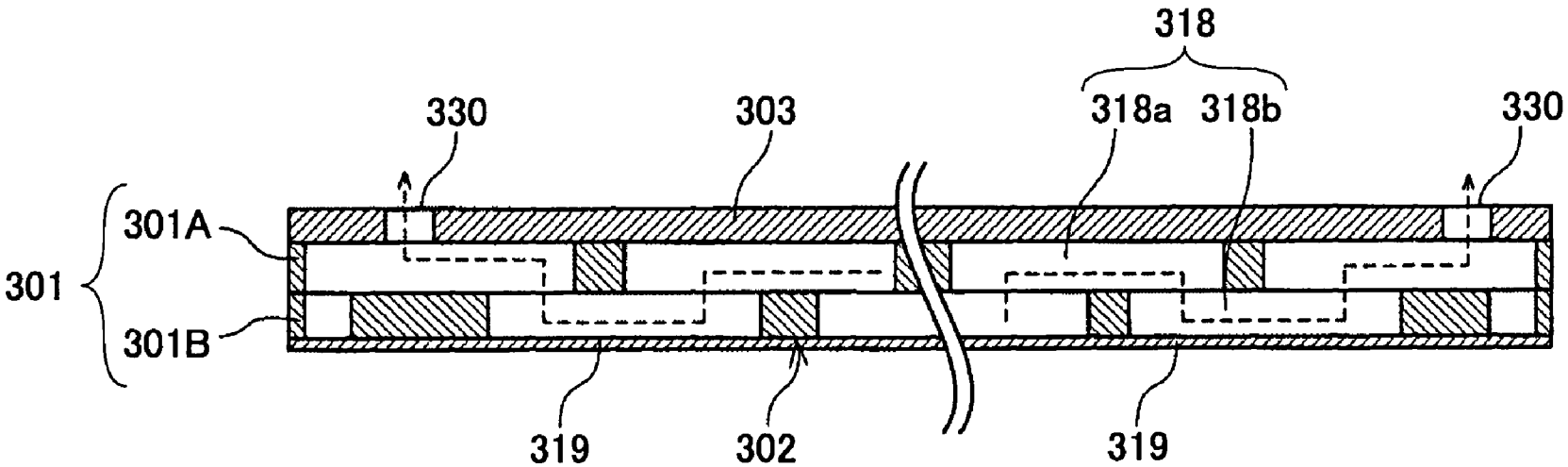
FIG. 26 is a sectional view of the liquid discharge head taken along a nozzle arrangement direction (along line C-C of FIG. 25) according to the $12^{th}$ embodiment of the present invention.

Next, a description is given, with reference to FIGS. 25 and 26, of a liquid discharge head according to a $12^{th}$ embodiment of the present invention. FIG. 25 is a perspective view of a buffer chamber part of the liquid discharge head. FIG. 26 is a sectional view of the liquid discharge head taken along a nozzle arrangement direction (along line C-C of FIG. 25).

According to this embodiment, the communicating holes 330, which are communicating paths that connect the buffer chambers 318 and the outside, are formed in the nozzle plate 303 (the nozzle plate 303 and the manifold plate 50 in the 11$^{th}$ embodiment) also serving as a wall face forming member (cover member) in the buffer chambers 318.

According to this configuration, it is also possible to allow pressure variations caused in the buffer chambers 318 to escape to the atmosphere (as airflow indicated by broken line in FIG. 26), so that it is possible to increase discharge stability.

According to this configuration, the communicating holes 330 serving as communicating paths may be formed in the nozzle plate 303 in contact with the buffer chambers 318 relatively large in area. Accordingly, processing accuracy is not required, so that it is possible to manufacture products with good yields.

13$^{th}$ Embodiment

Figure 27:
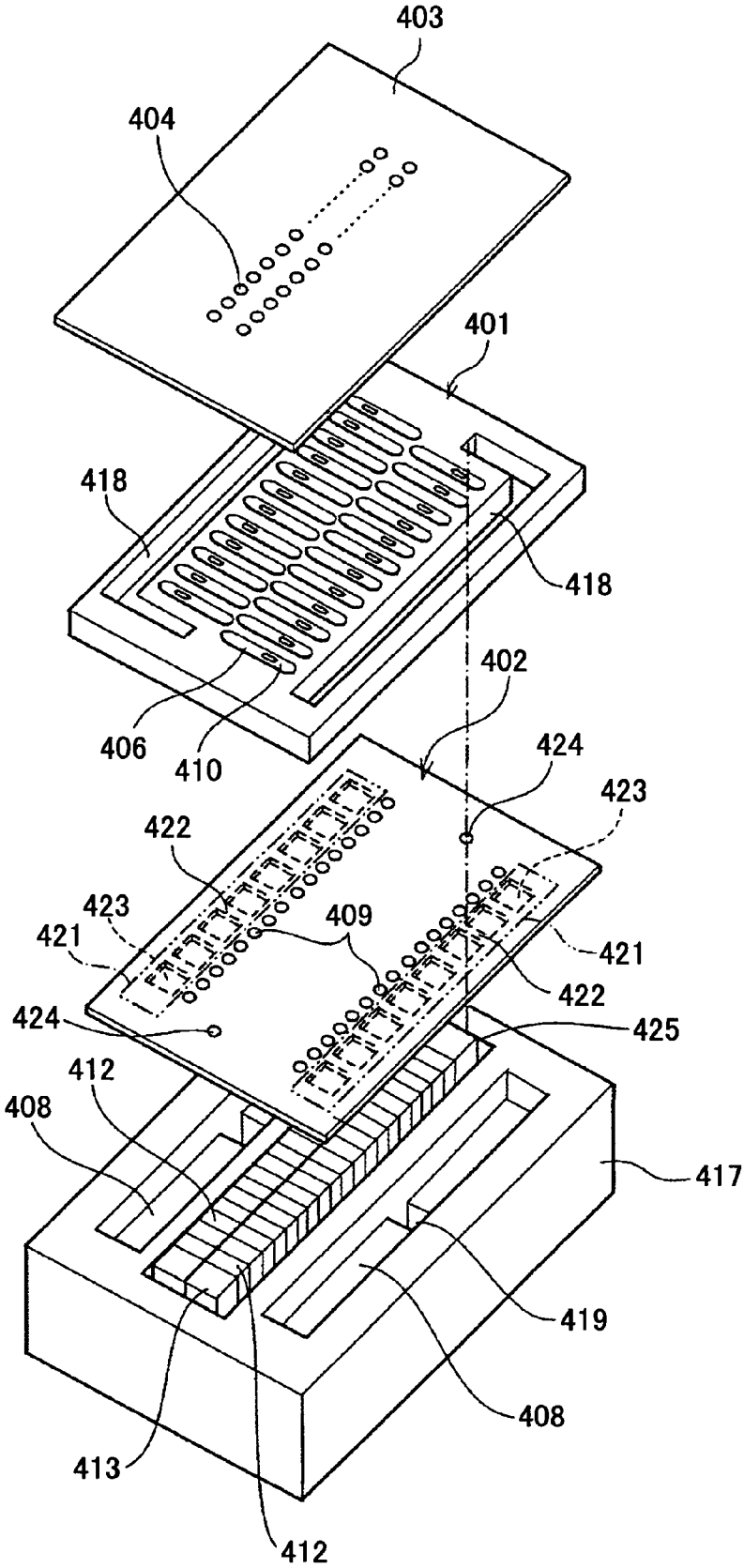
FIG. 27 is an exploded perspective view of a liquid discharge head according to a $13^{th}$ embodiment of the present invention.
Figure 28:
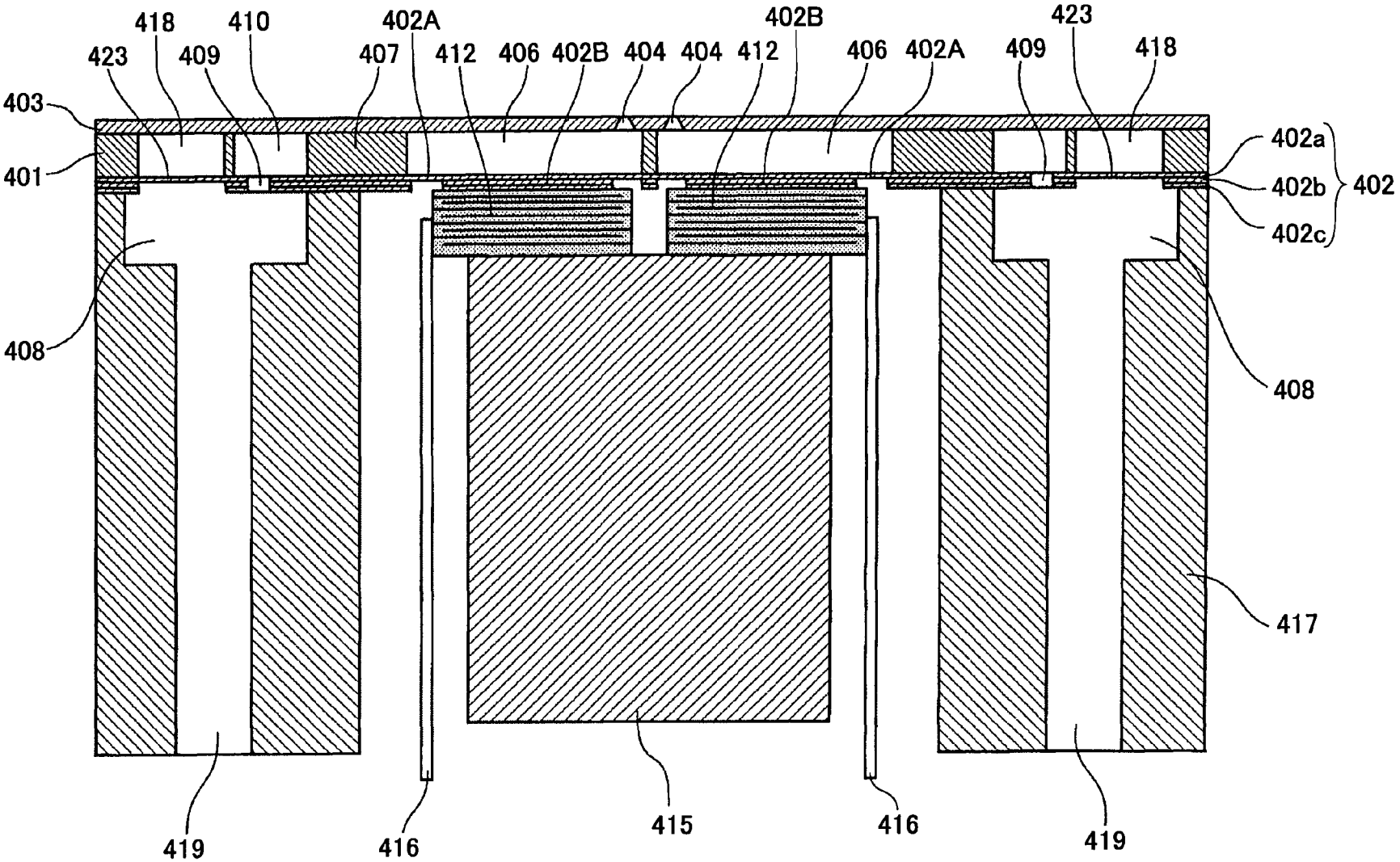
FIG. 28 is a cross-sectional view of the liquid discharge head taken along the length of a pressure liquid chamber of the liquid discharge head according to the $13^{th}$ embodiment of the present invention.
Figure 29:
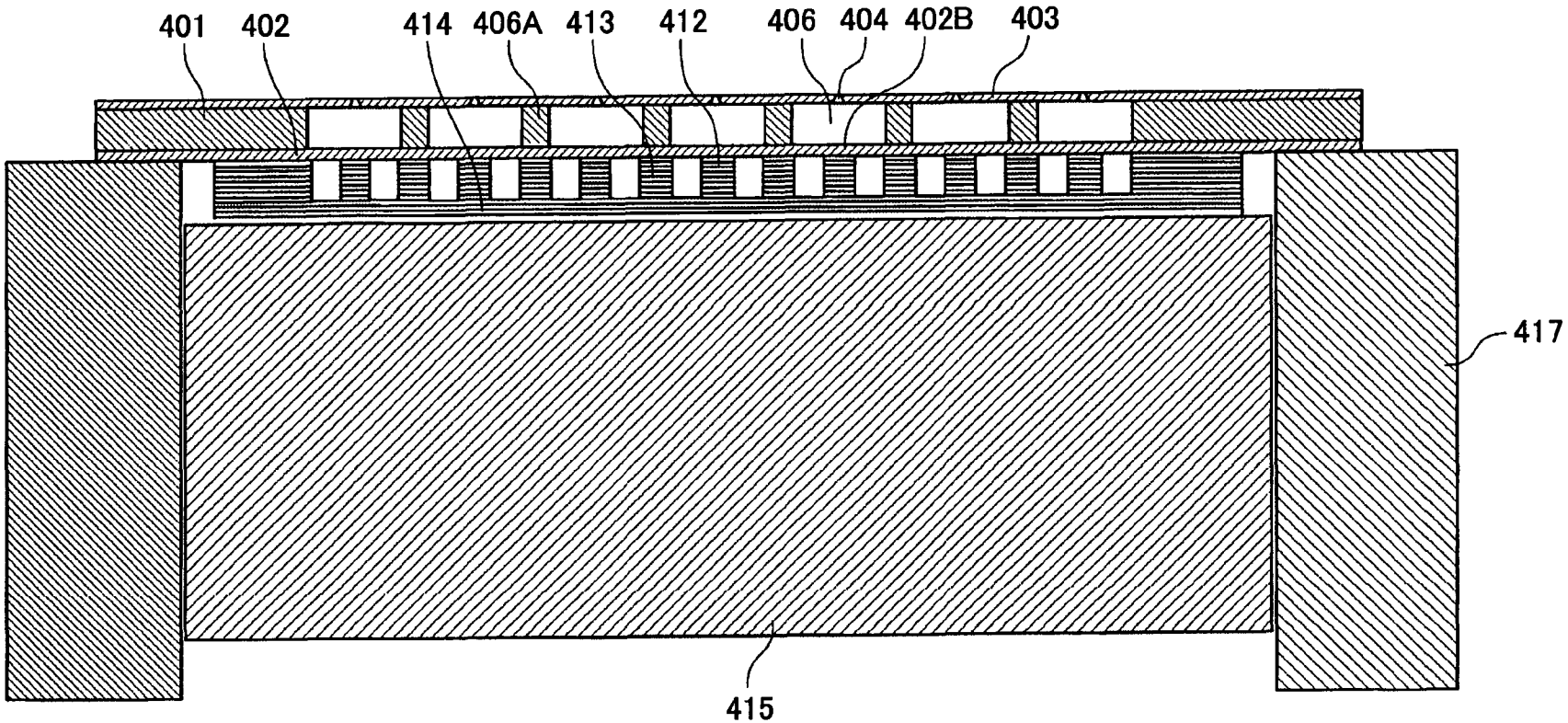
FIG. 29 is a longitudinal-sectional view of the liquid discharge head taken along the width of the pressure liquid chamber of the liquid discharge head according to the $13^{th}$ embodiment of the present invention.

Next, a description is given, with reference to FIGS. 27 through 29, of a liquid discharge head according to a 13$^{th}$ embodiment of the present invention. FIG. 27 is an exploded perspective view of the liquid discharge head. FIG. 28 is a cross-sectional view of the liquid discharge head taken along the length of a pressure liquid chamber of the liquid discharge head (the directions perpendicular to the directions in which nozzles are arranged). FIG. 29 is a longitudinal-sectional view of the liquid discharge head taken along the width of the pressure liquid chamber of the liquid discharge head (the directions in which the nozzles are arranged).

The liquid discharge head includes a channel plate (liquid chamber base plate) 401, a diaphragm 402 joined to the lower surface of the channel plate 401, and a nozzle plate 403 joined to the upper surface of the channel plate 401, thereby forming pressure liquid chambers (also referred to as "pressure chambers" or "channels") 406 serving as individual channels, fluid resistance parts 407, and damper chambers 418. The pressure liquid chambers 406 communicate with corresponding nozzles 404, through which liquid droplets (droplets of liquid) are discharged. The fluid resistance parts 407 also serve as supply channels for supplying ink (recording liquid) to the corresponding pressure liquid chambers 406.

Here, the openings of the pressure liquid chambers 406, the fluid resistance parts 407, and the damper chambers 418 are formed in the channel plate 401 by subjecting a SUS substrate to etching with an acid etching liquid or mechanical processing such as blanking. As described below, the channel plate 401 may be integrally formed with the nozzle plate 403 or the diaphragm 402 by electroforming. Further, the channel plate 401 may also be formed by subjecting a (110) single-crystal silicon substrate to anisotropic etching using an alkaline etching liquid such as a potassium hydroxide (KOH) aqueous solution. Photosensitive resin may also be used as the channel plate 401.

The diaphragm member 402 has a three-layer structure of nickel plates, which are a first layer 402*a*, a second layer 402*b*, and a third layer 402*c* from the pressure liquid chamber 406 side as shown in FIG. 28. The diaphragm member 402 is formed by, for example, electroforming. The diaphragm member 402 may also be formed of a lamination member of, for example, a resin member of polyimide and a metal plate such as a SUS substrate, or of a resin member.

The nozzle plate 403, in which the multiple nozzles 404 corresponding to the pressure liquid chambers 406 are formed, is joined to the channel plate 401 with an adhesive agent. The nozzle plate 403 may be formed of metal such as stainless steel or nickel, resin such as a polyimide resin film, silicon, or a combination of two or more thereof. The nozzles 404 are each formed to have a horn-like internal (interior) shape. The nozzles 404 may also be formed to have a substantially cylindrical or truncated corn-like internal shape. The hole diameter of each nozzle 404 is approximately 20 to 35 μm on the ink droplet exit side. Further, the nozzles 404 are arranged with a nozzle pitch of 150 dpi in each array.

Further, a water-repellent layer (not graphically illustrated) on which water-repellent surface treatment is performed is provided on the nozzle surface (surface in the discharge direction or discharge surface) of the nozzle plate 403. A water-repellent film selected in accordance with the physical properties of recording liquid is provided as the water-repellent layer, thereby stabilizing the droplet shape and flying characteristics of the recording liquid to produce high image quality. The water-repellent film may be formed by, for example, performing PTFE-Ni eutectoid plating, performing electropainting of fluororesin, depositing evaporative fluororesin (such as pitch fluoride) as a coating, or baking a silicon-based or fluorine-based resin solvent after its application.

As shown in FIG. 28, in the diaphragm member 402, projecting parts 402B of a two-layer structure of the second layer 402*b* and the third layer 402*c* are formed in correspondence to the pressure liquid chambers 406 in the center part of a diaphragm part 402A, which is a deformable area formed of the first layer 402*a*. A piezoelectric element 412 forming a pressure generation part (actuator part) is joined to each projecting part 402B. Further, support parts 413 are joined to the three-layer structure parts (thick wall parts 402B) so as to correspond to partition walls 406A of the pressure liquid chambers 406.

These piezoelectric elements 412 and support parts 413 are formed by dividing a stacked piezoelectric element member 414 in a comb-teeth manner by performing slitting by half-cut dicing on the stacked piezoelectric element member 414. The support parts 413 are also piezoelectric elements, but merely serve as supports since no driving voltage is applied thereto. This stacked piezoelectric element member 414 is joined to a base member 415.

Each piezoelectric element 412 (piezoelectric element member 414) is, for example, alternately stacked layers of lead zirconate titanate (PZT) piezoelectric layers each of 10 to 50 μm in thickness and silver-palladium (AgPd) internal electrode layers each of several μm in thickness. The internal electrodes are electrically connected alternately to an individual electrode and a common electrode, which are end face electrodes (external electrodes) at respective end faces. A driving signal is provided to these electrodes through a corresponding FPC cable 416.

The recording liquid in the pressure liquid chambers 406 may be pressurized using displacement in either the d33 direction or the d31 direction as the piezoelectric direction of the piezoelectric elements 412. According to the configuration of this embodiment, displacement in the d33 direction is employed.

Preferably, the base member 415 is formed of a metal material. If the material of the base member 415 is metal, it is possible to prevent the piezoelectric elements 412 from storing heat due to self-heating. The piezoelectric elements 412 and the base member 415 are bonded with an adhesive agent. However, an increase in the number of channels causes the temperatures of the piezoelectric elements 412 to increase to nearly 100° C. because of their self-heating, thus extremely reducing the bonding strength. Further, the self-heating of the piezoelectric elements 412 increases the internal temperature of the head, thus causing an increase in ink temperature. The increase in ink temperature reduces ink viscosity, thus greatly affecting ejection characteristics. Accordingly, forming the base member 415 of a metal material and thereby preventing the piezoelectric elements 412 from storing heat due to their self-heating make it possible to prevent such a decrease in bonding strength and degradation of ejection characteristics due to reduction in the viscosity of recording liquid.

Further, a frame member 417 formed of, for example, an epoxy resin or polyphenylene sulfide by injection molding is joined to the periphery of the diaphragm 402 with an adhesive agent.

Common liquid chambers 408 that supply recording liquid to each pressure liquid chamber 406 are formed in the frame member 417. The recording liquid is supplied from the common liquid chambers 408 to the pressure liquid chambers 406 through supply holes 409 formed in the diaphragm 402, channels 410 formed on the upstream side of the fluid resistance parts 407, and the fluid resistance parts 407. Recording liquid supply holes 419 for externally supplying recording liquid to the common liquid chambers 408 are also formed in the frame member 417. Further, as shown in FIG. 27, each common liquid chamber 408 is formed to have a rectangular planar shape in the directions in which the pressure liquid chambers 406 are arranged (the nozzle arrangement directions, which may be determined as "common liquid chamber longitudinal directions").

Here, a wall face of each common liquid chamber 408 is formed of the diaphragm 402, which is a member that forms wall faces of the pressure liquid chambers 406, and the part forming this wall face of each common liquid chamber 408 is determined as a damper area 421 (which, however, is not a physically defined area).

Figure 30:
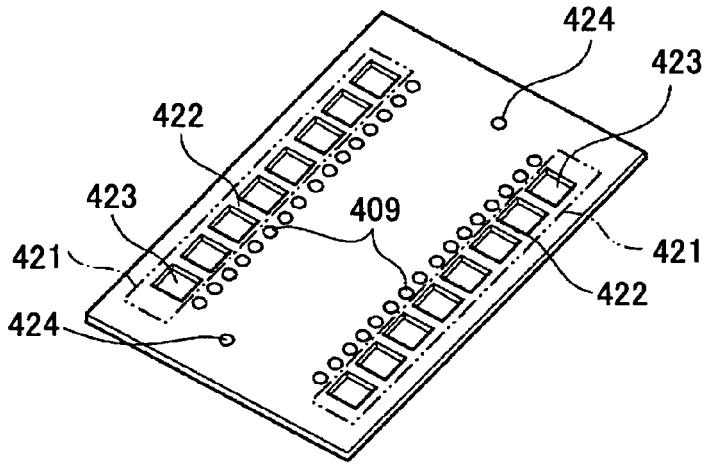
FIG. 30 is a perspective view of a diaphragm of the liquid discharge head from the common liquid chamber side according to the $13^{th}$ embodiment of the present invention.

As shown in FIG. 30, which is a perspective view of the diaphragm 402 from the common liquid chamber 408 side, each damper area 421 includes thick-wall parts 422 and damper parts 423. The thick-wall parts 422 are formed of the three-layer structure part (the first through third layers 402*a* through 402*c* from the pressure liquid chamber 406 side) of the diaphragm 402 having a three-layer structure. The damper parts 423 are planar rectangular deformable parts formed of a single-layer structure part of the first layer 402*a* of the diaphragm 402 formed by not forming (partially removing) the second layer 402*b* and the third layer 402*c*. That is, each damper part 423 is a deformable part that forms the wall part between the corresponding common liquid chamber 408 and its adjacent damper chamber 418. In this case, the thick-wall parts 422 and the damper parts 423 are alternately arranged like stripes in the longitudinal directions of the common liquid chambers 408 (nozzle arrangement directions).

The thick-wall parts 422 may have a two-layer structure and the damper parts 423 may have a single-layer structure. Alternatively, the thick-wall parts 422 may have a three-layer structure and the damper parts 423 may have a two-layer structure. Further, it is preferable that the diaphragm 402, which forms a wall face of each common liquid chamber 408, have resistance to ink (resistance to liquid) at least on the common liquid chamber 408 side.

The damper parts 423 of the damper areas 421 are deformable in order to absorb pressure in the common liquid chambers 408, and the face of each damper area 421 positioned on the side opposite to the corresponding common liquid chamber 408 forms a wall face of the corresponding damper chamber 418 formed in the channel plate 401. The damper chambers 418 are spaces open to the atmosphere through atmosphere communicating openings 424 formed in the diaphragm 402 to serve as communicating paths that communicate with the outside (atmosphere). The damper chambers 418 have the function of damping vibrations of the damper parts 423 so that accurate meniscus control is performable.

The atmosphere communicating openings 424 are formed at positions open to spaces 425 that are gaps in the assembly of the frame member 417 and the piezoelectric elements 412. This makes it possible to have the damper chambers 418 open to the atmosphere (communicate with the outside) by forming the atmosphere communicating openings 424 only in the diaphragm 402. Thus, there is no need to process other parts, so that it is possible to reduce manufacturing cost.

Further, by having the communicating paths that connect the damper chambers 418 and the outside (here, the atmosphere communicating openings 424) open on the side opposite to the surface on which the nozzles 404 are formed, it is possible to prevent recording liquid from entering the damper chambers 418. That is, if the communicating paths are open on the nozzle surface side, recording liquid may enter the damper chambers 418 through the communicating paths at the time of, for example, wiping the nozzle surface (so that the communicating paths have to be open to spaces covered with a nozzle cover). By causing the communicating paths to be open on the side opposite to the nozzle surface, it is possible to prevent recording liquid from entering the buffer chambers 418.

Further, the atmosphere communicating openings 424 are formed at positions that do not oppose the damper parts 423. Accordingly, it is possible to prevent foreign matter from being inserted into the atmosphere communicating openings 424 to damage the damper parts 423.

According to the liquid discharge head thus configured, for example, the piezoelectric element 412, which may be any of the multiple piezoelectric elements 412, contracts in response to a decrease in the voltage applied thereto from a reference electric potential, so that the diaphragm 402 moves downward to expand the volume of the corresponding pressure liquid chamber 406. As a result, ink flows into the pressure liquid chamber 406. Thereafter, the voltage applied to the piezoelectric element 412 is increased to expand the piezoelectric element 412 in its stacking direction, thereby deforming the diaphragm 402 toward the nozzle 404 to contract the volume of the pressure liquid chamber 406. As a result, the recording liquid in the pressure liquid chamber 406 is pressurized so that a droplet of the recording liquid is discharged (ejected) from the nozzle 404.

Then, by returning the voltage to be applied to the piezoelectric element 412 to the reference electric potential, the diaphragm 402 is restored to its initial position, so that the pressure liquid chamber 406 expands to generate a negative pressure. Accordingly, at this point, the pressure liquid chamber 406 is filled with the recording liquid from the corresponding common liquid chamber 408. Then, after the vibration of the meniscus surface of the nozzle 404 damps so that the meniscus surface is stabilized, the liquid discharge head proceeds to an operation for discharging the next liquid droplet.

The method of driving this head is not limited to the above-described example (pull-push ejection). Pull-ejection or push-ejection can also be performed depending on how the driving waveform is provided.

When a pressure variation is thus caused in the pressure liquid chamber 406 in order to discharge a liquid droplet from the nozzle 404, the pressure variation in the pressure liquid chamber 406 may be propagated to the corresponding common liquid chamber 408 through the fluid resistance part 407, and the pressure variation propagated to the common liquid chamber 408 may be propagated to another one of the pressure liquid chambers 406 through the corresponding fluid resistance part 407. In this case, if the damper chambers 418 are not provided, recording liquid may leak or liquid droplets may be discharged even if the nozzle 404 of the other one of the pressure liquid chambers 406 is a channel that is not to discharge liquid droplets. Further, if the nozzle 404 of the other one of the pressure liquid chambers 406 is a channel that is to discharge liquid droplets, its droplet discharge may be affected.

On the other hand, according to the liquid discharge head of this embodiment, the damper chambers 418 adjacent to the corresponding common liquid chambers 408 through the damper parts 423, which are part of the diaphragm 402, are provided. Accordingly, when a pressure vibration is propagated to any common liquid chamber 408, the corresponding damper part 423 deforms (is displaced) to absorb the pressure variation. This prevents a pressure wave from returning to the pressure liquid chambers 406, so that meniscus controllability is also stabilized.

Even if many pressure liquid chambers 406 are simultaneously driven to discharge liquid droplets from the corresponding nozzles 404, so that a large pressure variation is propagated to the common liquid chambers 408, the damper parts 423 can sufficiently deform to absorb even the large pressure variation with efficiency because the damper chambers 418 communicate with the outside through the atmosphere communicating openings 424.

That is, if the damper chamber 418 is a closed space, the air in the damper chamber 418 serves as resistance to deformation of the corresponding damper parts 423 so as to prevent sufficient deformation of the damper parts 423, so that a large pressure variation cannot be absorbed. On the other hand, according to this embodiment, since each damper chamber 418 is open to the atmosphere, it is possible to prevent the air inside the damper chamber 418 from serving as resistance to deformation of the damper parts 423.

Further, since each damper part 423 is provided as the wall part between the corresponding damper chamber 418 and common liquid chamber 408 so as not to be in direct contact with the atmosphere, layout restrictions are reduced. That is, if the damper parts 423 are in direct contact with the atmosphere, such layout should be provided as to prevent the damper parts 423 from being damaged in the case of occurrence of a jam or the like, thus increasing restrictions. On the other hand, according to this embodiment, since the damper parts 423 are protected by the corresponding damper chambers 418, such layout restrictions are reduced.

Further, since each communicating path has a complete external (atmosphere-side) opening, the movement of air between the damper chambers 418 and the outside is easy, so that a relatively high buffer effect is produced compared with the case of providing a deformable part at an opening (the case of an incomplete opening).

Further, by forming the damper parts 423 as the same layer, with the same thickness, and on the same member as (the first layer 402*a* of) the diaphragm 402 disposed at one surface of each pressure liquid chamber 406, it is possible to reduce the number of components of the head and to form the deformable area of each pressure liquid chamber 406 and the damper parts 423 on each common liquid chamber 408 simultaneously in the same process. Further, after forming the part forming the pressure liquid chambers 406 and the part forming the common liquid chambers 408, the pressure liquid chamber part and the common liquid chamber part can be formed by only joining the parts to the diaphragm 402 including a layer formed of the part forming liquid chamber wall faces and the damper parts 423. Therefore, it is possible to reduce the manufacturing cost, the number of manufacturing processes, and the number of assembling processes of the head.

Further, by forming the damper chambers 418 with the same depth (or penetrating shape) and in the same member (channel plate 401) as the pressure liquid chambers 406 formed in the channel plate 401, it is possible to reduce the number of components of the head, and to form the damper chambers 418 and the pressure liquid chambers 406 simultaneously in the same process. This makes it possible to form the pressure liquid chambers 406 and the damper chambers 418 by a single joining operation, so that it is possible to reduce the manufacturing cost, the number of manufacturing processes, and the number of assembling processes of the head.

Further, by forming the pressure liquid chambers 406 and the damper chambers 418 of the member forming the pressure liquid chambers 406, it is possible to form the common liquid chambers 408 in the frame member 417, so that the common liquid chambers 408 can be large in capacity. In particular, even when the number of nozzles increases as in an elongated head, it is possible to discharge droplets with stability without a shortage of supply of recording liquid to pressure liquid chambers.

According to this embodiment, a piezoelectric element is employed as a pressure generation part. However, the pressure generation part in the liquid discharge head according to this embodiment is not limited, and pressure may also be generated by heating a heating element and generating bubbles in liquid with the action of heat energy.

$14^{th}$ Embodiment

Figure 31:
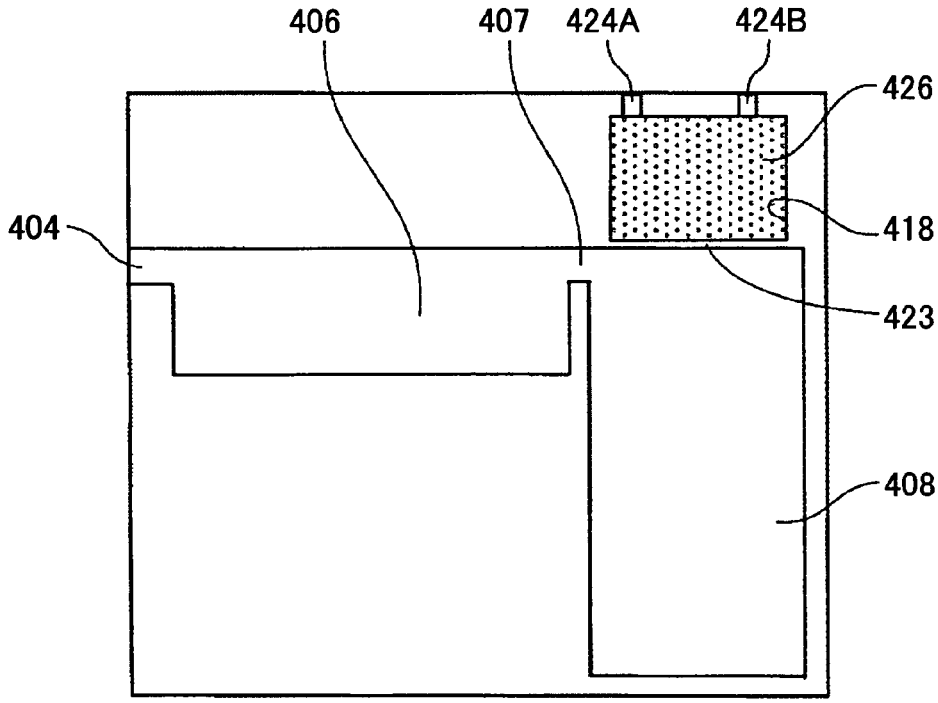
FIG. 31 is a schematic diagram for illustrating a liquid discharge head according to a $14^{th}$ embodiment of the present invention.

Next, a description is given, with reference to FIG. 31, of a liquid discharge head according to a $14^{th}$ embodiment of the present invention. FIG. 31 is a schematic diagram for illustrating the liquid discharge head. In FIG. 31, the same elements as those of the $13^{th}$ embodiment are referred to by the same reference numerals.

Referring to FIG. 31, in this head also, the recording liquid is supplied from the common liquid chamber 408 to the pressure liquid chamber 406 through the fluid resistance part 407, and the recording liquid in the pressure liquid chamber 406 is pressurized by a pressure generation part (not graphically illustrated) so that liquid droplets are discharged from the nozzle 404.

The damper chamber 418 is provided adjacently to the common liquid chamber 408 through the damper part 423 that is a deformable part, and at least two communicating paths 424A and 424B that connect the damper chamber 418 to the outside are provided.

Further, the damper chamber 418 is filled with vibration damping material 426. At the time of filling the damper chamber 418 with the vibration damping material 426, for example, the vibration damping material 426 is pushed (poured) in through the communicating path 424A and degassing is performed through the other communicating path 424B. Alternatively, the damper chamber 418 may be filled with the vibration damping material 426 by removing gas from the damper chamber 418 through the communicating path 424A using a pump to evacuate the damper chamber 418 and generate a negative pressure therein, and at the same time pouring in the vibration control material 426 through the other communicating path 424B.

In this case, by sealing the communicating paths 424A and 424B, provided at the damper chamber 418 to communicate with the outside, with sealing material after pouring in the vibration damping material 426, it is possible to increase a vibration damping effect, and to prevent the vibration damping material 426 from leaking outside.

In this configuration of filling the damper chamber 418 with the vibration damping material 426, the disposition of the damper chamber 418 and the damper parts 423 is not limited to that of the above-described $13^{th}$ embodiment, and the damper chamber 418 and the damper parts 423 may be disposed in any member forming the liquid discharge head as long as the dispositional relationship of the damper chamber 418 and the damper parts 423 with the common liquid chamber 408 satisfies the above-described conditions.

According to this configuration, when a pressure is applied to the pressure liquid chamber 406 in order to cause a liquid droplet to be discharged, the damper parts 423 are deformed by a pressure variation propagated to the common liquid chamber 408, and this deformation of the damper parts 423 is absorbed by the vibration damping material 426. At this point, even if the pressure variation propagated to the common liquid chamber 408 is large, it is possible to sufficiently absorb the pressure and to stably discharge a droplet because the damper chamber 418 is filled with the vibration damping material 426.

Here, the vibration damping material 426 is preferably a viscoelastic material. It is effective in damping vibration to have both elasticity and viscosity. Further, more preferably, the vibration damping material 426 is higher in viscosity than liquid in the common liquid chamber 408. Preferable examples of viscoelastic materials include silicon-based resins, synthetic rubber-based resins, natural rubber, isoprene rubber, and butadiene rubber, and foam including any of these may also be used.

The vibration damping material 426 may be formed by not only applying and setting a stock solution but also forming and disposing a molded article. Further, the vibration damping material 426 is preferably a gel material having elasticity and viscosity that are effective in vibration damping. Silicone gel, whose changes in elasticity and viscosity with respect to temperature are limited, is suitable. Further, the vibration damping material 426 may be liquid such as oil. In this case, silicon oil is preferable.

Further, according to this embodiment, the vibration damping material 426 is out of contact with liquid (ink in this embodiment) in the common liquid chambers 408. Therefore, the vibration damping material 426 may not have resistance to liquid (resistance to ink), thus widening the range of choices for the recording liquid and the vibration damping material 426. As a result, it is easy to lower the manufacturing cost of the head, and to improve image quality because of an increase in usable recording liquid types.

Figure 32:
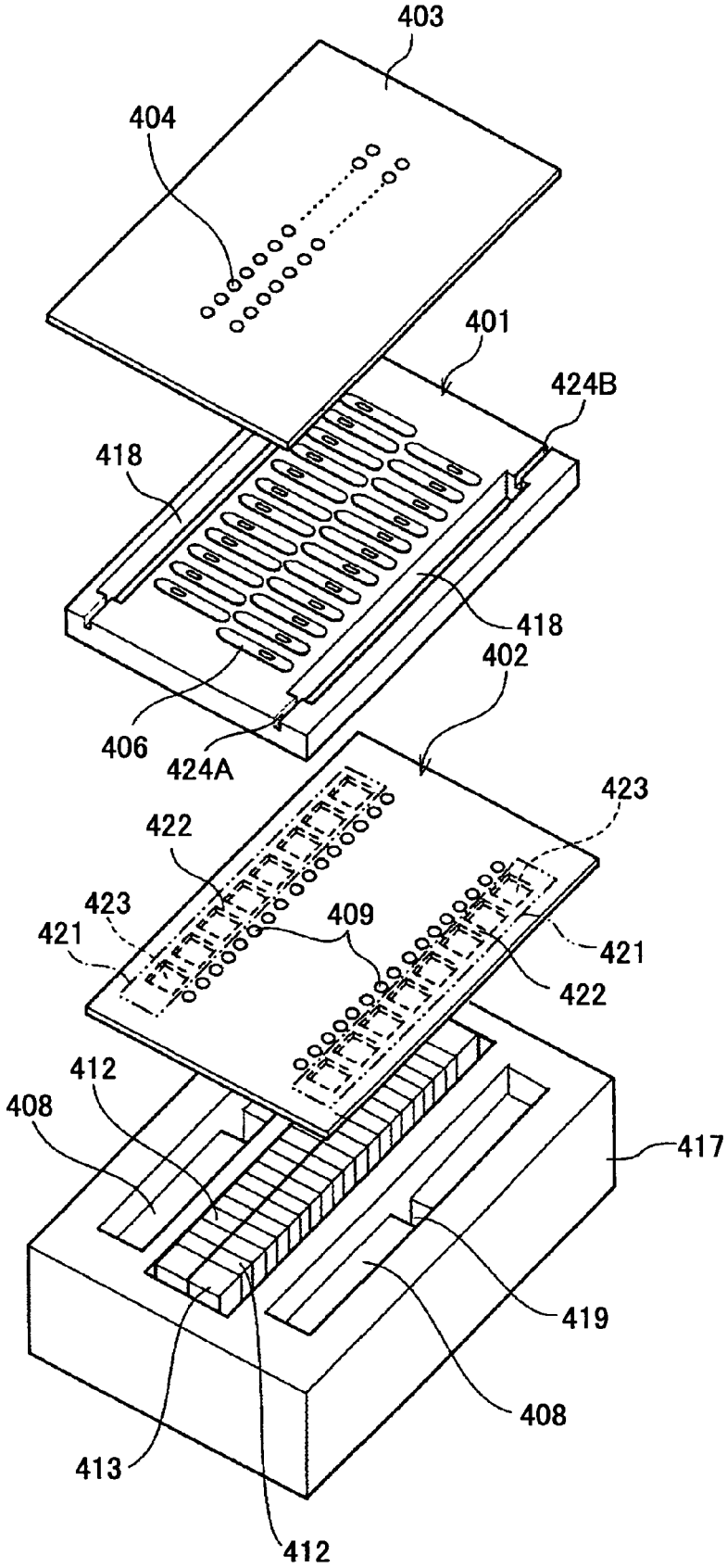
FIG. 32 is an exploded perspective view of the liquid discharge head according to the $14^{th}$ embodiment of the present invention.

Next, a description is given, with reference to FIG. 32, of a configuration of the liquid discharge head according to the $14^{th}$ embodiment. FIG. 32 is an exploded perspective view of the liquid discharge head. In FIG. 32, the same elements as those of the $13^{th}$ embodiment are referred to by the same reference numerals.

Each damper chamber 18 formed in the channel plate 401 communicates with the outside through the corresponding communicating paths 424A and 424B formed of grooves formed in the channel plate 401, and is filled with the vibration damping material 426 (not graphically illustrated). After assembling this liquid discharge head, the damper chamber 418 is filled with the vibration damping material 426 by, for example, pushing (pouring) in the vibration damping material 426 through the communicating path 424A and performing degassing through the other communicating path 424B as described above.

Figure 33:
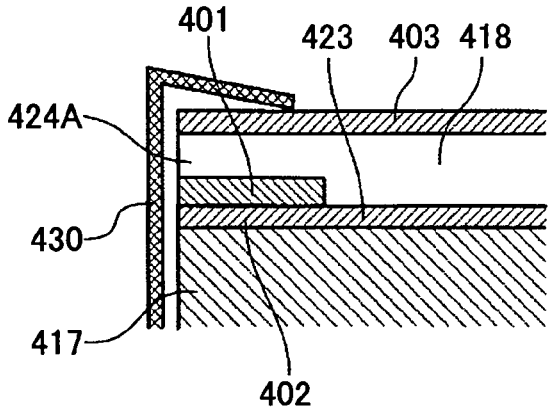
FIG. 33 is a cross-sectional view of part of the liquid discharge head for illustrating the case of covering a communicating path of the liquid discharge head with a nozzle cover according to the $14^{th}$ embodiment of the present invention.

According to this embodiment, the communicating paths 424A and 424B are open on corresponding side surfaces of the channel plate 401. Accordingly, as shown in FIG. 33, it is preferable to cover the corresponding side surfaces of the channel plate 401 with a nozzle cover 430 that protects the periphery of the nozzle plate 403 so as to prevent recording liquid adhering to the nozzle surface from entering the communicating paths 424A and 424B to react with the vibration damping material 426. Further, it is preferable to cover the openings of the communicating paths 424A and 424B with the nozzle cover 430 even in the configuration where the damper chambers 418 are not filled with the vibration damping material 426.

$15^{th}$ Embodiment

Figure 34:
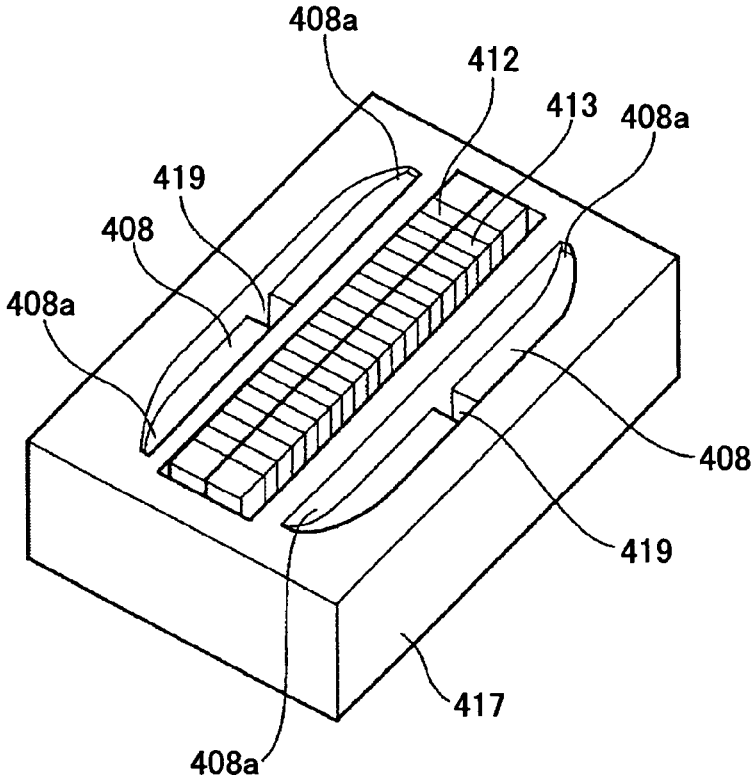
FIG. 34 is a perspective view of a frame member according to a $15^{th}$ embodiment of the present invention.

Next, a description is given, with reference to FIG. 34, of a structure of the common liquid chamber 408 according to a $15^{th}$ embodiment of the present invention. FIG. 34 is a perspective view of the frame member 417.

In this case, each common liquid chamber 408 is shaped to be reduced in width and depth at longitudinal ends 408*a* and 408*b* thereof. Providing the common liquid chambers 408 with such a shape makes it possible to increase a recording-liquid flow characteristic and a bubble discharge characteristic.

$16^{th}$ Embodiment

Figure 35:
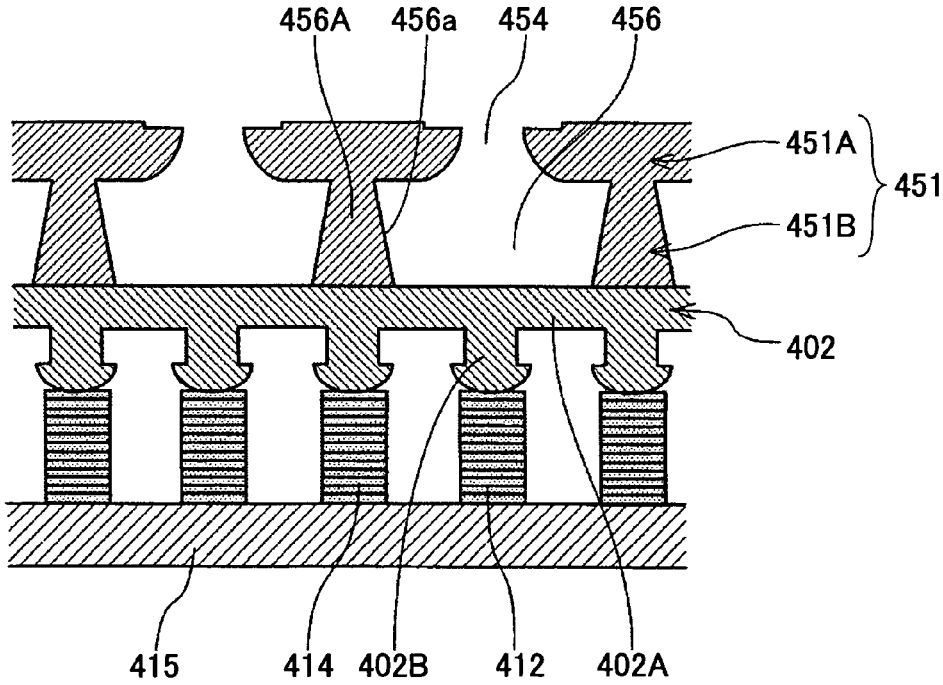
FIG. 35 is a cross-sectional view of part of a liquid discharge head according to a $16^{th}$ embodiment of the present invention.

Next, a description is given, with reference to FIG. 35, of a liquid discharge head integrating a channel plate and a nozzle plate according to a $16^{th}$ embodiment of the present invention. FIG. 35 is a cross-sectional view of part of the liquid discharge head.

According to this liquid discharge head, nozzles 454 from which liquid droplets are discharged, liquid chambers 456 communicating with the corresponding nozzles 454, and damper chambers (not graphically illustrated) are formed by joining the diaphragm 402 and a nozzle channel member 451 into which a nozzle plate 451A and a liquid chamber member (channel plate) 451B are integrated by electroforming. Further, the channel plate 451B forms the liquid chambers 456 and also inter-liquid chamber partition walls 456A, each of which separates corresponding adjacent two of the liquid chambers 456. The configuration of other parts may be the same as in any of the above-described $13^{th}$ to $15^{th}$ embodiments. Accordingly, the other parts are referred to by the same reference numerals, and a description thereof is omitted.

Here, the channel plate 451B including the inter-liquid chamber partition walls 456A is formed of a metal material so as to be shaped so that the thickness (width in the directions of arrangement of the liquid chambers 456) of the channel plate 451B is continuously reduced in the direction away from the diaphragm 402 toward the nozzle plate 451A, that is, so as to be tapered from the diaphragm 402 side to the nozzle plate 451A side with a wall face 56*a* of each partition wall 456A being continuously sloped.

By thus forming the inter-liquid chamber partition walls 456A of a metal material so that at least part of each partition wall 456A is continuously reduced in thickness in the direction away from the diaphragm 402 side to the nozzle plate 451A side, it is possible to support high density while ensuring a sufficient joining area of the inter-liquid chamber partition walls 456A and the diaphragm 402, and to reduce cost and increase reliability.

Further, by thus using a member integrating a nozzle plate and a channel plate, it is only necessary to join a diaphragm to the nozzle channel member in the case of forming a damper chamber using a channel member, so that it is possible to further reduce the number of parts and the number of assembly processes.

$17^{th}$ Embodiment

Figure 36:
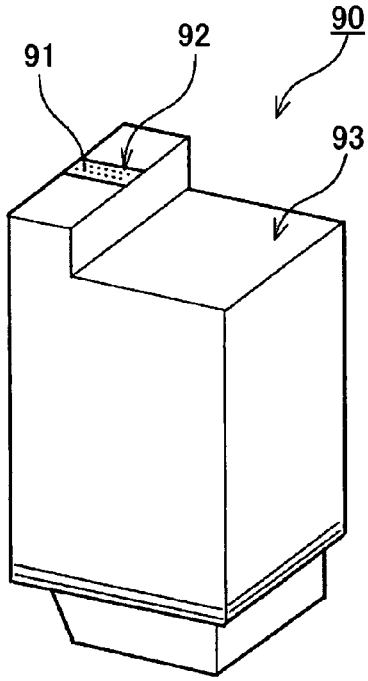
FIG. 36 is a perspective view of a liquid cartridge according to a $17^{th}$ embodiment of the present invention.

Next, a description is given, with reference to FIG. 36, of a liquid cartridge 90 according to a $17^{th}$ embodiment of the present invention. FIG. 36 is a perspective view of the liquid cartridge 90.

This liquid cartridge 90 includes a liquid discharge head 92 having nozzles 91 according to the present invention and a liquid container part (tank) 93 that supplies liquid such as recording liquid to the liquid discharge head 92. The liquid discharge head 92 and the liquid container part 93 are formed as a unit. The liquid discharge head 92 may be, for example, any of the above-described liquid discharge heads.

Thus, according to this embodiment, it is possible to provide a liquid cartridge integrating a liquid discharge head, in which layout restriction is reduced, a pressure variation can be absorbed, and mutual interference can be efficiently controlled.

$18^{th}$ Embodiment

Figure 37:
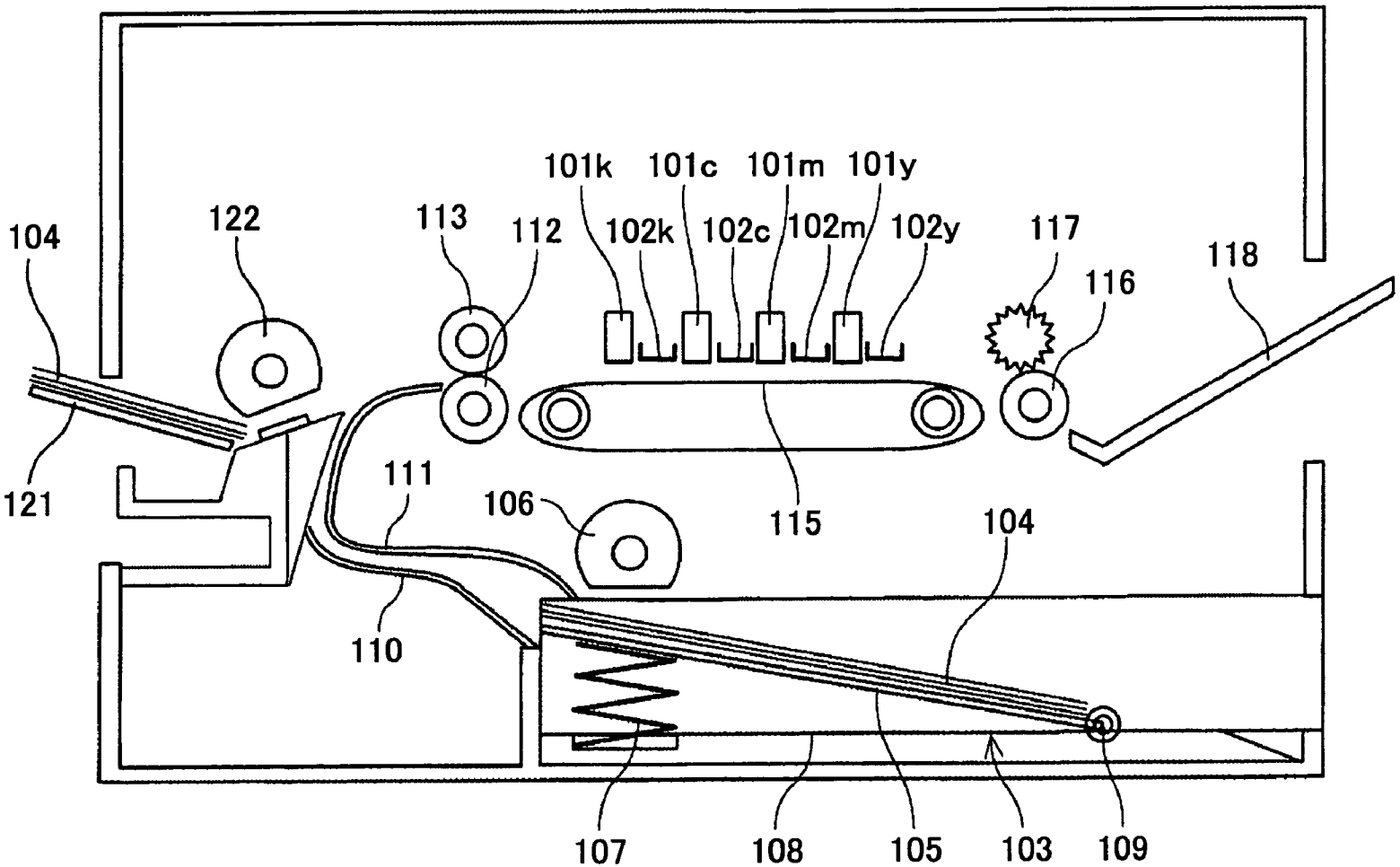
FIG. 37 is a schematic diagram showing an image forming apparatus including a liquid discharger including a liquid discharge head according to an $18^{th}$ embodiment of the present invention.

Next, a description is given, with reference to FIG. 37, of an image forming apparatus including a liquid discharger having a liquid discharge head according to an $18^{th}$ embodiment of the present invention. FIG. 37 is a schematic diagram for illustrating a mechanism part of the image forming apparatus.

This image forming apparatus is a line-type one having a recording head formed of a full-line-type head having a nozzle array (an arrangement of the nozzles 4) whose length is greater than or equal to the width of the print area of a medium.

This image forming apparatus includes four full-line-type recording heads 101*k*, 101*c*, 101*m*, and 101*y* that discharges liquid droplets of colors of black (K), cyan (C), magenta (M), and yellow (Y), respectively. (The recording heads 101*k*, 101*c*, 101*m*, and 110*y* may be collectively referred to by reference numeral "101" when there is no need to distinguish among colors.) Each recording head 101 is formed of a liquid discharge head according to the present invention, which may be, for example, any of the above-described liquid discharge heads. Each recording head 101 is attached to a head holder (not graphically illustrated) with its surface on which the nozzles 4 are formed facing downward. Further, the image forming apparatus has maintenance and recovery mechanisms 102*k*, 102*c*, 102*m*, and 102*y* for maintaining and recovering head performance provided for the recording heads 101*k*, 101*c*, 101*m*, and 101*y*, respectively. (The recovery mechanisms 102*k*, 102*c*, 102*m*, and 102*y* may be collectively referred to by reference numeral "102" when there is no need to distinguish among colors.) At the time of a head performance maintenance operation such as purging or wiping, the recording head 101 and the corresponding maintenance and recovery mechanism 102 are moved relative to each other so that a capping member forming the maintenance and recovery mechanism 102 opposes the nozzle surface of the recording head 101.

Here, the recording heads 101*k*, 101*c*, 101*m*, and 101*y* are disposed so as to discharge liquid droplets of black, cyan, magenta, and yellow colors in this order from the upstream side in a paper conveyance direction in which paper is conveyed. However, the disposition of the recording heads 101 and the number of colors are not limited to these. Further, as a line-type head, it is possible to use one or more heads in which multiple nozzle arrays that discharge liquid droplets of respective colors are provided at predetermined intervals. Further, a head and a recording liquid cartridge that supplies recording liquid to the head may be provided as either a unit or separate bodies.

The image forming apparatus includes a paper feed tray 103. The paper feed tray 103 includes a bottom plate 105 on which paper 104 is placed and a paper feed roller (semilunar roller) 106 for feeding the paper 104. The bottom plate 105 is rotatable on a rotation shaft 109 attached to a base 108, and is urged toward the paper feed roller 106 side by a pressure spring 107. A separation pad (not graphically illustrated) formed of a material having a large coefficient of friction, such as artificial leather or cork, is provided opposite the paper feed roller 106 so as to prevent multiple sheets of the paper 104 from being fed overlapping each other. Further, a release cam (not graphically illustrated) that releases the bottom plate 105 from the paper feed roller 106 is provided.

Further, guide members 110 and 111 that guide the paper 104 are provided in order to feed and place the paper 104 fed from the paper feed tray 103 between a conveyor roller 112 and a pinch roller 113.

The conveyor roller 112 is rotated by a drive source (not graphically illustrated), and conveys the fed paper 104 toward a platen 115 disposed opposite the recording heads 101. The platen 115 may be either a rigid structure or a conveyor belt as long as the platen 115 can maintain the gap between the recording heads 101 and the paper 104.

A paper output roller 116 and a spur 117 opposing the paper output roller 116 for outputting or ejecting the paper 104 with an image formed thereon are disposed on the downstream side of the platen 115. The image-formed paper 104 is output onto a paper output tray 118 by the paper output roller 116.

Further, a manual feed tray 121 for manually feeding the paper 104 and a paper feed roller 122 that feeds the paper 104 placed on the manual feed tray 121 are disposed on the side opposite to the side of the paper output tray 118. The paper 104 fed from the manual feed tray 121 is guided by the guide member 111 to be fed into between the conveyor roller 112 and the pinch roller 113.

In the standby state of this image forming apparatus, the release cam presses down the bottom plate 105 of the paper feed tray 103 so that the bottom plate 105 is out of contact with the paper feed roller 106. When the conveyor roller 112 is rotated in this state, this rotational driving force is transmitted to the paper feed roller 106 and the release cam through gears (not graphically illustrated), so that the release cam is detached from the bottom plate 105 to move the bottom plate 105 upward. Then, the paper 104 comes into contact with the paper feed roller 106. The paper 104 is picked up as the paper feed roller 106 rotates, so that feeding of the paper 104 is started. Sheets of the paper 104 are separated one by one by a separation claw (not graphically illustrated).

With the rotation of the paper feed roller 106, the paper 104 is guided by the guide members 110 and 111 to be fed into between the conveyor roller 112 and the pinch roller 113. The paper 104 is fed to be placed on the platen 115 by the conveyor roller 112. Thereafter, the trailing edge of the paper 104 opposes the D-cut part of the paper feed roller 106 so as to be released therefrom, and is conveyed onto the platen 115 by the conveyor roller 112. One or more auxiliary conveyor rotary bodies may also be provided between the paper feed roller 106 and the conveyor roller 112.

Liquid droplets are discharged from the recording heads 101 onto the paper 104 thus conveyed on the platen 115 so that an image is formed on the paper 104. The paper 104 with the image formed thereon is output onto the paper output tray 118 by the paper output roller 116. The paper conveyance speed and liquid droplet discharge timing at the time of image formation are controlled by a control part (not graphically illustrated).

Thus, by providing an image forming apparatus with a line-type liquid discharge head according to the present invention, it is possible to form a high-quality image at high speed.

$19^{th}$ Embodiment

Figure 38:
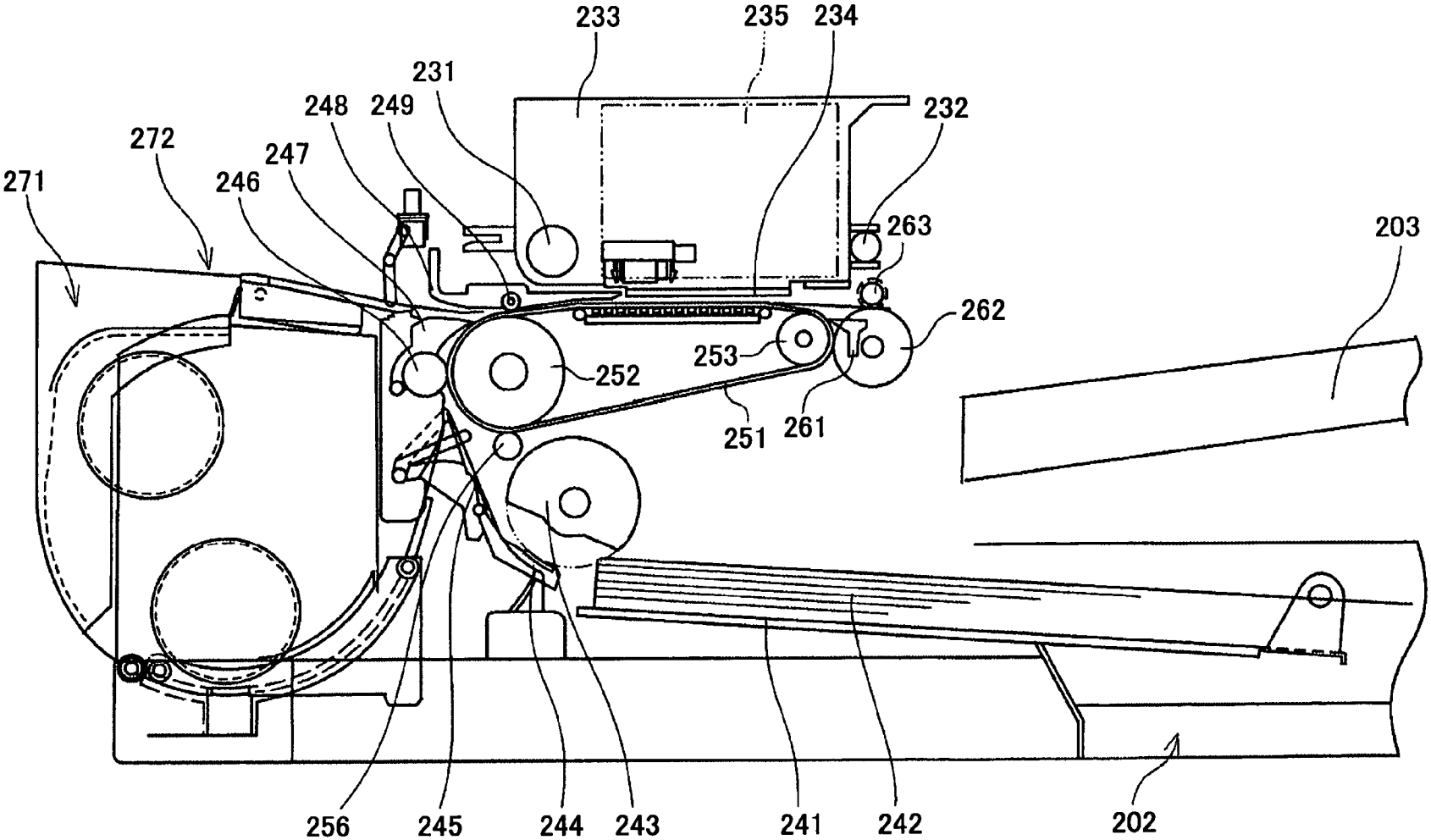
FIG. 38 is a schematic diagram showing an image forming apparatus including a liquid discharger including a liquid discharge head according to a $19^{th}$ embodiment of the present invention.
Figure 39:
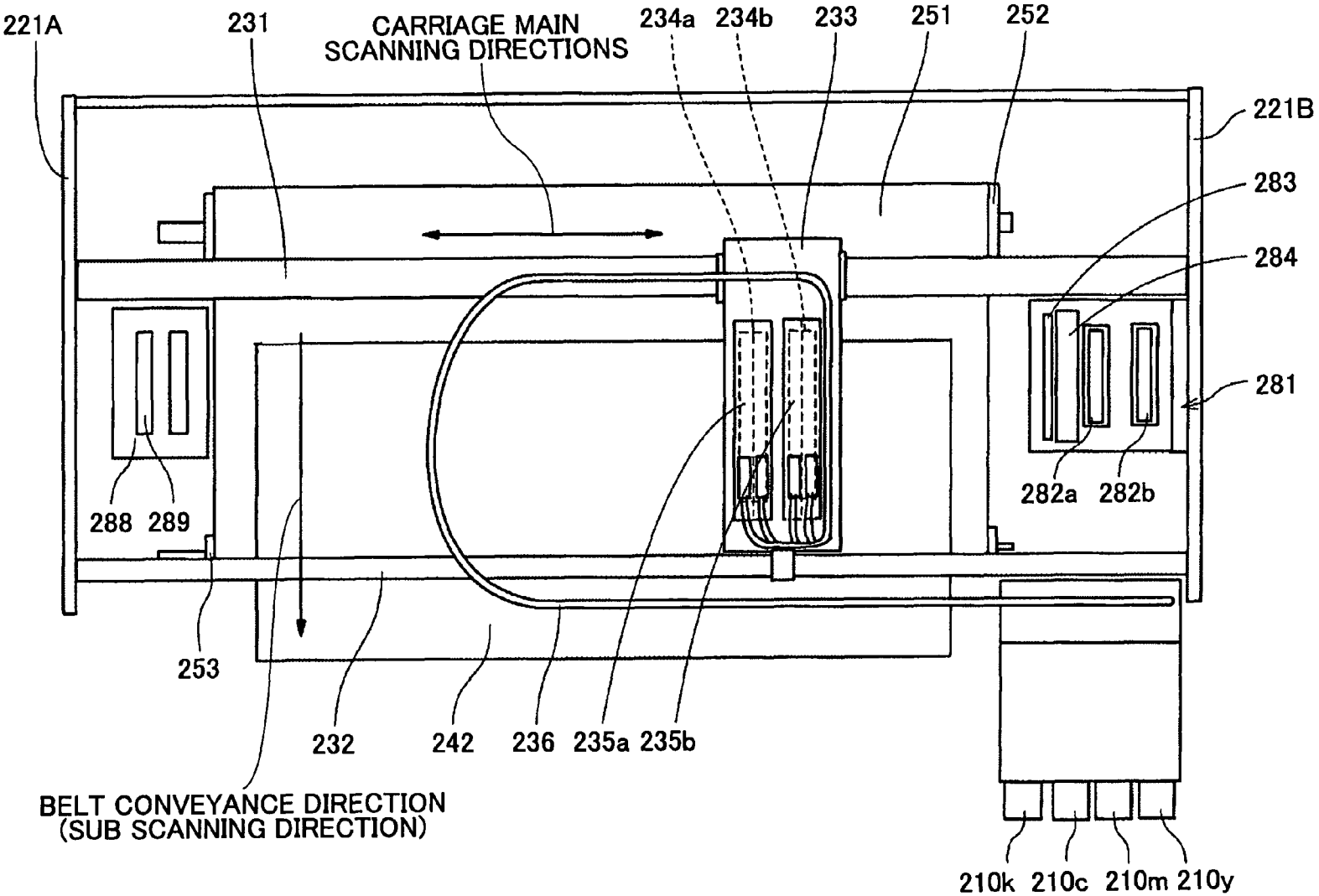
FIG. 39 is a plan view of part of the image forming apparatus according to the $19^{th}$ embodiment of the present invention.

Next, a description is given, with reference to FIGS. 38 and 39, of an image forming apparatus including a liquid discharger having a liquid discharge head according to a $19^{th}$ embodiment of the present invention. FIG. 38 is a schematic diagram for illustrating a mechanism part of the image forming apparatus. FIG. 39 is a plan view of part of the mechanism part.

This image forming apparatus is a serial type. According to this image forming apparatus, a carriage 233 is held with a primary (main) guide rod 231 and a secondary (sub) guide rod 232, which are guide members extending between left and right side plates 221A and 221B, so as to be slidable in the main scanning directions, and the carriage 233 is caused to move and scan in the directions indicated by double-headed arrow in FIG. 39 (carriage main scanning directions) by a main scanning motor (not graphically illustrated) through a timing belt.

Recording heads 234*a* and 234*b* for discharging ink droplets of yellow (Y), cyan (C), magenta (M), and black (K) colors are attached to the carriage 233 with their multiple nozzles being arranged in arrays in the sub scanning direction perpendicular to the main scanning direction and their nozzle surfaces (discharge surfaces) facing downward so that ink droplets are discharged downward. (The recording heads 234*a* and 234*b* may be collectively referred to by reference numeral "234" when no distinction is made therebetween.) Each recording head 234 is formed of a liquid discharge head according to the present invention, which may be any of the above-described liquid discharge heads.

Each recording head 234 has two nozzle arrays. One nozzle array of the recording head 234*a* discharges liquid droplets of black (K), and the other nozzle array of the recording head 234*a* discharges liquid droplets of cyan (C). One nozzle array of the recording head 234*b* discharges liquid droplets of magenta (M), and the other nozzle array of the recording head 234*b* discharges liquid droplets of yellow (Y).

Further, head tanks (sub tanks) 235*a* and 235*b* for supplying color inks to the corresponding nozzle arrays of the recording heads 234*a* and 234*b*, respectively, are provided on the carriage 233. (The head tanks 235*a* and 235*b* may be collectively referred to by reference numeral "235" when no distinction is made therebetween.) The color inks are supplied from corresponding ink cartridges 210*k*, 210*c*, 210*m*, and 210*y* to the corresponding head tanks 235 through corresponding supply tubes 236.

On the other hand, as a paper feed part for feeding paper 242 stacked on a paper stacking part (platen) 241 of a paper feed tray 202, the image forming apparatus includes a semi-lunar roller (paper feed roller) 243 that separates and feeds sheets of the paper 242 one by one from the paper stacking part 241 and a separation pad 244 formed of a material having a large coefficient of friction and disposed opposite the paper feed roller 243. The separation pad 244 is urged toward the paper feed roller 243 side.

Further, the image forming apparatus includes a guide member 245 that guides the paper 242, a counter roller 246, a conveyance guide member 247, and a pressing member 248 including an edge pressure roller 249 in order to feed the paper 242 fed from the paper feed part to a position below the recording heads 234. Further, the image forming apparatus also includes a conveyor belt 251 serving as a conveyor part for conveying the fed paper 242 in a position opposing the recording heads 234 by having the fed paper 242 electrostatically attracted and adhered thereto.

This conveyor belt 251 is an endless belt, and is engaged with and provided between a conveyor roller 252 and a tension roller 253 so as to rotate in a belt conveyance direction (sub scanning direction) (FIG. 39). Further, the image forming apparatus includes a charging roller 256 serving as a charger for charging the surface of the conveyor belt 251. The charging roller 256 is disposed in contact with the surface layer of the conveyor belt 251 so as to be rotated by the rotation of the conveyor belt 251. The conveyor belt 251 is caused to rotate in the belt conveyance direction of FIG. 39 by the conveyor roller 252 being rotated by a sub scanning motor (not graphically illustrated) through a timing belt.

The image forming apparatus further includes a separation claw 261 for separating the paper 242 from the conveyor belt 251, a paper output roller 262, and a paper output roller 263 as a paper output part for outputting (ejecting) the paper 242 subjected to recording with the recording heads 234. The image forming apparatus also includes a paper output tray 203 below the paper output roller 262.

The image forming apparatus includes a duplex unit 271 detachably attached to the rear part of an apparatus main body. The duplex unit 271 takes in the paper 242 returned by the reverse rotation of the conveyor belt 251. Then, the duplex unit 271 reverses the paper 242, and feeds the reversed paper 242 again into between the counter roller 246 and the conveyor belt 251. The upper surface of the duplex unit 271 serves as a manual feed tray 272.

Further, as shown in FIG. 39, a maintenance and recovery mechanism 281 serving as a head maintenance and recovery unit including a recovery part for maintaining and restoring the nozzle status of the recording heads 234 is disposed in one of non-printing areas in the scanning directions of the carriage 233.

The maintenance and recovery mechanism 281 includes cap members (hereinafter referred to as "caps") 282*a* and 282*b* for capping the nozzle surfaces of the recording heads 234*a* and 234*b*, respectively, a wiper blade 283 serving as a blade member for wiping the nozzle surfaces, and a blank discharge (flushing) reception member 284 that receives liquid droplets at the time of flushing or discharging liquid droplets that do not contribute to recording in order to discharge recording liquid with increased viscosity.

Further, as shown in FIG. 39, an ink collection unit (blank ejection receiver) 288, serving as a liquid collection container that receives liquid droplets at the time of flushing or discharging liquid droplets that do not contribute to recording in order to discharge recording liquid with increased viscosity during recording, is disposed in the other one of the non-printing areas in the scanning directions of the carriage 233.

The ink collection unit 288 includes openings 289 elongated along the directions of the nozzle arrays of the recording heads 234.

According to the image forming apparatus thus configured, sheets of the paper 242 are separated and fed one by one from the paper feed tray 202. The paper 242 fed upward in a substantially vertical direction is guided by the guide 245 to be conveyed, held between the conveyor belt 251 and the counter roller 246. Further, the paper 242 has its leading edge guided by the conveyance guide member 247 to be pressed against the conveyor belt 251 by the edge pressure roller 249, so that the conveying direction of the paper 242 is changed by substantially 90°.

At this point, positive output and negative output are alternately applied repeatedly, that is, an alternating voltage is applied, to the charging roller 256, so that the conveyor belt 251 has alternating charging voltage patterns, that is, the conveyor belt 251 is charged so as to have alternate belt-like patterns, each of a predetermined width, of positively charged parts and negatively charged parts in the sub scanning direction that is the rotating direction. When the paper 242 is fed onto this conveyor belt 251 charged alternately positively and negatively, the paper 242 is attracted and adhered to the conveyor belt 251, and is conveyed in the sub scanning direction by the rotation of the conveyor belt 251.

Then, the recording heads 234 are driven in accordance with an image signal while moving the carriage 233, thereby discharging ink droplets onto the paper 242 at rest and performing one line's worth of recording. Then, after conveying the paper 242 by a predetermined amount, the next line is recorded. In response to reception of a recording end signal or a signal indicating that the trailing edge of the paper 242 has reached a recording area, the recording operation ends and the paper 242 is output onto the paper output tray 203.

By having a liquid discharge head according to the present invention, such a serial-type image forming apparatus obtains stable liquid discharge characteristics so as to be able to record a high-quality image at high speed.

Next, a description is given of recording liquid (ink) as liquid discharged from the above-described liquid discharge heads.

The ink discharged from a liquid discharged head according to the present invention contains at least water, a coloring agent, and a wetting agent, and preferably, further contains a penetrant, a surfactant, and as required, other components.

Here, more preferably, the ink has a surface tension of 15 to 30 mN/m at 25° C. If the surface tension is less than 15 mN/m, the ink may excessively wet the nozzle plate of the liquid discharge head according to the present invention and prevent proper ink droplet formation (particle generation), so as to prevent stable ink discharging. Further, if the surface tension exceeds 30 mN/m, the ink may not sufficiently penetrate a recording medium, so as to cause beading or a longer drying time.

The surface tension may be measured, for example, with a platinum plate at 25° C. using a surface tensiometer (CBVP-Z, manufactured by Kyowa Interface Science Co., Ltd.).

[Coloring Agent]

As a coloring agent contained in ink, it is preferable to use at least one of pigment, dye, and colored fine particles.

Examples of suitably used colored fine particles include a water dispersion of polymer fine particles containing at least one of coloring materials of pigment and dye.

Here, the phrase "containing coloring material" means one or both of the condition where coloring material is enclosed in polymer fine particles and the condition where coloring material is adsorbed to the surfaces of polymer fine particles. In this case, a coloring material mixed into the ink according to the present invention does not have to be entirely enclosed in or adsorbed to polymer fine particles, and may be dispersed in an emulsion as long as one or more effects of the present invention are not impaired. The coloring material is not limited in particular as long as it is insoluble or difficult to dissolve in water and adsorbable to the polymer, and may be suitably selected in accordance with a purpose.

The phrase "insoluble or difficult to dissolve in water" means that a coloring material is not dissolved as much as ten parts by weight or more in 100 parts by weight of water at 20° C. Further, the term "dissolved" means that separation or sedimentation of a coloring material cannot be visually recognized at the top or bottom layer of an aqueous solution.

Further, the polymer fine particles containing coloring material (colored fine particles) are preferably 0.01 to 0.16 μm in volume average particle size in ink.

Examples of the coloring agent include dyes such as a water-soluble dye, an oil-soluble dye, and a disperse dye, and pigments. Oil-soluble and disperse dyes are preferable in terms of good adsorbability and enclosability, while pigments are preferred in terms of the light fastness of an image produced.

In terms of efficient impregnation into polymer fine particles, the above-described dyes are preferably dissolved as much as 2 g/litter or more, and more preferably 20 to 600 g/litter, in an organic solvent such as a ketone-based solvent.

Examples of water-soluble dyes include those classified as acid dyes, direct dyes, basic dyes, reactive dyes, and food colors in Color Index, and those excellent in water resistance and light fastness are preferably used.

In this case, examples of acid dyes and food colors include C.I. acid yellow 17, 23, 42, 44, 79 and 142; C.I. acid red 1, 8, 13, 14, 18, 26, 27, 35, 37, 42, 52, 82, 87, 89, 92, 97, 106, 111, 114, 115, 134, 186, 249, 254 and 289; C.I. acid blue 9, 29, 45, 92 and 249; C.I. acid black 1, 2, 7, 24, 26, and 94; C.I. food yellow 3 and 4; C.I. food red 7, 9, and 14; and C.I. food black 1 and 2.

Further, examples of direct dyes include C.I. direct yellow 1, 12, 24, 26, 33, 44, 50, 86, 120, 132, 142 and 144; C.I. direct red 1, 4, 9, 13, 17, 20, 28, 31, 39, 80, 81, 83, 89, 225 and 227; C.I. direct orange 26, 29, 62 and 102; C.I. direct blue 1, 2, 6, 15, 22, 25, 71, 76, 79, 86, 87, 90, 98, 163, 165, 199 and 202; and C.I. direct black 19, 22, 32, 38, 51, 56, 71, 74, 75, 77, 154, 168 and 171.

Further, examples of basic dyes include C.I. basic yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91; C.I. basic red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112; C.I. basic blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155; and C.I. basic black 2 and 8.

Further, examples of reactive dyes include C.I. reactive black 3, 4, 7, 11, 12 and 17; C.I. reactive yellow 1, 5, 11, 13, 14, 20, 21, 22, 25, 40, 47, 51, 55, 65 and 67; C.I. reactive red 1, 14, 17, 25, 26, 32, 37, 44, 46, 55, 60, 66, 74, 79, 96 and 97; and C.I. reactive blue 1, 2, 7, 14, 15, 23, 32, 35, 38, 41, 63, 80 and 95.

There are no particular limitations on pigments, and a pigment suitable for a purpose may be selected. For example, either inorganic or organic pigments may be used.

Examples of inorganic pigments include titanium oxide, ferric oxide, calcium carbonate, barium sulfate, aluminum hydroxide, barium yellow, cadmium red, chrome yellow, and carbon black. Of those, carbon black is preferable. Examples of carbon black include those manufactured by known methods such as the contact, furnace, and thermal processes.

Examples of organic pigments include azo pigments, polycyclic pigments, dye chelates, nitro pigments, nitroso pigments, and aniline black. Of those, azo pigments and polycyclic pigments are more preferable. Examples of azo pigments include azo lakes, insoluble azo pigments, condensation azo pigments, and chelate azo pigments. Examples of polycyclic pigments include phthalocyanine pigments, perylene pigments, perynon pigments, anthraquinone pigments, quinacridone pigments, dioxazine pigments, indigo pigments, thioindigo pigments, isoindolinone pigments, and quinophthalone pigments. Examples of dye chelates include basic dye chelates and acid dye chelates.

There no particular limitations on the colors of pigments, and a color suitable for a purpose may be selected. For example, pigments for black and pigments for other colors may be used. Any of these pigments may be used alone or in combination with one or more of them.

Example of pigments for black include carbon blacks (C.I. pigment black 7) such as furnace black, lampblack, acetylene black, and channel black; metals such as copper, iron (C.I. pigment black 11), and titanium oxide; and organic pigments such as aniline black (C.I. pigment black 1).

Examples of pigments for other colors are as follows.

Examples of pigments for yellow ink include C.I. pigment yellow 1 (fast yellow G), 3, 12 (disazo yellow AAA), 13, 14, 17, 23, 24, 34, 35, 37, 42 (yellow iron oxide), 53, 55, 74, 81, 83 (disazo yellow HR), 95, 97, 98, 100, 101, 104, 108, 109, 110, 117, 120, 138, 150, and 153.

Examples of pigments for magenta include C.I. pigment red 1, 2, 3, 5, 17, 22 (brilliant fast scarlet), 23, 31, 38, 48:1 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 92, 101 (colcothar), 104, 105, 106, 108 (cadmium red), 112, 114, 122 (dimethyl quinacridone), 123, 146, 149, 166, 168, 170, 172, 177, 178, 179, 185, 190, 193, 209, and 219.

Examples of pigments for cyan include C.I. pigment blue 1, 2, 15 (phthalocyanine blue R), 15:1, 15:2, 15:3 (phthalocyanine blue G), 15:4, 15:6 (phthalocyanine blue E), 16, 17:1, 56, 60, and 63.

Examples of pigments for neutral tints include, for red, green, and blue, C.I. pigment red 177, 194, and 224; C.I. pigment orange 43; C.I. pigment violet 3, 19, 23, and 37; and C.I. pigment green 7 and 36.

Examples of suitably used pigments include a self-dispersing pigment having at least one type of hydrophilic group bonded directly or through another atomic group to the surface of the pigment so as to be stably dispersible without use of a dispersing agent. As a result, unlike in the conventional ink, a dispersing agent for dispersing pigment is no longer required. Ionic self-dispersing pigments are preferable, and those anionically charged or those cationically charged are suitable.

Self-dispersing pigments are preferably 0.01 to 0.16 μm in volume average particle size in ink.

Examples of anionic hydrophilic groups include —COOM, —$SO_3M$, —$PO_3HM$, —$PO_3M_2$, —$SO_2NH_2$, and —$SO_2NHCOR$ (where, in the formulas, M represents a hydrogen atom, alkali metal, ammonium, or organic ammonium, and R represents an alkyl group of 1 to 12 carbon atoms, a phenyl group that may have a substituent, or a naphthyl group that may have a substituent). It is preferable to use a color pigment whose surface has, of those, —COOM or —$SO_3M$ bonded thereto.

Regarding "M" in the above-described hydrophilic groups, examples of alkali metal include lithium, sodium, and potassium; and examples of organic ammonium include monomethylammonium, dimethylammonium, trimethylammonium, monoethylammonium, diethylammonium, triethylammonium, monomethanolammonium, dimethanolammonium, and triethanolammonium. Examples of methods of obtaining the above-described anionically charged color pigments include oxidizing a color pigment with sodium hypochlorite as a method of introducing —COONa to the surface of a color pigment, sulfonating a color pigment, and reacting a diazonium salt with a color pigment.

For example, quaternary ammonium groups are preferable as cationic hydrophilic groups, and the following quaternary ammonium groups are more preferable. Pigments having any of these bonded to their surfaces are suitable as coloring material.

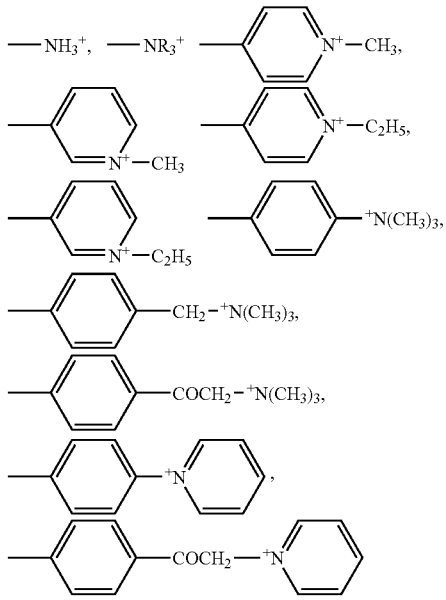

The method of manufacturing cationic self-dispersing carbon black having any of the above-described hydrophilic groups bonded thereto is not limited in particular, and may be suitably selected in accordance with a purpose. For instance, examples of the method of bonding N-ethylpyridyl expressed by the following structural formula include treating carbon black with 3-amino-N-ethylpyridium bromide.

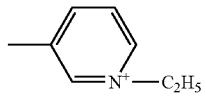

Here, the hydrophilic group may be bonded to the surface of the carbon black through another atomic group. Examples of other atomic groups include an alkyl group of 1 to 12 carbon atoms, a phenyl group that may have a substituent, or a naphthyl group that may have a substituent. Specific examples of bonding of the above-described hydrophilic groups to the surface of carbon black through another atomic group include —$C_2H_4COCM$ (where M represents alkali metal or quaternary ammonium), —$PhSO_3M$ (where Ph represents a phenyl group and M represents alkali metal or quaternary ammonium), and —$C_5H_{10}NH_3$.

Pigment dispersion liquid using a pigment dispersant may also be employed as ink used in a recording method according to the present invention.

Regarding pigment dispersants, examples of natural hydrophilic polymers include vegetable polymers such as gum Arabic, tragacanth gum, gum guaiac, karaya gum, locust bean gum, arabinogalactan, pectin, quince seed starch, and shellac; seaweed polymers such as an alginic acid, carrageenan, and agar; animal polymers such as gelatin, casein, albumin, and collagen; and microbe polymers such as xanthan gum and dextran. Examples of semisynthetic hydrophilic polymers include cellulose polymers such as methyl cellulose, ethyl cellulose, hydroxyethylcellulose, hydroxypropylcellulose, and carboxymethylcellulose; starch polymers such as sodium carboxymethyl starch and sodium starch phosphate; and seaweed polymers such as sodium alginate and propylene glycol alginate. Examples of synthetic hydrophilic polymers include vinyl polymers such as polyvinyl alcohol, polyvinyl pyrrolidone, and polyvinyl methyl ether; acrylic resins such as non-cross-linked polyacrylamide, a polyacrylic acid or its alkali metal salt, and water-soluble styrene acrylic resin; styrene maleic acid resin; water-soluble vinylnaphthalene acrylic resin; water-soluble vinylnaphthalene maleic acid resin; polyvinyl pyrrolidone; polyvinyl alcohol; an alkali metal salt of a condensate of a β-naphthalenesulfonic acid and formalin; and polymers having a salt of a cationic functional group such as quaternary ammonium or an amino group as a side chain. Of these, polymers having a carboxyl group introduced therein, such as those formed of a homopolymer of an acrylic acid, a methacrylic acid, or a styrene acrylic acid or a copolymer of monomers having another hydrophilic acid, are particularly preferable as polymer dispersants.

Here, copolymers are preferably 3,000 to 50,000, and more preferably 7,000 to 15,000, in weight average molecular weight.

Further, the pigment/pigment dispersant mixture mass ratio (pigment:pigment dispersant) is preferably 1:0.06 to 1:3, and more preferably 1:0.125 to 1:3.

The load of the coloring agent in ink is preferably 6 to 15 wt %, and more preferably 8 to 12 wt %. If the load is less than 6 wt %, image density may be lowered because of a decrease in coloring power, or feathering or bleeding may worsen because of a decrease in viscosity. On the other hand, if the load exceeds 15 wt %, nozzles are likely to dry if the inkjet recording apparatus is left unused, so that discharge failure may occur. Further, a decrease in penetrability due to excessively high viscosity or a decrease in image density due to poor dot spreading may result in a coarse image.

[Wetting Agent]

There are no particular limitations on wetting agents, and a wetting agent suitable for a purpose may be selected. For example, at least one selected from polyol compounds, lactam compounds, urea compounds, and saccharides is suitable.

Here, examples of polyol compounds include polyhydric alcohols, polyalcoholic alkyl ethers, polyalcoholic aryl ethers, nitrogen-containing heterocyclic compounds, amides, amines, sulfur-containing compounds, propylenecarbonate, and ethylene carbonate. Any of these compounds may be used alone or in combination with one or more of them.

Examples of polyhydric alcohols include ethylene glycol, diethylene glycol, triethylene glycol, tetraethylene glycol, polyethylene glycol, propylene glycol, dipropylene glycol, tripropylene glycol, polypropylene glycol, 1,3-propanediol, 1,3-butanediol, 1,4-butanediol, 2,3-butanediol, 3-methyl-1,3-butanediol, 1,5-pentanediol, 1,6-hexanediol, glycerol, 1,2,6-hexanetriol, 1,2,4-butanetriol, 1,2,3-butanetriol, and petriol.

Examples of polyalcoholic alkyl ethers include ethyleneglycol monoethyl ether, ethyleneglycol monobutyl ether, diethyleneglycol monomethyl ether, diethyleneglycol monoethyl ether, diethyleneglycol monobutyl ether, tetraethylene glycol monomethyl ether, and propyleneglycol monoethyl ether.

Examples of polyalcoholic aryl ethers include ethyleneglycol monophenyl ether and ethyleneglycol monobenzyl ether.

Examples of nitrogen-containing heterocyclic compounds include N-methyl-2-pyrrolidone, N-hydroxyethyl-2-pyrrolidone, 2-pyrrolidone, 1,3-dimethylimidazolidinone, and ε-caprolactam.

Examples of amides include formamide, N-methyl formamide, and N,N-dimethyl formamide.

Examples of amines include monoethanol amine, diethanol amine, triethanol amine, monoethyl amine, diethyl amine, and triethyl amine.

Examples of sulfur-containing compounds include dimethyl sulfoxide, sulforane, and thiodiethanol.

Of those described above, glycerol, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,5-pentanediol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, and N-hydroxyethyl-2-pyrrolidone are preferable because excellent effects are produced regarding solubility and prevention of ejection characteristic deficiency due to moisture evaporation.

Examples of lactam compounds include 2-pyrrolidone, N-methyl-2-pyrrolidone, N-hydroxyethyl-2-pyrrolidone, and ε-caprolactam.

Examples of urea compounds include at least one selected from urea, thiourea, ethylene urea, and 1,3-dimethyl-2-imidazolidinone. In general, the load of a urea compound in ink is preferably 0.5 to 50 wt %, and more preferably 1 to 20 wt %.

Examples of saccharides include monosaccharides, disaccharides, oligosaccharides (including trisaccharides and tetrasaccharides), polysaccharides, and derivatives thereof. Of those, glucose, mannose, fructose, ribose, xylose, arabinose, galactose, maltose, cellobiose, lactose, sucrose, trehalose, and maltotriose are preferable, and maltitose, sorbitose, gluconolactone, and maltose are particularly preferable.

Here, the above-described polysaccharides mean broad-sense saccharides, which may include substances existing widely in nature, such as α-cyclodextrin and cellulose.

Derivatives of saccharides include reducing sugars of saccharides (for example, sugar alcohol, which is expressed by the general formula $HOCH_2(CHOH)_nCH_2OH$, where n is an integer of 2 to 5), oxidized sugars (for example, aldonic acids and uronic acids), amino acids, and thio acids. Of these, sugar alcohol is preferable in particular. Examples of sugar alcohol include maltitol and sorbitol.

The content of a wetting agent in ink is preferably 10 to 50 wt %, and more preferably 20 to 35 wt %. If the content is too low, nozzles are likely to dry so that discharge failure of liquid droplets may occur. If the content is too high, the ink viscosity may increase to exceed an appropriate viscosity range.

[Penetrant]

Water-soluble organic solvents such as polyol compounds and glycol ether compounds may be used as penetrants. In particular, at least one of a polyol compound and a glycol ether compound having a carbon number greater than or equal to eight is suitably used.

Here, if the carbon number of the polyol compound is less than eight, sufficient penetrability cannot be obtained. As a result, a recording medium may be contaminated at the time of duplex printing, or ink does not spread sufficiently on the recording medium so that pixels are poorly filled. This may cause a decrease in character quality or image density.

Examples of suitable polyol compounds having a carbon number greater than or equal to eight include 2-ethyl-1,3-hexanediol (solubility: 4.2% [25° C.]) and 2,2,4-trimethyl-1,3-pentanediol (solubility: 2.0% [25° C.]).

There are no particular limitations on glycol ether compounds, and a glycol ether compound suitable for a purpose may be selected. Examples of glycol ether compounds include polyalcoholic alkyl ethers such as ethyleneglycol monoethyl ether, ethyleneglycol monobutyl ether, diethyleneglycol monomethyl ether, diethyleneglycol monoethyl ether, diethyleneglycol monobutyl ether, tetraethylene glycol monomethyl ether, and propyleneglycol monoethyl ether; and polyalcoholic aryl ethers such as ethyleneglycol monophenyl ether and ethyleneglycol monobenzyl ether.

The load of a penetrant is not limited in particular, and a load suitable for a purpose may be selected. The load of a penetrant is preferably 0.1 to 20 wt %, and more preferably 0.5 to 10 wt %.

[Surfactant]

There are no particular limitations on surfactants, and a surfactant suitable for a purpose may be selected. Examples of surfactants include anionic surfactants, nonionic surfactants, ampholytic surfactants, and fluorochemical surfactants.

Examples of anionic surfactants include polyoxyethylenealkyletheracetates, dodecylbenzenesulfonates, laurylates, and polyoxyethylenealkylethersulfates.

Examples of nonionic surfactants include acetylene glycolic surfactants, polyoxyethylenealkylether, polyoxyethylenealkylphenylether, polyoxyethylenealkylester, and polyoxyethylenesorvitane fatty acid ester.

Examples of acetylene glycolic surfactants include 2,4,7,9-tetramethyl-5-decyne-4,7-diol, 3,6-dimethyl-4-octyne-3,6-diol, and 3,5-dimethyl-1-hexyne-3-ol. Commercially-available acetylene glycolic surfactant products include Surfynol 104, 82, 465, 485, and TG of Air Products and Chemicals, Inc. (U.S.).

Examples of ampholytic surfactants include laurylaminopropionates, lauryldimethylbetaine, stearyldimethylbetaine, and lauryldihydroxyethylbetaine. Specifically, examples of ampholytic surfactants include lauryldimethylamine oxide, myristyldimethylamine oxide, stearyldimethylamine oxide, dihydroxyethyllaurylamine oxide, polyoxyethylene (palm oil) alkyldimethylamine oxide, dimethylalkyl(palm)betaine, and dimethyllaurylbetaine.

Of these surfactants, inter alia, those expressed by the following general formulas (I), (II), (III), (IV), (V), and (VI) are suitable.

$$R1\text{-}O\text{—}(CH_2CH_2O)hCH_2COOM \quad (I)$$

In the general formula (I), R1 represents an alkyl group, which has a carbon number of 6 to 14 and may be branched, h represents an integer of 3 to 12, and M represents one selected from an alkali metal ion, quaternary ammonium, quaternary phosphonium, and alkanolamine.

$$\begin{array}{l} CH_2COO\text{—}R^2 \\ | \\ MO_3SCHCOO\text{—}R^2 \end{array} \quad (II)$$

In the general formula (II), R2 represents an alkyl group, which has a carbon number of 5 to 16 and may be branched, and M represents one selected from an alkali metal ion, quaternary ammonium, quaternary phosphonium, and alkanolamine.

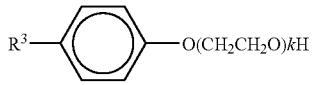

(III)

In the general formula (III), R3 represents a hydrocarbon group such as an alkyl group that has a carbon number of 6 to 14 and may be branched, and k represents an integer of 5 to 20.

$$R4\text{-}(OCH_2CH_2)jOH \quad (IV)$$

In the general formula (IV), R4 represents a hydrocarbon group such as an alkyl group that has a carbon number of 6 to 14, and j represents an integer of 5 to 20.

$$H\text{—}(OCH_2CH_2)_L\text{—}(O\overset{\overset{CH_3}{|}}{C}HCH_2)_p\text{—}R^6 \quad (V)$$

In the general formula (V), $R^6$ represents a hydrocarbon group such as an alkyl group that has a carbon number of 6 to 14 and may be branched, and each of L and p represents an integer of 1 to 20.

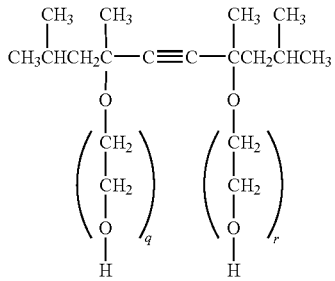

(VI)

In the general formula (VI), each of q and r represents an integer of 0 to 40.

Surfactants of the above-described structural formulas (I) and (II) are specifically shown below in free acid form. First, examples of surfactants of (I) include those expressed by the following (I-1) through (I-6).

$$CH_3(CH_2)_{12}O(CH_2CH_2O)_3CH_2COOH \quad (I\text{-}1)$$

$$CH_3(CH_2)_{12}O(CH_2CH_2O)_4CH_2COOH \quad (I\text{-}2)$$

$$CH_3(CH_2)_{12}O(CH_2CH_2O)_5CH_2COOH \quad (I\text{-}3)$$

-continued $$CH_3(CH_2)_{12}O(CH_2CH_2O)_6CH_2COOH \quad (I\text{-}4)$$

$$CH_3(CH_2)_{11}\underset{\underset{CH_3}{|}}{C}HO(CH_2CH_2O)_6CH_2COOH \quad (I\text{-}5)$$

$$CH_3(CH_2)_6\underset{\underset{(CH_2)_5CH_3}{|}}{C}HO(CH_2CH_2O)_3CH_2COOH \quad (I\text{-}6)$$

Next, examples of surfactants of (II) include those expressed by the following (II-1) through (II-4).

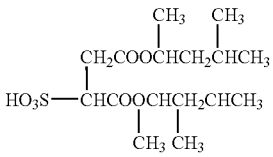

(II-1)

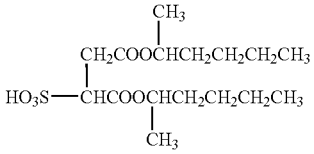

(II-2)

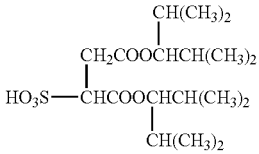

(II-3)

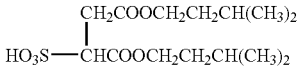

(II-4)

Next, examples of fluorochemical surfactants include those expressed by the following general formula (A).

$$CF_3CF_2(CF_2CF_2)m\text{-}CH_2CH_2O(CH_2CH_2O)nH \quad (A)$$

In the general formula (A), m represents an integer of 0 to 10, and n represents an integer from 1 to 40.

Examples of fluorochemical surfactants include perfluoroalkylsulfonic acid-type compounds, perfluoroalkylcarboxylic acid-type compounds, perfluoroalkylphosphoric acid-type compounds, perfluoroalkyl compounds with an ethylene oxide unit(s), and polyoxyalkylene ether compounds having a perfluoroalkyl ether group as a side chain. Of these, polyoxyalkylene ether compounds having a perfluoroalkyl ether group as a side chain are particularly preferable because they have low foamability and have low fluorine compound bioaccumulation characteristics so as to be highly safe with respect to bioaccumulation of fluorine compounds, which has been seen as a problem of late.

Examples of perfluoroalkylsulfonic acid-type compounds include perfluoroalkylsulfonic acids and perfluoroalkylsulfonates.

Examples of perfluoroalkylcarboxylic acid-type compounds include perfluoroalkylcarboxylic acids and perfluoroalkylcarboxylates.

Examples of perfluoroalkylphosphoric acid-type compounds include perfluoroalkylphosphoric acid ester and perfluoroalkylphosphates.

Further, examples of polyoxyalkylene ether compounds having a perfluoroalkyl ether group as a side chain include polyoxyalkylene ether polymers having a perfluoroalkyl ether group as a side chain, polyoxyalkylene ether sulfate salts having a perfluoroalkyl ether group as a side chain, and salts of polyoxyalkylene ethers having a perfluoroalkyl ether group as a side chain.

Examples of counterions for these salt-type fluorochemical surfactants include ions of Li, Na, K, $NH_4$, $NH_3CH_2CH_2OH$, $NH_2(CH_2CH_2OH)_2$, and $NH(CH_2CH_2OH)_3$.

Further, either suitably synthesized fluorochemical surfactants or commercially available fluorochemical surfactant products may be used.

Examples of commercially available fluorochemical surfactant products include Surflon S-111, S-112, S-113, S-121, S-131, S-132, S-141, and S-145 (manufactured by Asahi Glass Co., Ltd.); Fluorad FC-93, FC-95, FC-98, FC-129, FC-135, FC-170C, FC-430, and FC-431 (manufactured by Sumitomo 3M Ltd.); Megafac F-470, F-1405, and F-474 (manufactured by Dainippon Ink and Chemicals, Inc.); Zonyl TBS, FSP, FSA, FSN-100, FSN, FSO-100, FSO, FS-300, and UR (manufactured by DuPont); FT-110, FT-250, FT-251, FT-400S, FT-150, and FT-400SW (manufactured by Neos co., Ltd.); and PF-151N (manufactured by Omnova Solutions, Inc.). Of these, Zonyl FS-300, FSN, FSN-100, and FSO (manufactured by DuPont) are particularly preferable in terms of excellent reliability and coloring improvement.

[Other Components]

There are no particular limitations on other components, and one or more suitable components may be selected. Examples of other components include a resin emulsion, a pH adjustor, a preservative/fungicide, a rust inhibitor, an antioxidant, an ultraviolet ray absorber, an oxygen absorbent, and a light stabilizer.

The resin emulsion has resin fine particles dispersed in water as a continuous phase, and may contain a dispersing agent such as a surfactant as required.

In general, the content of resin fine particles as a dispersed phase component (the content of resin fine particles in the resin emulsion) is preferably 10 to 70 wt %. Further, the resin fine particles are preferably 10 to 1000 nm, and more preferably 20 to 300 nm, in average particle size particularly in consideration of their use in inkjet recording apparatuses.

There are not particular limitations on the resin fine particle component of the dispersed phase, and a resin fine particle component suitable for a purpose may be selected. Examples of resin fine particle components include acrylic resins, vinyl acetate-based resins, styrene-based resins, butadiene-based resins, styrene-butadiene-based resins, vinyl chloride-based resins, acryl-styrene-based resins, and acryl-silicone-based resins. Of these, acryl-silicone-based resins are particularly preferable.

Either suitably synthesized resin emulsions or commercially available resin emulsion products may be used.

Examples of commercially available resin emulsions include Micro gel E-1002 and E-5002 (styrene-acryl-based resin emulsions, manufactured by Nippon Paint Co., Ltd.), Boncoat 4001 (an acrylic resin emulsion, manufactured by Dai Nippon Ink and Chemicals Inc.), Boncoat 5454 (a styrene-acryl-based resin emulsion, manufactured by Dai Nippon Ink and Chemicals Inc.), SAE-1014 (a styrene-acryl-based resin emulsion, manufactured by Zeon Corp.), Saivinol SK-200 (an acrylic resin emulsion, manufactured by Saiden Chemical Industry Co., Ltd.), Primal AC-22 and AC-61 (an acrylic resin emulsion, manufactured by Rohm and Haas Company), Nanocryl SBCX-2821 and 3689 (acryl-silicone-based resin emulsions, manufactured by Toyo Ink Mfg. Co., Ltd.), and #3070 (a methacrylic acid methyl polymer resin emulsion, manufactured by Mikuni Color Limited).

The load of the resin fine particle component in the resin emulsion in ink is preferably 0.1 to 50 wt %, more preferably 0.5 to 20 wt %, and further preferably 1 to 10 wt %. If the load is less than 0.1 wt %, anti-clogging and discharge stability characteristics may not be sufficiently improved. If the load exceeds 50 wt %, the storage stability of ink may be reduced.

Examples of preservatives/fungicides include 1,2-benzisothiazolin-3-one, sodium dehydroacetate, sodium sorbate, sodium 2-pyridinethiol-1-oxide, sodium benzoic acid, and sodium pentachlorophenol.

There are no particular limitations on pH adjustors as long as pH can be controlled to be greater than or equal to 7 without adversely affecting ink, and a material suitable for a purpose may be selected.

Examples of pH adjustors include amines such as diethanolamine and triethanolamine; alkali metal hydroxides such as lithium hydroxide, sodium hydroxide, and potassium hydroxide; ammonium hydroxide; quaternary ammonium hydroxide; quaternary phosphonium hydroxide; and alkali metal carbonates such as lithium carbonate, sodium carbonate, and potassium carbonate.

Examples of rust inhibitors include acid sulfite, sodium thiosulfate, ammonium thiodiglycolate, diisopropylammonium nitrite, tetra nitric acid pentaerythritol, and dicyclohexylammonium nitrite.

Examples of antioxidants include phenolic antioxidant (including hindered phenolic antioxidants), aminic antioxidants, sulfur-based antioxidants, and phosphoric antioxidants.

Examples of phenolic antioxidant (including hindered phenolic antioxidants) include butylated hydroxyanisole, 2,6-di-tert-butyl-4-ethyl phenol, stearyl-β-(3,5-di-tert-butyl-4-hydroxyphenyl) propionate, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 3,9-bis[1,1-dimethyl-2-[β-(3-tert-butyl-4-hydroxy-5-methylphenyl) propionyloxy]ethyl]2,4,8,10-tetraoxaspiro[5,5] undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis[methylene-3-(3',5'-di-tert-butyl-4'-hydroxyphenyl)propionate]methane.

Examples of aminic antioxidants include phenyl-β-naphthylamine, α-naphthylamine, N,N'-di-sec-butyl-p-phenylenediamine, phenothiazine, N,N'-diphenyl-p-phenylenediamine, 2,6-di-tert-butyl-p-cresol, 2,6-di-tert-butylphenol, 2,4-dimethyl-6-tert-butylphenol, butylhydroxyanisole, 2,2'-methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene-3(3,5-di-tert-butyl-4-dihydroxyphenyl)propionate]methane, and 1,1,3-tris(2-methyl-4-hydroxy-5-tert-butylphenyl)butane.

Examples of sulfur-based antioxidants include dilauryl 3,3'-thiodipropionate, distearyl thiodipropionate, lauryl-stearyl thiodipropionate, dimyristyl 3,3'-thiodipropionate, distearyl β,β'-thiodipropionate, 2-mercaptobenzoimidazole, and dilauryl sulfide.

Examples of phosphoric antioxidants include triphenyl phosphite, octadecyl phosphite, triisodecyl phosphite, trilauryl trithiophosphite, and trinonylphenyl phosphite.

Examples of ultraviolet ray absorbers include benzophenone-based ultraviolet ray absorbers, benzotriazole-based ultraviolet ray absorbers, salicylate-based ultraviolet ray absorbers, cyanoacrylate-based ultraviolet ray absorbers, and nickel complex salt-based ultraviolet ray absorbers.

Examples of benzophenone-based ultraviolet ray absorbers include 2-hydroxy-4-n-octoxybenzophenone, 2-hydroxy-4-n-dodecyloxybenzophenone, 2,4-dihydroxybenzophenone, 2-hydroxy-4-methoxybenzophenone, and 2,2',4,4'-tetrahydroxybenzophenone.

Examples of benzotriazole-based ultraviolet ray absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

Examples of salicylate-based ultraviolet ray absorbers include phenyl salicylate, p-tert-butylphenyl salicylate, and p-octylphenyl salicylate.

Examples of cyanoacrylate-based ultraviolet ray absorbers include ethyl-2-cyano-3,3'-diphenyl acrylate, methyl-2-cyano-3-methyl-3-(p-methoxyphenyl)acrylate, and butyl-2-cyano-3-methyl-3-(p-methoxyphenyl)acrylate.

Examples of nickel complex salt-based ultraviolet ray absorbers include nickel-bis(octylphenyl) sulfide, nickel (II) 2,2'-thiobis(4-tert-octylferrate)-n-butylamine, nickel (II) 2,2'-thiobis(4-tert-octylferrate)-2-ethylhexylamine, and nickel (II) 2,2'-thiobis(4-tert-octylferrate)triethanolamine.

Ink in the ink medium set according to the present invention is manufactured by dispersing or dissolving at least water, a coloring agent, and a wetting agent in an aqueous medium, together with a penetrating agent and a surfactant as needed, and further with other components as needed, and stirring and mixing them as needed. The dispersing may be performed using, for example, a sand mill, a homogenizer, a ball mill, a paint shaker, or an ultrasonic disperser. The stirring and mixing can be performed using a normal agitator with impellers, a magnetic stirrer, or a high-speed disperser.

The ink viscosity is preferably greater than or equal to 1 mPa·s and less than or equal to 20 mPa·s, and more preferably 2 to 20 mPa·s, at 25° C. If the ink viscosity exceeds 20 mPa·s, it may be difficult to ensure discharge stability. Further, the ink viscosity is preferably greater than or equal to 5 mPa·s at 25° C. in order to reduce bleeding of an image.

The ink pH is preferably 7 to 10, for example.

There are no particular limitations on ink colors, and an ink color suitable for a purpose may be selected. Examples of ink colors include yellow, magenta, cyan, and black. A multicolor image can be formed by performing recording using an ink set employing two or more of these colors. A full-color image can be formed by performing recording using an ink set employing all of these colors.

Next, a description is given of specific example implementations. However, a liquid (recording liquid) discharged from a liquid discharge head according to the present invention is not limited to the following example implementations.

Example Preparation 1

Preparation of Dispersion of Polymer Fine Particles Containing Copper Phthalocyanine Pigment After sufficient replacement with a nitrogen gas in a 1 L flask having a mechanical agitator, a thermometer, a nitrogen gas introducing tube, a reflux tube, and a droplet funnel, 11.2 g of styrene, 2.8 g of acrylate, 12.0 g of lauryl methacrylate, 4.0 g of polyethylene glycol methacrylate, 4.0 g of styrene macromer (product name: AS-6, manufactured by Toagosei Co., Ltd.), and 0.4 g of mercapto ethanol were introduced into the flask, and the flask was heated to 65° C. Then, an aqueous mixture of 100.8 g of styrene, 25.2 g of acrylate, 108.0 g of lauryl methacrylate, 36.0 g of polyethylene glycol methacrylate, 60.0 g of hydroxyethyl methacrylate, 36.0 g of styrene macromer (product name: AS-6, manufactured by Toagosei Co., Ltd.), 3.6 g of mercapto ethanol, 2.4 g of azobis dimethyl valeronitrile, and 18 g of methyl ethyl ketone was dropped into the flask in 2.5 hours.

After the dropping was completed, an aqueous mixture of 0.8 g of azobis dimethyl valeronitrile and 18 g of methyl ethyl ketone was dropped into the flask in 0.5 hours. After aging the mixture for 1 hour at 65° C., 0.8 g of azobis dimethyl valeronitrile were added, and the mixture was further aged for 1 hour. After completion of the reaction, 364 g of methyl ethyl ketone were added into the flask, thereby obtaining 800 g of a polymer solution of a 50 wt % density. Then, the polymer solution was partly dried, and was measured by gel permeation chromatography (standard: polystyrene, solvent; tetrahydrofuran), according to which the weight average molecular weight (Mw) was 15000.

Next, 28 g of the obtained polymer solution, 26 g of a copper phthalocyanine pigment, 13.6 g of 1 mol/L potassium hydroxide solution, 20 g of methyl ethyl ketone, and 30 g of ion-exchanged water were sufficiently stirred, and thereafter mixed (or kneaded) 20 times using a three-roll mill (product name: NR-84A, manufactured by Noritake Company). The obtained paste was put in 200 g of ion-exchange water. After sufficiently stirring the mixture, methyl ethyl ketone and water were evaporated using an evaporator, thereby obtaining 160 g of a blue polymer fine particle dispersion whose solid content is 20.0 wt %.

The average particle size (D 50%) of the obtained polymer fine particles measured with a particle size distribution measuring apparatus (Microtrac UPA, Manufactured by Nikkiso Co., Ltd.) was 93 nm.

Example Preparation 2

Preparation of Dispersion of Polymer Fine Particles Containing Dimethyl Quinacridone Pigment A magenta polymer fine particle dispersion was prepared the same as in Example Preparation 1 except that the copper phthalocyanine pigment was changed to C.I. pigment red 122.

The average particle size (D 50%) of the obtained polymer fine particles measured with a particle size distribution measuring apparatus (Microtrac UPA, Manufactured by Nikkiso Co., Ltd.) was 127 nm.

Example Preparation 3

Preparation of Dispersion of Polymer Fine Particles Containing Monoazo Yellow Pigment A yellow polymer fine particle dispersion was prepared the same as in Example Preparation 1 except that the copper phthalocyanine pigment was changed to C.I. pigment yellow 74.

The average particle size (D 50%) of the obtained polymer fine particles measured with a particle size distribution measuring apparatus (Microtrac UPA, Manufactured by Nikkiso Co., Ltd.) was 76 nm.

Example Preparation 4

Preparation of Dispersion of Polymer Fine Particles Containing Carbon Black Treated With Sulfonating Agent First, 150 g of a commercially available carbon black pigment (Printex #85, manufactured by Degussa AG) was well mixed into 400 ml of sulfolane. After the mixture was subjected to slight dispersing with a bead mill, 15 g of a sulfamic acid was added to the mixture, and the mixture was stirred for 10 hours at 140 to 150° C. Then, the resultant slurry was put in 1000 ml of ion-exchanged water, and was subjected to centrifugation at 12,000 rpm so that a surface-treated carbon black wet cake was obtained. The obtained carbon black wet cake was redispersed in 2000 ml of ion exchanged water, and its pH was adjusted with lithium hydroxide. Then, the dispersion was subjected to desalination and concentration with an ultrafilter membrane, so that a carbon black dispersion having a pigment concentration of 10% was obtained. This dispersion was filtrated with a 1 μm nylon filter.

The average particle size (D 50%) of the resultant carbon black dispersion measured with a particle size distribution measuring apparatus (Microtrac UPA, Manufactured by Nikkiso Co., Ltd.) was 80 nm.

Example Manufacture 1

Preparation of Cyan Ink

First, 20.0 wt % of the copper phthalocyanine pigment-containing polymer fine particle dispersion of Example Preparation 1, 23.0 wt % of 3-methyl-1,3-butanediol, 8.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a cyan ink was prepared.

Example Manufacture 2

Preparation of Magenta Ink

First, 20.0 wt % of the dimethyl quinacridone pigment-containing polymer fine particle dispersion of Example Preparation 2, 22.5 wt % of 3-methyl-1,3-butanediol, 9.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a magenta ink was prepared.

Example Manufacture 3

Preparation of Yellow Ink

First, 20.0 wt % of the monoazo yellow pigment-containing polymer fine particle dispersion of Example Preparation 3, 24.5 wt % of 3-methyl-1,3-butanediol, 8.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a yellow ink was prepared.

Example Manufacture 4

Preparation of Black Ink

First, 20.0 wt % of the carbon black dispersion of Example Preparation 4, 22.5 wt % of 3-methyl-1,3-butanediol, 7.5 wt % of glycerin, 2.0 wt % of 2-pyrrolidone, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a black ink was prepared.

Next, the surface tensions and viscosities of the obtained inks of Example Manufactures 1 through 4 were measured as follows. Table 1 shows the measurement results.

[Viscosity Measurement]

The viscosities were measured at 25° C. under the conditions of a cone of 1° 34'×R24, a rotation speed of 60 rpm, and a measurement time of 3 min. using an R-500 viscometer (manufactured by TOKI SANGYO CO., LTD).

[Surface Tension Measurement]

The surface tensions were static ones measured with a platinum plate at 25° C. using a surface tensiometer (CBVP-Z, manufactured by Kyowa Interface Science Co., Ltd.).

TABLE 1

| | Viscosity (mPa · S) | Surface Tension (mN/m) |
|---|---|---|
| Example Manufacture 1 | 8.05 | 25.4 |
| Example Manufacture 2 | 8.09 | 25.4 |
| Example Manufacture 3 | 8.11 | 25.7 |
| Example Manufacture 4 | 8.24 | 25.4 |

In the above-described embodiments, a liquid discharge according to the present invention is applied to image forming apparatuses having a printer configuration. However, a liquid discharger according to the present invention may also be applied to image forming apparatuses such as multifunction machines having the functions of a printer, a facsimile machine, and a copier, and to liquid dischargers and image forming apparatuses using liquid other than recording liquid.

According to one embodiment of the present invention, there is provided a liquid discharge head, including a plurality of individual channels communicating with corresponding nozzles from which liquid is discharged; a common channel configured to supply the liquid to the individual channels; a deformable member configured to form at least one wall face of the common channel; and a vibration damping member formed of a viscoelastic material, the vibration member being provided in contact with the deformable member (configuration 1).

According to the above-described liquid discharge head, the deformable member forming the one wall face of the common channel deforms in response to a pressure variation in the common channel so as to absorb the pressure variation, and the vibration of the deformable member is damped by the vibration damping member. Accordingly, it is possible to immediately damp the vibration of the deformable member, so that it is possible to perform accurate meniscus control even if there occurs a large pressure variation in the common channel.

Additionally, in the liquid discharge head as set forth in configuration 1, the vibration damping member may be provided across the deformable part from the common liquid chamber (configuration 2).

Additionally, in the liquid discharge head as set forth in configuration 1, the viscoelastic material may have a viscosity higher than a viscosity of the liquid (configuration 3).

Additionally, in the liquid discharge head as set forth in configuration 1, the viscoelastic material may be a gel material (configuration 4).

Additionally, in the liquid discharge head as set forth in configuration 4, the viscoelastic material may be a silicone gel (configuration 5).

Additionally, in the liquid discharge head as set forth in configuration 1, the deformable member may be resistant to the liquid (configuration 6).

Additionally, in the liquid discharge head as set forth in configuration 1, the vibration damping member may be resistant to the liquid (configuration 7).

Additionally, in the liquid discharge head as set forth in configuration 1, the vibration damping member may be repellent to the liquid (configuration 8).

Additionally, the liquid discharge head as set forth in configuration 1 may further include a protection layer configured to protect the vibration damping member (configuration 9).

Additionally, in the liquid discharge head as set forth in configuration 9, the protection layer may be resistant to the liquid (configuration 10).

Additionally, in the liquid discharge head as set forth in configuration 9, the protection layer may be repellent to the liquid (configuration 11).

Additionally, the liquid discharge head as set forth in configuration 1 may further include a member configured to protect the deformable member and the vibration damping member (configuration 12).

Additionally, the liquid discharge head as set forth in configuration 1 may further include a diaphragm member configured to have a deformable area forming at least one wall face of each of the individual channels, wherein the deformable member is a part of the diaphragm member (configuration 13).

Additionally, the liquid discharge head as set forth in configuration 1 may further include a diaphragm member configured to have a deformable area forming at least one wall face of each of the individual channels, wherein the deformable member has a same thickness as the deformable area of the diaphragm member (configuration 14).

Additionally, in the liquid discharge head as set forth in configuration 1, the common liquid chamber may have a cross-sectional area thereof relatively reduced at an end thereof in a direction in which the nozzles are arranged (configuration 15).

Additionally, in the liquid discharge head as set forth in configuration 1, a viscosity of the liquid may be greater than or equal to 5 mPa·s at 25° C. (configuration 16).

According to one embodiment of the present invention, there is provided a liquid cartridge integrating a liquid discharge head and a tank configured to supply liquid to the liquid discharge head, wherein the liquid discharge head is that of any of configurations 1 to 12 (configuration 17).

The above-described liquid cartridge includes a liquid discharge head according to one embodiment of the present invention. Therefore, according to one aspect of the present invention, it is possible to provide a liquid cartridge including a liquid discharge head, the liquid cartridge being capable of performing accurate meniscus control even if there occurs a large pressure variation in the common channel.

According to one embodiment of the present invention, there is provided a liquid discharger configured to discharge a liquid droplet from a liquid discharge head, wherein the liquid discharge head is that of any of configurations 1 to 16 or that of the liquid cartridge of configuration 17 (configuration 18).

The above-described liquid discharger includes a liquid discharge head or a liquid cartridge according to one embodiment of the present invention. Accordingly, the liquid discharger can discharge droplets with stability.

According to one embodiment of the present invention, there is provided an image forming apparatus configured to form an image by causing a liquid droplet to be discharged from a liquid discharge head, wherein the liquid discharge head is that of any of configurations 1 to 16 or that of the liquid cartridge of configuration 17 (configuration 19).

The above-described image forming apparatus includes a liquid discharge head or a liquid cartridge according to one embodiment of the present invention. Accordingly, the image forming apparatus can discharge droplets with stability and form a high-quality image.

According to one embodiment of the present invention, there is provided a liquid discharge head including a plurality of individual channels communicating with corresponding nozzles from which liquid is discharged; a common channel configured to supply the liquid to the individual channels; a buffer chamber adjacent to the common channel through a deformable part; and a communicating path connecting the buffer chamber and an outside (configuration 20).

According to the above-described liquid discharge head, the deformable part serving as a wall face of the buffer chamber is prevented from being exposed to the outside. Accordingly, layout restrictions are reduced. Further, by the buffer chamber communicating with the outside through the communicating path, it is possible to absorb even a large pressure variation so that it is possible to control mutual interference with efficiency.

According to one embodiment of the present invention, there is provided a liquid discharge head including a plurality of individual channels communicating with corresponding nozzles from which liquid is discharged; a common channel configured to supply the liquid to the individual channels; a buffer chamber adjacent to the common channel through a deformable part, a communicating path connecting the buffer chamber and an outside; and a deformable portion provided in the communicating path (configuration 21).

According to the above-described liquid discharge head, the deformable part serving as a wall face of the buffer chamber is prevented from being exposed to the outside. Accordingly, layout restrictions are reduced. Further, since the buffer chamber has a deformable portion in the communicating path, it is possible to absorb even a large pressure variation so that it is possible to control mutual interference with efficiency.

Additionally, in the liquid discharge head as set forth in configuration 21, the deformable portion may be a diaphragm (configuration 22).

According to one embodiment of the present invention, there is provided a liquid discharge head including a plurality of individual channels communicating with corresponding nozzles from which liquid is discharged; a common channel configured to supply the liquid to the individual channels; a buffer chamber adjacent to the common channel through a deformable part; a communicating path connecting the buffer chamber and an outside; and a buffer material provided in the buffer chamber (configuration 23).

According to the above-described liquid discharge head, the deformable part serving as a wall face of the buffer chamber is prevented from being exposed to the outside. Accordingly, layout restrictions are reduced. Further, since a buffer material is provided in the buffer chamber, it is possible to absorb even a large pressure variation so that it is possible to control mutual interference with efficiency.

Additionally, in the liquid discharge head as set forth in any of configurations 20 to 23, the communicating path may have an opening on a side of the buffer chamber, the opening being prevented from opposing the deformable part of the buffer chamber (configuration 24).

Additionally, in the liquid discharge head as set forth in any of configurations 20 to 24, the communicating path may be open to the outside on a side of a member in which the nozzles are formed (configuration 25).

Additionally, in the liquid discharge head as set forth in any of configurations 20 to 24, the communicating path may be open to the outside on a side opposite to a surface on which the nozzles are open (configuration 26).

Additionally, in the liquid discharge head as set forth in any of configurations 20 to 26, the buffer chamber may be formed of at least two stacked members, the buffer chamber may include a plurality of first buffer chamber parts and a plurality of second buffer chamber parts, the first buffer chamber parts being formed of a first one of the stacked members, the first one being in contact with the deformable part, the second buffer chamber parts being formed of a second one of the stacked members, the second one being out of contact with the deformable part, and the first buffer chamber parts and the second buffer chamber parts may be positioned to be offset from each other in a direction in which the nozzles are arranged (configuration 27).

Additionally, in the liquid discharge head as set forth in any of configurations 20 to 27, the deformable part of the buffer chamber may be formed as a part of a diaphragm forming a wall face of each of the individual channels (configuration 28).

According to one embodiment of the present invention, there is provided a liquid discharger configured to discharge a liquid droplet from a liquid discharge head, wherein the liquid discharge head is that of any of configurations 20 to 28 (configuration 29).

The above-described liquid discharger includes a liquid discharge head according to one embodiment of the present invention. Accordingly, the liquid discharger can discharge droplets with stability.

According to one embodiment of the present invention, there is provided an image forming apparatus configured to form an image by causing a liquid droplet to be discharged from a liquid discharge head, wherein the liquid discharge head is that of any of configurations 20 to 28 (configuration 30).

The above-described image forming apparatus includes a liquid discharge head according to one embodiment of the present invention. Accordingly, the image forming apparatus can discharge droplets with stability and form a high-quality image.

According to one embodiment of the present invention, there is provided a liquid discharge head including a plurality of individual channels communicating with corresponding nozzles from which the liquid is discharged; a diaphragm configured to form at least one wall face of each of the individual channels; a common channel configured to supply the liquid to the individual channels; a damper chamber formed of a member forming the individual channels, the damper chamber being adjacent to the common liquid chamber; and a deformable part configured to form a wall part between the damper chamber and the common liquid chamber, the deformable part being a part of the diaphragm (configuration 31).

According to the above-described liquid discharge head, it is possible to provide the common channel separately from the channel member, so that it is possible to ensure capacity of the common channel. Further, since the deformable part serving as a wall face of the damper chamber is prevented from being exposed to the outside, layout restrictions are reduced. Further, it is possible to absorb a pressure variation and to control mutual interference with efficiency.

Additionally, the liquid discharge head as set forth in configuration 31 may further include a communicating path connecting the damper chamber and an outside (configuration 32).

Additionally, in the liquid discharge head as set forth in configuration 32, the communicating path may be open to the outside on a side opposite to a surface on which the nozzles are open (configuration 33).

Additionally, in the liquid discharge head as set forth in configuration 33, the communicating path may be open to a space in which a piezoelectric element deforming the diaphragm is provided (configuration 34).

Additionally, in the liquid discharge head as set forth in any of configurations 31 to 34, the channel member forming the individual channels and one of a nozzle plate in which the nozzles are formed and the diaphragm are integrated by electroforming (configuration 35).

According to one embodiment of the present invention, there is provided a liquid discharge head including a plurality of individual channels communicating with corresponding nozzles from which liquid is discharged; a diaphragm configured to form at least one wall face of each of the individual channels; a common channel configured to supply the liquid to the individual channels; a damper chamber adjacent to the common channel; a deformable part configured to form a wall part between the common channel and the damper chamber, the deformable part being a part of the diaphragm; a vibration damping material with which the damper chamber is filled; and at least two communicating paths configured to connect the damper chamber and an outside (configuration 36).

According to the above-described liquid discharge head, since the deformable part serving as a wall face of the damper chamber is prevented from being exposed to the outside, layout restrictions are reduced. Further, since the damper chamber is filled with vibration damping material, it is possible to absorb a pressure variation and to control mutual interference with efficiency.

Additionally, in the liquid discharge head as set forth in configuration 36, the vibration damping material may be liquid (configuration 37).

Additionally, in the liquid discharge head as set forth in configuration 37, the liquid may be an oil-based material (configuration 38).

Additionally, in the liquid discharge head as set forth in configuration 36, the vibration damping material may be a viscoelastic material (configuration 39).

Additionally, in the liquid discharge head as set forth in configuration 39, the viscoelastic material may be a silicone-based material (configuration 40).

Additionally, in the liquid discharge head as set forth in any of configurations 36 to 40, an opening of the communication path may be sealed with the damping chamber being filled with the vibration damping material (configuration 41).

Additionally, in the liquid discharge head as set forth in any of configurations 36 to 41, the common channel may be formed in a frame member holding a periphery of the diaphragm (configuration 42).

According to one embodiment of the present invention, there is provided a liquid cartridge integrating a liquid discharge head and a tank supplying liquid to the liquid discharge head, wherein the liquid discharge head is that of any of configurations 31 to 42 (configuration 43).

The above-described liquid cartridge includes a liquid discharge head according to one embodiment of the present invention. Accordingly, it is possible to provide a liquid cartridge including liquid discharge head, in which layout restrictions are reduced and it is possible to absorb a pressure variation and to control mutual interference with stability.

According to one embodiment of the present invention, there is provided a liquid discharger configured to discharge a liquid droplet from a liquid discharge head, wherein the liquid discharge head is that of any of configurations 31 to 42 or that of the liquid cartridge of configuration 43 (configuration 44).

The above-described liquid discharger includes a liquid discharge head or a liquid cartridge according to one embodiment of the present invention. Accordingly, the liquid discharger can discharge droplets with stability.

According to one embodiment of the present invention, there is provided an image forming apparatus configured to form an image by causing a liquid droplet to be discharged from a liquid discharge head, wherein the liquid discharge head is that of any of configurations 31 to 42 or that of the liquid cartridge of configuration 43 (configuration 45).

The above-described image forming apparatus includes a liquid discharge head or a liquid cartridge according to one embodiment of the present invention. Accordingly, the image forming apparatus can discharge droplets with stability and form a high-quality image.

According to the present invention, the term "communicating path" may mean a part that connect a buffer chamber and the outside (which part may be either open to the outside, or sealed or closed to the outside), and may include not only a "path or passage" but also an "opening" that may not be a "path or passage."

The present invention is not limited to the specifically disclosed embodiments, and variations and modifications may be made without departing from the scope of the present invention.

The present applications is based on Japanese Priority Patent Applications No. 2006-122629, filed on Apr. 26, 2006, No. 2006-138314, filed on May 17, 2006, and No. 2006-146105, filed on May 26, 2006, the entire contents of which are hereby incorporated by reference.

What is claimed is:

1. An image forming apparatus, comprising:

a liquid discharger including a liquid discharge head, the liquid discharge head being configured to discharge a droplet of liquid so as to form an image, the liquid discharge head including a plurality of individual channels communicating with corresponding nozzles from which the liquid is discharged;

a common channel configured to supply the liquid to the individual channels;

a buffer chamber adjacent to the common channel through a deformable part;

a communicating path connecting the buffer chamber and an outside; and a deformable portion provided in the communicating path, wherein:

the buffer chamber is formed of at least two stacked members, the buffer chamber includes a plurality of first buffer chamber parts and a plurality of second buffer chamber parts, the first buffer chamber parts being formed of a first one of the stacked members, the first one being in contact with the deformable part, the second buffer chamber parts being formed of a second one of the stacked members, the second one being out of contact with the deformable part, and the first buffer chamber parts and the second buffer chamber parts are positioned to be offset from each other in a direction in which the nozzles are arranged.

2. The image forming apparatus as claimed in claim 1, wherein the communicating path has an opening on a side of the buffer chamber, the opening being prevented from opposing the deformable part of the buffer chamber.

3. The image forming apparatus as claimed in claim 1, wherein the communicating path is open to the outside on a side of a member in which the nozzles are formed.

4. The image forming apparatus as claimed in claim 1, wherein the communicating path is open to the outside on a side opposite to a surface on which the nozzles are open.

5. The image forming apparatus as claimed in claim 1, wherein the buffer chamber is configured such that when a pressure variation caused in one of the channels is propagated to the common channel, the deformable part deforms so that the buffer chamber absorbs the pressure variation and air inside the buffer chamber escapes from the buffer chamber through the communicating path.

6. The image forming apparatus as claimed in claim 1, wherein the individual channels are adjacent to the common channel through the deformable part.

7. The image forming apparatus as claimed in claim 1, wherein the communicating path has an opening to the outside, and the deformable portion is a deformable thin film at the opening of the communicating path to the outside.

8. The image forming apparatus as claimed in claim 1, wherein the deformable portion provided in the communicating path is configured to absorb pressure variations in the buffer chamber.

9. The image forming apparatus as claimed in claim 1, wherein the deformable portion provided in the communicating path is a buffer material configured to reduce permeation of air from the outside into the buffer chamber.

10. The image forming apparatus as claimed in claim 1, wherein the deformable portion provided in the communicating path is a buffer material configured reduce permeation of evaporated liquid from the buffer chamber to the outside.

11. An image forming apparatus, comprising:

a liquid discharger including a liquid discharge head configured to discharge a droplet of liquid so as to form an image, the liquid discharge head including a plurality of individual channels configured to communicate with corresponding nozzles from which the liquid is discharged;

a common channel configured to supply the liquid to the individual channels;

a buffer chamber adjacent to the common channel through a deformable part, wherein the deformable part is disposed between the buffer chamber and the common channel;

a communicating path connecting the buffer chamber and an outside; and a deformable portion provided in the communicating path, wherein:

the buffer chamber is formed of at least two stacked members, the buffer chamber includes a plurality of first buffer chamber parts and a plurality of second buffer chamber parts, the first buffer chamber parts being formed of a first one of the stacked members, the first one being in contact with the deformable part, the second buffer chamber parts being formed of a second one of the stacked members, the second one being out of contact with the deformable part, and the first buffer chamber parts and the second buffer chamber parts are positioned to be offset from each other in a direction in which the nozzles are arranged.

* * * * *